US009218775B2

(12) United States Patent
Furuta et al.

(10) Patent No.: US 9,218,775 B2
(45) **Date of Patent: *Dec. 22, 2015**

(54) DISPLAY DRIVING CIRCUIT, DISPLAY DEVICE, AND DISPLAY DRIVING METHOD

(75) Inventors: Shige Furuta, Osaka (JP); Etsuo Yamamoto, Osaka (JP); Yuhichiroh Murakami, Osaka (JP); Seijirou Gyouten, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 600 days.

This patent is subject to a terminal disclaimer.

(21) Appl. No.: 13/501,174

(22) PCT Filed: Jun. 4, 2010

(86) PCT No.: PCT/JP2010/059547

§ 371 (c)(1),
(2), (4) Date: Apr. 10, 2012

(87) PCT Pub. No.: WO2011/045955

PCT Pub. Date: Apr. 21, 2011

(65) Prior Publication Data

US 2012/0206510 A1 Aug. 16, 2012

(30) Foreign Application Priority Data

Oct. 16, 2009 (JP) ..... 2009-239763

(51) Int. Cl.
*G09G 3/36* (2006.01)
*G09G 5/00* (2006.01)

(52) U.S. Cl.
CPC ..... *G09G 3/3614* (2013.01); *G09G 3/3655* (2013.01); *G09G 2310/0267* (2013.01)

(58) Field of Classification Search
CPC ..... G09G 3/3655
USPC ..... 345/100, 204
See application file for complete search history.

(56) References Cited

U.S. PATENT DOCUMENTS 8,933,918 B2 * 1/2015 Furuta et al. ..... 345/204
2002/0050971 A1 5/2002 Su et al.

(Continued)

FOREIGN PATENT DOCUMENTS

JP 07-146666 A 6/1995
JP 07-230077 A 8/1995

(Continued)

OTHER PUBLICATIONS

International Search Report.

(Continued)

*Primary Examiner* — Adam J Snyder
(74) *Attorney, Agent, or Firm* — Harness, Dickey & Pierce, P.L.C.

(57) ABSTRACT

A display device employing CC driving switches from (i) a first mode in which to carry out a display by converting resolution of a video signal by a factor of 2 in a column-wise direction to (ii) a second mode in which to carry out a display at the resolution of the video signal. During the first mode, signal potentials having the same polarity and the same gray scale are supplied to pixel electrodes included in respective two pixels that correspond to two adjacent scanning signal lines and that are adjacent to each other in the column-wise direction, and a direction of change in the signal potentials written to the pixel electrodes varies every two adjacent rows (2-line inversion driving). During the second mode, the direction of change in the signal potentials written to the pixel electrodes lines varies every single row (1-line inversion driving).

9 Claims, 29 Drawing Sheets

(56) References Cited

U.S. PATENT DOCUMENTS

| | | | | |
|---|---|---|---|---|
| 2002/0097921 | A1* | 7/2002 | Wakisawa et al. | 382/300 |
| 2002/0154084 | A1 | 10/2002 | Tanaka et al. | |
| 2003/0058229 | A1 | 3/2003 | Kawabe et al. | |
| 2005/0093806 | A1 | 5/2005 | Hosotani | |
| 2005/0110734 | A1 | 5/2005 | Hirosawa | |
| 2005/0110739 | A1* | 5/2005 | Kwon | 345/100 |
| 2006/0114208 | A1 | 6/2006 | Senda | |
| 2007/0188431 | A1* | 8/2007 | Sato et al. | 345/90 |
| 2008/0055300 | A1* | 3/2008 | Yamazaki | 345/212 |
| 2008/0079680 | A1* | 4/2008 | Fujita | 345/89 |
| 2009/0073103 | A1 | 3/2009 | Tajiri | |
| 2009/0303168 | A1 | 12/2009 | Nagata | |
| 2010/0097369 | A1* | 4/2010 | Fujita | 345/213 |
| 2010/0128009 | A1* | 5/2010 | Okada et al. | 345/205 |
| 2011/0169790 | A1 | 7/2011 | Yanagawa et al. | |
| 2012/0086689 | A1* | 4/2012 | Furuta et al. | 345/96 |

FOREIGN PATENT DOCUMENTS

| | | | |
|---|---|---|---|
| JP | 2001-083943 | A | 3/2001 |
| JP | 2002-149117 | A | 5/2002 |
| JP | 2002-182624 | A | 6/2002 |
| JP | 2006-145923 | A | 6/2006 |
| JP | 2007-094027 | A | 4/2007 |
| JP | 2009-069562 | A | 4/2009 |
| JP | 2009-075225 | A | 4/2009 |
| JP | 2009-116122 | A | 5/2009 |
| WO | WO-2008-114479 | A1 | 9/2008 |
| WO | WO 2009050926 | A1 * | 4/2009 |
| WO | WO-2010032526 | A1 | 3/2010 |
| WO | WO-2010-146741 | A1 | 12/2010 |
| WO | WO-2011-045954 | A1 | 4/2011 |

OTHER PUBLICATIONS

International Search Report (PCT/ISA/210) and Written Opinion (PCT/ISA/237) dated May 11, 2010 for International Application No. PCT/JP2010/001322.

Office Action issued in U.S. Appl. No. 13/377,847 dated Dec. 13, 2013.

Office Action issued in U.S. Appl. No. 13/377,847 dated Apr. 18, 2014.

Advisory Action issued in U.S. Appl. No. 13/377,847 dated Jul. 30, 2014.

Notice of Allowance issued in U.S. Appl. No. 13/377,847 dated Sep. 15, 2014.

* cited by examiner

Prior Art

Prior Art

DISPLAY DRIVING CIRCUIT, DISPLAY DEVICE, AND DISPLAY DRIVING METHOD

TECHNICAL FIELD

The present invention relates to driving of display devices such as liquid crystal display devices having active-matrix liquid crystal display panels and, in particular, to a display driving circuit and a display driving method for driving a display panel in a display device employing a drive system referred to as CC (charge coupling) driving.

BACKGROUND ART

A conventional CC driving system that is employed in an active-matrix liquid crystal display device is disclosed, for example, in Patent Literature 1. CC driving is explained by taking as an example the content of disclosure in Patent Literature 1.

FIG. 26 shows a configuration of a device that realizes CC driving. FIG. 27 shows operating waveforms of various signals in CC driving of the device of FIG. 26.

As shown in FIG. 26, the liquid crystal display device that carries out CC driving includes an image display section 110, a source line driving circuit 111, a gate line driving circuit 112, and a CS bus line driving circuit 113.

The image display section 110 includes a plurality of source lines (signal lines) 101, a plurality of gate lines (scanning lines) 102, switching elements 103; pixel electrodes 104; a plurality of CS (capacity storage) bus lines (common electrode lines) 105, retention capacitors 106, liquid crystals 107, and a counter electrode 109. The switching elements 103 are disposed near points of intersection between the plurality of source lines 101 and the plurality of gate lines 102, respectively. The pixel electrodes 104 are connected to the switching elements 103, respectively.

The CS bus lines 105 are paired with the gate lines 102, respectively, and arrange in parallel with one another. Each of the retention capacitor 106 has one end connected to a pixel electrode 104 and the other end connected to a CS bus line 105. The counter electrode 109 is provided in such a way as to face the pixel electrodes 104 with the liquid crystals 107 sandwiched therebetween.

The source line driving circuit 111 is provided so as to drive the source lines 101, and the gate line driving circuit 112 is provided so as to drive the gate lines 102. Further, the CS bus line driving circuit 113 is provided so as to drive the CS bus lines 105.

Each of the switching elements 103 is formed by amorphous silicon (a-Si), polycrystalline silicon (p-Si), monocrystalline silicon (c-Si), and the like. Because of such a structure, a capacitor 108 is formed between the gate and the drain of the switching element 103. This capacitor 108 causes a phenomenon in which a gate pulse signal from a gate line 102 shifts the electric potential of a pixel electrode 104 toward a negative side.

As shown in FIG. 27, the electric potential Vg of a gate line 102 in the liquid crystal display device is Von only during an H period (horizontal scanning period) in which the gate line 102 is selected, and retained at Voff during the other periods. The electric potential Vs of a source line 101 varies in amplitude depending on a video signal to be displayed, but takes a waveform whose polarity stays the same for all pixels of the same row and is reversed every single row (single horizontal scanning period) (1-line (1H) inversion driving). Since it is assumed in FIG. 27 that a uniform video signal is being inputted, the electric potential Vs changes with constant amplitude.

The electric potential Vd of the pixel electrode 104 is equal to the electric potential Vs of the source line 101 because the switching element 103 conducts during a period in which the electric potential Vg is Von and, at the moment the electric potential Vg becomes Voff, the electric potential Vd shifts slightly toward a negative side through the gate-drain capacitor 108.

The electric potential Vc of a CS bus line 105 is Ve+ during an H period in which the corresponding gate line 102 is selected and the next H period. Further, the electric potential Vc switches to Ve− during the H period after the next, and then retained at Ve− until the next field. This switching causes the electric potential Vd to be shifted toward a negative side through the retention capacitor 106.

In the result, the electric potential Vd changes with larger amplitude than the electric potential Vs; therefore, the amplitude of change in the electric potential Vs can be made smaller. This allows achieving a simplification of circuitry and a reduction of power consumption in the source line driving circuit 111.

CITATION LIST

Patent Literature 1

Japanese Patent Application Publication, Tokukai, 2001-83943 A (Publication Date: Mar. 30, 2001)

SUMMARY OF INVENTION

Technical Problem

However, the liquid crystal display device is premised on line (1H) inversion driving by which the polarity of the voltage of a pixel electrode is reversed every single row (single line, single horizontal scanning period). That is, driving is carried out so that the electric potential of a CS signal varies every single line. Therefore, the electric potential of a CS signal cannot be made to vary, for example, every two rows. This causes such a problem, for example, that when the liquid crystal display device switches from (i) a display mode (hereinafter referred to also as "normal display driving") in which to carry out a display by 1-line inversion driving to (ii) a display mode (hereinafter referred to also as "resolution conversion driving") in which to carry out a display by converting resolution of a video signal into higher resolution, there appear alternate bright and dark transverse stripes in a display picture.

The following description discusses why transverse stripes appear when the liquid crystal display device switches from normal display driving to resolution conversion driving. (a) of FIG. 28 shows (i) display pictures displayed during normal display driving and (ii) polarities of signal potentials supplied to pixel electrodes corresponding to the display pictures. (b) of FIG. 28 shows (i) the display picture shown in the upper left area (enclosed by a dotted line) in (a) of FIG. 28 and (ii) polarities of signal potentials supplied to the pixel electrodes as observed in a case where the resolution of the corresponding video signal has been converted by a factor of 2 both in row-wise and column-wise directions (double-size display). In the case pf double-size conversion, for example, the single pixel located in the third row and the second column in (a) of FIG. 28 corresponds to the four pixels located in the fifth and sixth rows and the third and fourth columns.

Resolution conversion driving is carried out such that depending on the conversion factor, signals having the same polarity and the same electric potential (gray scale) are supplied to a plurality of pixels adjacent to each other in the column-wise direction (scanning direction). For example, in the case of normal display driving in the first frame and double-size display in the second frame, a source signal S supplied to the pixel electrode of the pixel located in the third row and the second column shown in (a) of FIG. 28 and a source signal S supplied to the pixel electrode of each of the pixels located in the fifth and sixth rows and the third and fourth columns are equal in polarity (which is here a negative polarity) and electric potential (gray scale) to each other.

FIG. 29 is a timing chart showing waveforms of various signals observed in a case where a conventional liquid crystal display device has switched from normal display driving to resolution conversion driving (double-size display driving).

FIG. 29 assumes that the Xth frame is a given frame of a display picture, that the (X−1)th frame is a frame that comes immediately before the Xth frame, and that the (X+1)th frame is a frame that comes immediately after the Xth frame. It is also assumed that normal display driving (1-line inversion driving) is carried out in the Xth frame, and that resolution conversion driving (double-size display driving) is carried out in the (X−1)th frame.

In FIG. 29, GSP is a gate start pulse signal that defines a timing of vertical scanning, and GCK1 (CK) and GCK2 (CKB) are gate clock signals that are outputted from the control circuit to define a timing of operation of the shift register. A period from a falling edge to the next falling edge in GSP corresponds to a single vertical scanning period (1V period). A period from a rising edge in GCK1 to a rising edge in GCK2 and a period from a rising edge GCK2 to a rising edge in GCK1 each correspond to a single horizontal scanning period (1H period). CMI is a polarity signal that reverses its polarity every single horizontal scanning period.

Further, FIG. 29 shows the following signals in the order named: a source signal S (video signal), which is supplied from the source line driving circuit 111 in the Xth frame to a source line 101 provided in the xth column; a source signal S (video signal), which is supplied from the source line driving circuit 111 in the (X−1)th frame to a source line 101 provided in the yth column (column of pixels after resolution conversion that corresponds to the xth column), a gate signal G1, which is supplied from the gate line driving circuit 112 to a gate line 102 provided in the first row; a CS signal CS1, which is supplied from the CS bus line driving circuit 113 to a CS bus line 105 provided in the first row; and an electric potential Vpix1 of a pixel electrode provided in the first row and the xth column (Xth frame) and yth column ((X+1)th frame). Similarly, FIG. 29 shows the following signals in the order named: a gate signal G2, which is supplied to a gate line 102 provided in the second row; a CS signal CS2, which is supplied to a CS bus line 105 provided in the second row; and an electric potential Vpix2 of a pixel electrode provided in the second row and the xth column(Xth frame) and yth column ((X+1)th frame). The same applies to the third to fifth rows.

It should be noted that the dotted lines in the electric potentials Vpix1 to Vpix5 indicate the electric potential of the counter electrode 109.

In the Xth frame, the source signal S is assigned the reference signs "AA" to "HA" each correspond to a single horizontal scanning period and indicating a signal potential (gray scale) during that single horizontal scanning period. For example, the source signal S exhibits a signal potential of a negative polarity ("AA") during the first horizontal scanning period, a signal potential of a positive polarity ("KA") during the second horizontal scanning period, and a signal potential of a negative polarity ("SA") during the third horizontal scanning period.

Moreover, the CS signals CS1 to CS5 are reversed after their corresponding gate signals G1 to G5 fall, and take such waveforms that they are opposite in direction of reversal to one another. Specifically, the CS signals CS2 and CS4 rise after their corresponding gate signals G2 and G4 falls, and the CS signals CS1, CS3, and CS5 fall after their corresponding gate signals G1, G3, and G5 fall.

With this, in the Xth frame, the electric potentials Vpix1 to Vpix5 of the pixel electrodes are subjected to an electric potential shift according to the changes in electric potential of the CS signals CS1 to CS5, so that 1-line inversion driving is properly achieved.

In the (X+1)th frame, on the other hand, the source signal S exhibits identical signal potentials of a positive polarity ("AA") during the first and second horizontal scanning periods, and exhibits identical signal potentials of a negative polarity ("KA") during the third and fourth horizontal scanning periods.

Then, the CS signals CS1 to CS5 are reversed as in the Xth frame; that is, the CS signals CS2 and CS4 rise after their corresponding gate signals G2 and G4 falls, and the CS signals CS1, CS3, and CS5 fall after their corresponding gate signals G1, G3, and G5 fall.

Thus, whereas, in the (X+1)th frame, the source signal S reverses its polarity every two lines, each of the CS signals CS reverses its polarity every single line. This prevents the electric potentials Vpix2 and Vpix 3 of the pixel electrodes from being properly subjected to an electric potential shift. Therefore, although the source signals S being inputted in the first and second rows have the same gray scale ("AA"), there occurs a difference in luminance due to a difference between the electric potentials Vpix1 and Vpix2. Similarly, although the source signals S being inputted in the third and fourth rows have the same gray scale ("KA"), there occurs a difference in luminance due to a difference between the electric potentials Vpix3 and Vpix4. Therefore, there appear alternate bright and dark transverse stripes in a display picture in the (X+1)th frame (as indicated by shaded areas in FIG. 29).

Thus, if the conventional liquid crystal display device switches from the display mode of normal display driving to the display mode of driving with conversion in resolution, there will undesirably appear alternate bright and dark transverse stripes in a display picture. The above example is a case where the conversion factor is of a double size. However, also in a case where the conversion factor is of a triple size or the resolution has been converted only in the column-wise direction, there will undesirably appear alternate bright and dark transverse stripes in a display picture. That is, it is difficult for the conventional technology to alternatively switch between (i) a first mode in which to carry out a display by converting resolution of a video signal by a factor of n (n is an integer) (in the above example, n=1) and (ii) a second mode in which to carry out a display by converting the resolution of the video signal by a factor of m (m is an integer different from n) (in the above example, m=2).

The present invention has been made in view of the foregoing problems, and it is an object of the present invention is to provide a display driving circuit and a display driving method each of which allows a display device employing CC driving to, without lowering display quality, alternately switch between (i) a first mode in which to carry out a display by converting resolution of a video signal by a factor of n (n is an integer) and (ii) a second mode in which to carry out a display by converting the resolution of the video signal by a factor of m (m is an integer different from n).

Solution to Problem

A display driving circuit according to the present invention is a display driving circuit for use in a display device in which by supplying retention capacitor wire signals to retention capacitor wires forming capacitors with pixel electrodes included in pixels, signal potentials written to the pixel electrodes from data signal lines are changed in a direction corresponding to polarities of the signal potentials, the display driving circuit alternately switching between (i) a first mode in which to carry out a display by converting resolution of a video signal by a factor of n (n is an integer of two or greater) at least in a column-wise direction, assuming that a direction in which scanning signal lines extend is a row-wise direction, and (ii) a second mode in which to carry out a display by converting the resolution of the video signal by a factor of m (m is an integer different from n) at least in the column-wise direction, during the first mode, signal potentials having the same polarity and the same gray scale being supplied to pixel electrodes included in respective n pixel(s) that correspond to n adjacent scanning signal line(s) and that are adjacent to each other in the column-wise direction, a direction of change in the signal potentials written to the pixel electrodes from the data signal lines varying every n adjacent row(s), during the second mode, signal potentials having the same polarity and the same gray scale being supplied to pixel electrodes included in respective m pixel(s) that correspond to m adjacent scanning signal line(s) and that are adjacent to each other in the column-wise direction, and the direction of change in the signal potentials written to the pixel electrodes from the data signal lines varying every m adjacent row(s).

According to the display driving circuit, the signal potentials written to the pixel electrodes are changed by the retention capacitor wire signals in the direction corresponding to the polarity of the signal potential. This achieves the CC driving.

The display driving circuit is configured to alternately switch, in such CC driving, between (i) a first mode in which to carry out a display by converting resolution of a video signal by a factor of n (n is an integer of two or greater) at least in a column-wise direction, and (ii) a second mode in which to carry out a display by converting the resolution of the video signal by a factor of m (m is an integer different from n) at least in the column-wise direction. Further, during the first mode, the display driving circuit supplies signal potentials having the same gray scale to pixel electrodes included in respective n pixel(s) that are adjacent to each other in the column-wise direction, and carries out n-line inversion driving. During the second mode, the display driving circuit supplies signal potentials having the same gray scale to pixel electrodes included in respective m pixel(s) that are adjacent to each other in the column-wise direction, and carries out m-line inversion driving.

This allows the signal potentials written to the pixel electrodes to be properly subjected to an electric potential shift, thus making it possible to eliminate the appearance of alternate bright and dark transverse stripes in a display picture (see FIG. 29). This allows a display device employing CC driving to, without lowering display quality, alternately switch between (i) a first mode in which to carry out a display by converting resolution of a video signal by a factor of n (n is an integer) and (ii) a second mode in which to carry out a display by converting the resolution of the video signal by a factor of m (m is an integer different from n).

A display device according to the present invention includes: any one of the display driving circuits above; and a display panel.

A display driving method according to the present invention is a display driving method for driving a display device in which by supplying retention capacitor wire signals to retention capacitor wires forming capacitors with pixel electrodes included in pixels, signal potentials written to the pixel electrodes from data signal lines are changed in a direction corresponding to polarities of the signal potentials, the display driving method comprising alternately switching between (i) a first mode in which to carry out a display by converting resolution of a video signal by a factor of n (n is an integer of two or greater) at least in a column-wise direction, assuming that a direction in which scanning signal lines extend is a row-wise direction, and (ii) a second mode in which to carry out a display by converting the resolution of the video signal by a factor of m (m is an integer different from n) at least in the column-wise direction, during the first mode, signal potentials having the same polarity and the same gray scale being supplied to pixel electrodes included in respective n pixel(s) that correspond to n adjacent scanning signal line(s) and that are adjacent to each other in the column-wise direction, a direction of change in the signal potentials written to the pixel electrodes from the data signal lines varying every n adjacent row(s), during the second mode, signal potentials having the same polarity and the same gray scale being supplied to pixel electrodes included in respective m pixel(s) that correspond to m adjacent scanning signal line(s) and that are adjacent to each other in the column-wise direction, and the direction of change in the signal potentials written to the pixel electrodes from the data signal lines varying every m adjacent row(s).

The display driving method can bring about the same effects as those brought about by the configuration of the display driving circuit.

Advantageous Effects of Invention

As described above, the display driving circuit and the display driving method according to the present invention are configured to, in CC driving, alternately switch between (i) a first mode in which to carry out a display by converting resolution of a video signal by a factor of n (n is an integer of two or greater) at least in a column-wise direction, assuming that a direction in which scanning signal lines extend is a row-wise direction, and (ii) a second mode in which to carry out a display by converting the resolution of the video signal by a factor of m (m is an integer different from n) at least in the column-wise direction, during the first mode, signal potentials having the same polarity and the same gray scale being supplied to pixel electrodes included in respective n pixel(s) that correspond to n adjacent scanning signal line(s) and that are adjacent to each other in the column-wise direction, a direction of change in the signal potentials written to the pixel electrodes from the data signal lines varying every n adjacent row(s), during the second mode, signal potentials having the same polarity and the same gray scale being supplied to pixel electrodes included in respective m pixel(s) that correspond to m adjacent scanning signal line(s) and that are adjacent to each other in the column-wise direction, and the direction of change in the signal potentials written to the pixel electrodes from the data signal lines varying every m adjacent row(s).

This allows a display device employing CC driving to, without lowering display quality, alternately switch between (i) a first mode in which to carry out a display by converting resolution of a video signal by a factor of n (n is an integer) and (ii) a second mode in which to carry out a display by converting the resolution of the video signal by a factor of m (m is an integer different from n).

DESCRIPTION OF EMBODIMENTS

Embodiment 1

An embodiment of the present invention is described below with reference to the drawings.

Figure 1:
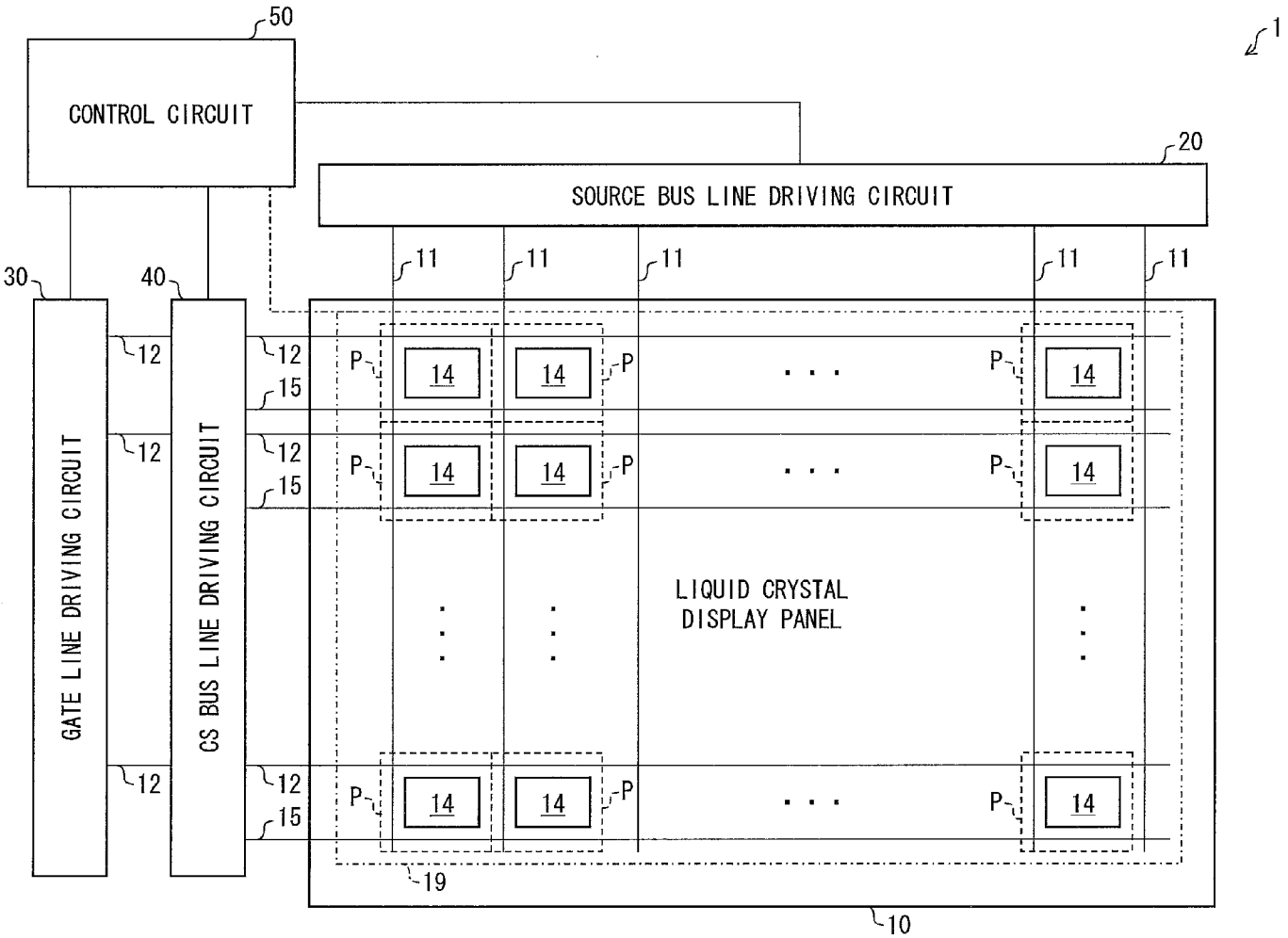
FIG. 1 is a block diagram showing a configuration of a liquid crystal display device according to an embodiment of the present invention.
Figure 2:
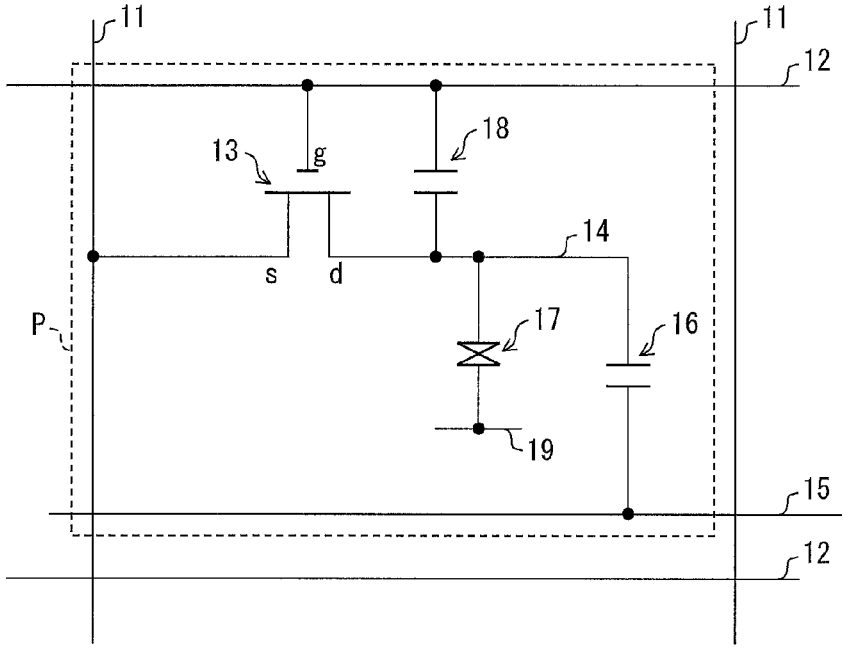
FIG. 2 is an equivalent circuit diagram showing an electrical configuration of each pixel in the liquid crystal display device of FIG. 1.

First, a configuration of a liquid crystal display device 1 corresponding to a display device of the present invention is described with reference to FIGS. 1 and 2. FIG. 1 is a block diagram showing an overall configuration of the liquid crystal display device 1, and FIG. 2 is an equivalent circuit diagram showing an electrical configuration of each pixel of the liquid crystal display device 1.

The liquid crystal display device 1 includes: an active-matrix liquid crystal display panel 10, which corresponds to a display panel of the present invention; a source bus line driving circuit 20, which corresponds to a data signal line driving circuit of the present invention; a gate line driving circuit 30, which corresponds to a scanning signal line driving circuit of the present invention; a CS bus line driving circuit 40, which corresponds to a retention capacitor wire driving circuit of the present invention; and a control circuit 50, which corresponds to a control circuit of the present invention.

The liquid crystal display panel 10, constituted by sandwiching liquid crystals between an active matrix substrate and a counter substrate (not illustrated), has a large number of pixels P arranged in rows and columns.

Moreover, the liquid crystal display panel 10 includes: source bus lines 11, provided on the active matrix substrate, which correspond to data signal lines of the present invention; gate lines 12, provided on the active matrix substrate, which correspond to scanning signal lines of the present invention; thin-film transistors (hereinafter referred to as "TFTs") 13, provided on the active matrix substrate, which correspond to switching element of the present invention; pixel electrodes 14, provided on the active matrix substrate, which correspond to pixel electrodes of the present invention; CS bus lines 15, provided on the active matrix substrate, which correspond to retention capacitor wires of the present invention; and a counter electrode 19 provided on the counter substrate. It should be noted that each of the TFTs 13, omitted from FIG. 1, is shown in FIG. 2 alone.

The source bus lines 11 are arranged one by one in columns in parallel with one another along a column-wise direction (longitudinal direction), and the gate lines 12 are arranged one by one in rows in parallel with one another along a row-wise direction (transverse direction). The TFTs are each provided in correspondence with a point of intersection between a source bus line 11 and a gate line 12, so are the pixel electrodes 14. Each of the TFTs 13 has its source electrode s connected to the source bus line 11, its gate electrode g connected to the gate line 12, and its drain electrode d connected to a pixel electrode 14. Further, each of the pixel electrode 14 forms a liquid crystal capacitor 17 with the counter electrode 19 with liquid crystals sandwiched between the pixel electrode 14 and the counter electrode 19.

With this, when a gate signal (scanning signal) supplied to the gate line 12 causes the gate of the TFT 13 to be on and a source signal (data signal) from the source bus line 11 is written to the pixel electrode 14, the pixel electrode 14 is given an electric potential corresponding to the source signal. In the result, the voltage corresponding to the source signal is applied to the liquid crystals sandwiched between the pixel electrode 14 and the counter electrode 19. This allows realization of a gray-scale display corresponding to the source signal.

The CS bus lines 15 are arranged one by one in rows in parallel with one another along a row-wise direction (transverse direction), in such a way as to be paired with the gate lines 12, respectively. The CS bus lines 15 each form a retention capacitor 16 (referred to also as "auxiliary capacitor") with each one of the pixel electrodes 14 arranged in each row, thereby being capacitively coupled to the pixel electrodes 14.

It should be noted that since, because of its structure, the TFT 13 has a pull-in capacitor 18 formed between the gate electrode g and the drain electrode d, the electric potential of the pixel electrode 14 is affected (pulled in) by a change in electric potential of the gate line 12. However, for simplification of explanation, such an effect is not taken into consideration here.

The liquid crystal display panel 10 thus configured is driven by the source bus line driving circuit 20, the gate line driving circuit 30, and the CS bus line driving circuit 40. Further, the control circuit 50 supplies the source bus line driving circuit 20, the gate line driving circuit 30, and the CS bus line driving circuit 40 with various signals that are necessary for driving the liquid crystal display panel 10.

In the present embodiment, during an active period (effective scanning period) in a vertical scanning period that is periodically repeated, each row is allotted a horizontal scanning period in sequence and scanned in sequence. For that purpose, in synchronization with a horizontal scanning period in each row, the gate line driving circuit 30 sequentially outputs a gate signal for turning on the TFTs 13 to the gate line 12 in that row. The gate line driving circuit 30 will be described in detail later.

The source bus line driving circuit 20 outputs a source signal to each source bus line 11. This source signal is obtained by the source bus line driving circuit 20 receiving a video signal from an outside of the liquid crystal display device 1 via the control circuit 50, allotting the video signal to each column, and giving the video signal a boost or the like.

Figure 4:
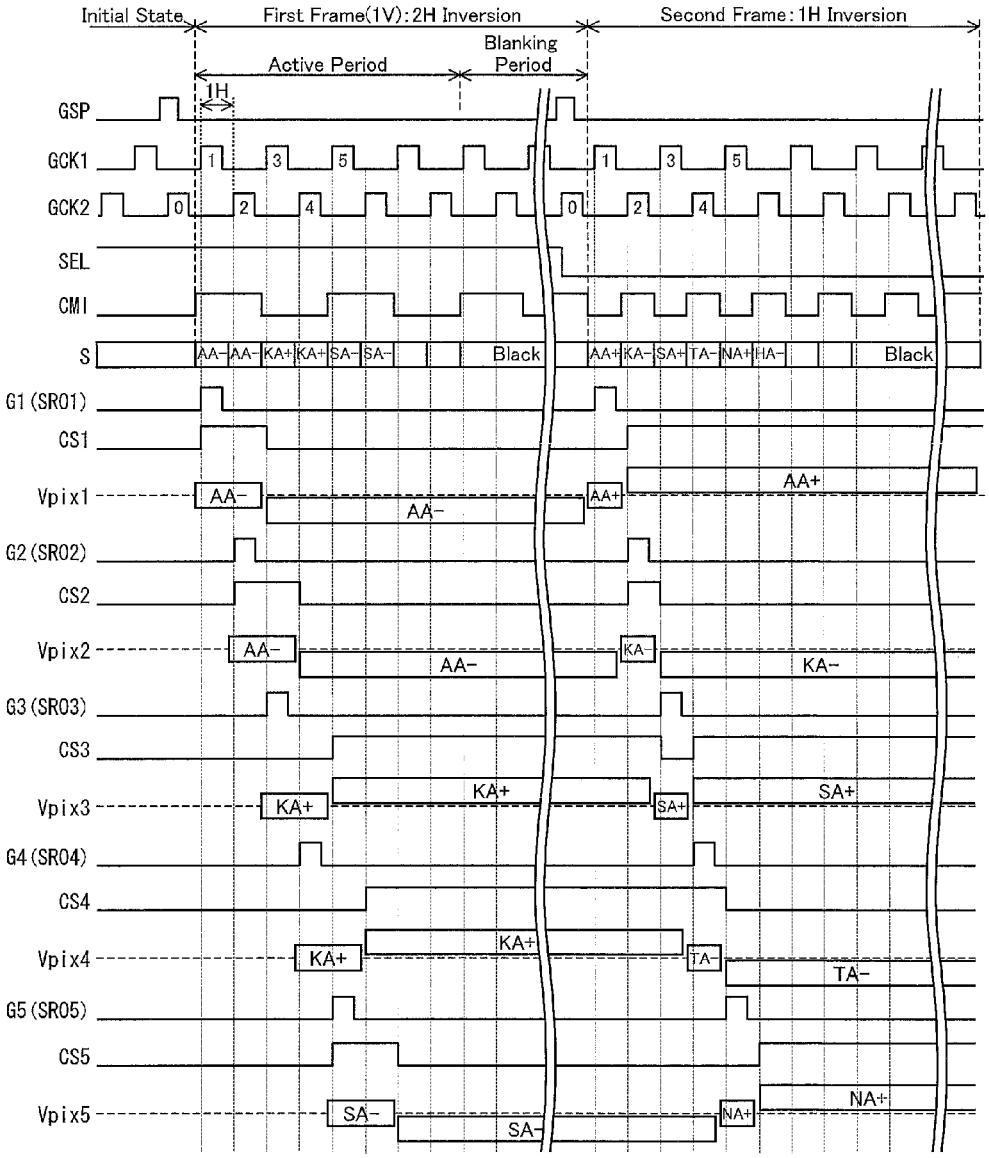
FIG. 4 is a timing chart showing waveforms of various signals of a liquid crystal display device in Example 1.

Further, in order to carry out n-line (nH) inversion driving or m-line (mH) inversion driving, the source bus line driving circuit 20 is configured such that the polarity of the source signal it outputs is identical for all pixels in an identical row and reversed every n line(s) or m line(s). It should be noted that n and m are integers that are different from each other. For example, as shown in FIG. 4, which shows driving timings of carrying out 2-line (2H) inversion driving in the first frame and 1-line (1H) inversion driving in the second frame, the horizontal scanning periods in the first and second rows and the horizontal scanning periods in the third and fourth rows are opposite in polarity of the source signal S from each other in the first frame, and the horizontal scanning period in the first row and the horizontal scanning period in the second row are opposite in polarity of the source signal S from each other in the second frame. That is, in the case of n-line (nH) inversion driving, the source signal S reverses its polarity (polarity of an electric potential of a pixel electrode) every n line(s) (n horizontal scanning period(s)), and in the case of m-line (mH) inversion driving, the source signal S reverses its polarity (polarity of an electric potential of a pixel electrode) every m line(s) (m horizontal scanning period(s)). It should be noted here that a switch between n-line (nH) inversion driving and m-line (mH) inversion driving can be made at any given timing, for example, every single frame.

Furthermore, in order to carry out a display based on a video signal whose resolution has been converted into higher resolution (by a factor of n or m) at least in the column-wise direction, the source bus line driving circuit 20 supplies signal potentials having the same polarity and the same gray scale every n row(s) (n line(s)) or m row(s) (m line(s)). For example, in a case of carrying out a display based on a video signal whose resolution has been converted by a factor of 2 in the column-wise direction, source signals S supplied to the first and second rows have the same voltage polarity and the same gray scale, whereas source signals S supplied to the third and fourth rows have the same voltage polarity and the same gray scale. It should be noted that although the following description assumes that one row (one line) corresponds to one horizontal scanning period, this does not imply any limitation on the present invention.

The CS bus line driving circuit 40 outputs a CS signal corresponding to a retention capacitor wire signal of the present invention to each CS bus line 15. This CS signal is a signal whose electric potential switches (rises or falls) between two values (high and low electric potentials), and is controlled such that the electric potential at a point in time where the TFTs 13 in the corresponding row are switched from on to off (i.e., at a point in time where the gate signal falls) varies every n line(s) or m line(s). The CS bus line driving circuit 40 will be described in detail later.

The control circuit 50 controls the gate line driving circuit 30, the source bus line driving circuit 20, and the CS bus line driving circuit 40, thereby causing each of them to output signals as shown in FIG. 4.

Figure 28:
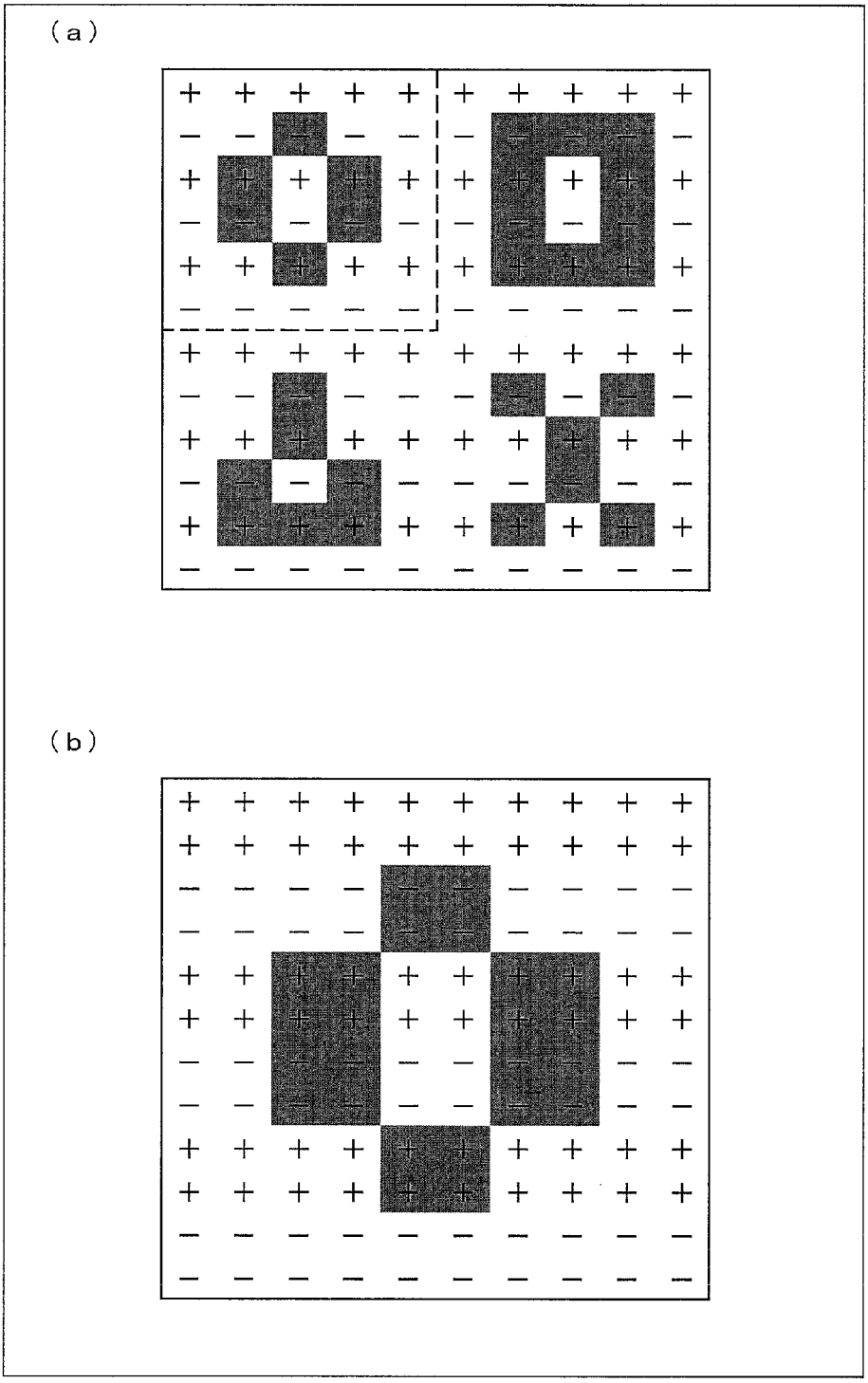
FIG. 28 is a set of diagrams (a) and (b) showing polarities of signal potentials supplied to pixel electrodes, (a) showing polarities of signal potentials supplied to pixel electrodes during normal driving, (b) showing (i) a display picture shown in the upper left area (enclosed by a dotted line) in (a) and (ii) polarities of signal potentials supplied to pixel electrodes as observed in a case where the resolution of a video signal has been converted by a factor of 2 (double-size display).

The liquid crystal display device having the above configuration is configured to alternately switch between (i) a first mode in which to carry out a display by converting resolution of a video signal by a factor of n (n is an integer) and (ii) a second mode in which to carry out a display by converting the resolution of the video signal by a factor of m (m is an integer different from n), to carry out n-line inversion driving during the first mode, and to carry out m-line inversion driving during the second mode. Although the liquid crystal display device in accordance with the present embodiment is configured to covert resolution of a video signal by a factor n or m at least in the column-wise direction, the liquid crystal display device may be configured to convert the resolution by a factor n or m in the row-wise direction as well as in the column-wise direction (see FIG. 28). An embodiment in which a display is carried out based on a video signal whose resolution has been converted by a factor of n (or m) only in the column-wise direction is represented as "longitudinal n-(or m-)fold-size display driving" conversion driving, and an embodiment in which a display is carried out based on a video signal whose resolution has been converted by a factor of n (or m) both in the column-wise and row-wise directions is represented as "n-(or m-)fold-size display driving". In the following, for convenience of explanation, an embodiment in which a display is carried out based on a video signal whose resolution has been converted by a factor of n or m only in the column-wise direction is taken as an example, with attention paid mainly to the same column of pixels.

Example 1

FIG. 4 is a timing chart showing waveforms of various signals observed in a case of changing from (i) using, in the first frame, a display mode (longitudinal double-size display driving) in which to carry out a display by converting resolution of a video signal by a factor of 2 (n=2) only in the column-wise direction to (ii) using, in the second frame, a display mode (normal display driving) in which to carry out a display without converting the resolution of the video signal (m=1). In FIG. 4, as in FIG. 29, GSP is a gate start pulse signal that defines a timing of vertical scanning, and GCK1 (CK) and GCK2 (CKB) are gate clock signals that are outputted from the control circuit 50 to define a timing of operation of the shift register. A period from a falling edge to the next falling edge in GSP corresponds to a single vertical scanning period (1V period). A period from a rising edge in GCK1 to a rising edge in GCK2 and a period from a rising edge GCK2 to a rising edge in GCK1 each correspond to a single horizontal scanning period (1H period). CMI is a polarity signal that reverses its polarity at predetermined timings.

Further, FIG. 4 shows the following signals in the order named: a source signal S (video signal), which is supplied from the source bus line driving circuit 20 to a source bus line 11 (source bus line 11 provided in the xth column); a gate signal G1, which is supplied from the gate line driving circuit 30 to a gate line 12 provided in the first row; a CS signal CS1, which is supplied from the CS bus line driving circuit 40 to a CS bus line 15 provided in the first row; and a potential waveform Vpix1 of a pixel electrode 14 provided in the first row and the xth column. FIG. 4 shows the following signals in the order named: a gate signal G2, which is supplied to a gate line 12 provided in the second row; a CS signal CS2, which is supplied to a CS bus line 15 provided in the second row; and a potential waveform Vpix2 of a pixel electrode 14 provided in the second row and the xth column. FIG. 4 shows the following signals in the order named: a gate signal G3, which is supplied to a gate line 12 provided in the third row; a CS signal CS3, which is supplied to a CS bus line 15 provided in the third row; and a potential waveform Vpix3 of a pixel electrode 14 provided in the third row and the xth column. As to the fourth and fifth rows, FIG. 4 similarly shows a gate signal G4, a CS signal CS4, and a potential waveform Vpix4 in the order named and a gate signal G5, a CS signal CS5, and a potential waveform Vpix5 in the order named.

It should be noted that the dotted lines in the electric potentials Vpix1, Vpix2, Vpix3, Vpix4, and Vpix5 indicate the electric potential of the counter electrode 19.

In the following, it is assumed that the start frame of a display picture is a first frame and that the first frame is preceded by an initial state. As shown in FIG. 4, during an initial state, the CS signals CS1 to CS5 are all fixed at one electric potential (in FIG. 4, at a low level). In the first frame, the CS signal CS1 in the first row is at a high level at a point in time where the corresponding gate signal G1 (which corresponds to the output SRO1 from the corresponding shift register circuit SR1) falls. The CS signal CS2 in the second row is at a high level at a point in time where the corresponding gate signal G2 falls. The CS signal CS3 in the third row is at a low level at a point in time where the corresponding gate signal G3 falls. The CS signal CS4 in the fourth row is at a low level at a point in time where the corresponding gate signal G4 falls. The CS signal CS5 in the fifth row is at a high level at a point in time where the corresponding gate signal G5 falls.

Then, the CS signals CS1 to CS5 switch between high and low electric potential levels after their corresponding gate signals G1 to G5 fall. Specifically, in the first frame, the CS signals CS1 and CS2 fall after their corresponding gate signals G1 and G2 fall, respectively, and the CS signals CS3 and CS4 rise after their corresponding signals G3 and G4 fall, respectively.

The source signal S in the first frame is a signal which has amplitude corresponding to a gray scale represented by a video signal and which reverses its polarity every two horizontal scanning periods (2H). Further, the source signal S in the first frame has the same electric potential (gray scale) during two adjacent horizontal scanning periods (2H) and has the same electric potential (gray scale) during next two adjacent horizontal scanning periods (2H). That is, each of the reference signs "AA" to "SA" shown in FIG. 4 corresponds to a single horizontal scanning period, and indicates a signal potential (gray scale) during that horizontal scanning period. The source signal S exhibits identical signal potentials of a negative polarity ("AA") during the first and second horizontal scanning periods, and exhibits identical signal potentials of a positive polarity ("KA") during the third and fourth horizontal scanning periods. The gate signals G1 to G5 serve as gate-on potentials during the first to fifth 1H periods, respectively, in an active period (effective scanning period) of each frame, and serve as gate-off potentials during the other periods.

In the second frame, on the other hand, the source signal S is a signal which has amplitude corresponding to a gray scale represented by a video signal and which reverses its polarity every single horizontal scanning period (1H). Further, the source signal S in the second frame corresponds to the gray scale of the first frame, and the source signal S in the second frame is assigned the reference signs "AA" to "SA" respectively corresponding to the reference signs "AA" to "SA" of the first frame. That is, the gray scale ("AA") of the first and second rows in the first frame and the gray scale ("AA") of the first row in the second frame are equal to each other. The gray scale ("KA") of the third and fourth rows in the first frame and the gray scale ("KA") of the second row in the second frame are equal to each other. The gray scale ("SA") of the fifth and sixth rows in the first frame and the gray scale ("SA") of the third row in the second frame are equal to each other. The gate signals G1 to G5 serve as gate-on potentials during the first to fifth 1H periods, respectively, in an active period (effective scanning period) of each frame, and serve as gate-off potentials during the other periods.

In the second frame, the CS signal CS1 in the first row is at a low level at a point in time where the corresponding gate signal G1 (which corresponds to the output SRO1 from the corresponding shift register circuit SR1) falls. The CS signal CS2 in the second row is at a high level at a point in time where the corresponding gate signal G2 falls. The CS signal CS3 in the third row is at a low level at a point in time where the corresponding gate signal G3 falls. The CS signal CS4 in the fourth row is at a high level at a point in time where the corresponding gate signal G4 falls. The CS signal CS5 in the fifth row is at a low level at a point in time where the corresponding gate signal G5 falls.

Then, the CS signals CS1 and CS3 rise after their corresponding gate signals G1 and G3 fall, respectively, and the CS signals CS2 and CS4 fall after their corresponding signals G3 and G4 fall, respectively.

Thus, in the first frame in which longitudinal double-size display diving is carried out, the electric potential of each CS signal at a point in time where the gate signal falls varies every two rows in correspondence with the polarity of the source signal S; therefore, the electric potentials Vpix1 to Vpix5 of the pixel electrodes 14 are all properly shifted by the CS signals CS1 to CS5, respectively. Therefore, inputting of source signals S of the same gray scale causes the positive and negative potential differences between the electric potential of the counter electrode and the shifted potential of each of the pixel electrodes 14 to be equal to each other. That is, in the first frame, in which source signals having a negative polarity and the same electric potential (gray scale) are written to pixels corresponding to two adjacent rows in the same column of pixels and source signals having a positive polarity and the same electric potential (gray scale) are written to pixels corresponding to two adjacent pixels next to the two rows in the same column of pixels, the electric potentials of the CS signals corresponding to the first two rows are not polarity-reversed during the writing to the pixels corresponding to the first two rows, are polarity-reversed in a negative direction after the writing, and are not polarity-reversed until the next writing, and the electric potentials of the CS signals corresponding to the next two rows are not polarity-reversed during the writing to the pixels corresponding to the next two rows, are polarity-reversed in a positive direction after the writing, and are not polarity-reversed until the next writing. This achieves longitudinal double-size display driving (2-line inversion driving) in CC driving. Further, the foregoing configuration allows the electric potentials Vpix1 to Vpix5 of the pixel electrodes 14 to be properly shifted by the CS signals CS1 to CS5, thus making it possible to eliminate possible appearance of transverse stripes in the first frame of a display picture.

Further, in the second frame in which normal driving (1-line inversion driving) is carried out, the electric potential of each CS signal at a point in time where the gate signal falls varies every adjacent rows in correspondence with the polarity of the source signal S; therefore, the electric potentials Vpix1 to Vpix5 of the pixel electrodes 14 are all properly shifted by the CS signals CS1 to CS5, respectively. Therefore, inputting of source signals S of the same gray scale causes the positive and negative potential differences between the electric potential of the counter electrode and the shifted potential of each of the pixel electrodes 14 to be equal to each other. That is, in the second frame, in which source signals having a positive polarity are written to the odd-numbered pixels of the same column of pixels and source signals having a negative polarity are written to the even-numbered pixels, the electric potentials of the CS signals corresponding to the odd-numbered pixels are not polarity-reversed during the writing to the odd-numbered pixels corresponding to the first two rows, are polarity-reversed in a positive direction after the writing, and are not polarity-reversed until the next writing, and the electric potentials of the CS signals corresponding to the even-numbered pixels are not polarity-reversed during the writing to the even-numbered pixels, are polarity-reversed in a negative direction after the writing, and are not polarity-reversed until the next writing. This achieves 1-line inversion driving in CC driving.

Moreover, the foregoing configuration allows the electric potentials Vpix1 to Vpix5 of the pixel electrodes 14 to be properly shifted by the CS signals CS1 to CS5, respectively, even in a case of a switch from longitudinal double-size display driving (2-line inversion driving) to normal display driving (1-line inversion driving). This allows pixel electrodes 14 that are supplied with the same signal potential during the first and second frames to be equal in electric potential to each other, thus making it possible to eliminate the appearance of transverse stripes shown in FIG. 29.

A specific configuration of the gate line driving circuit 30 and the CS bus line driving circuit 40 for achieving the aforementioned control is described here.

Figure 3:
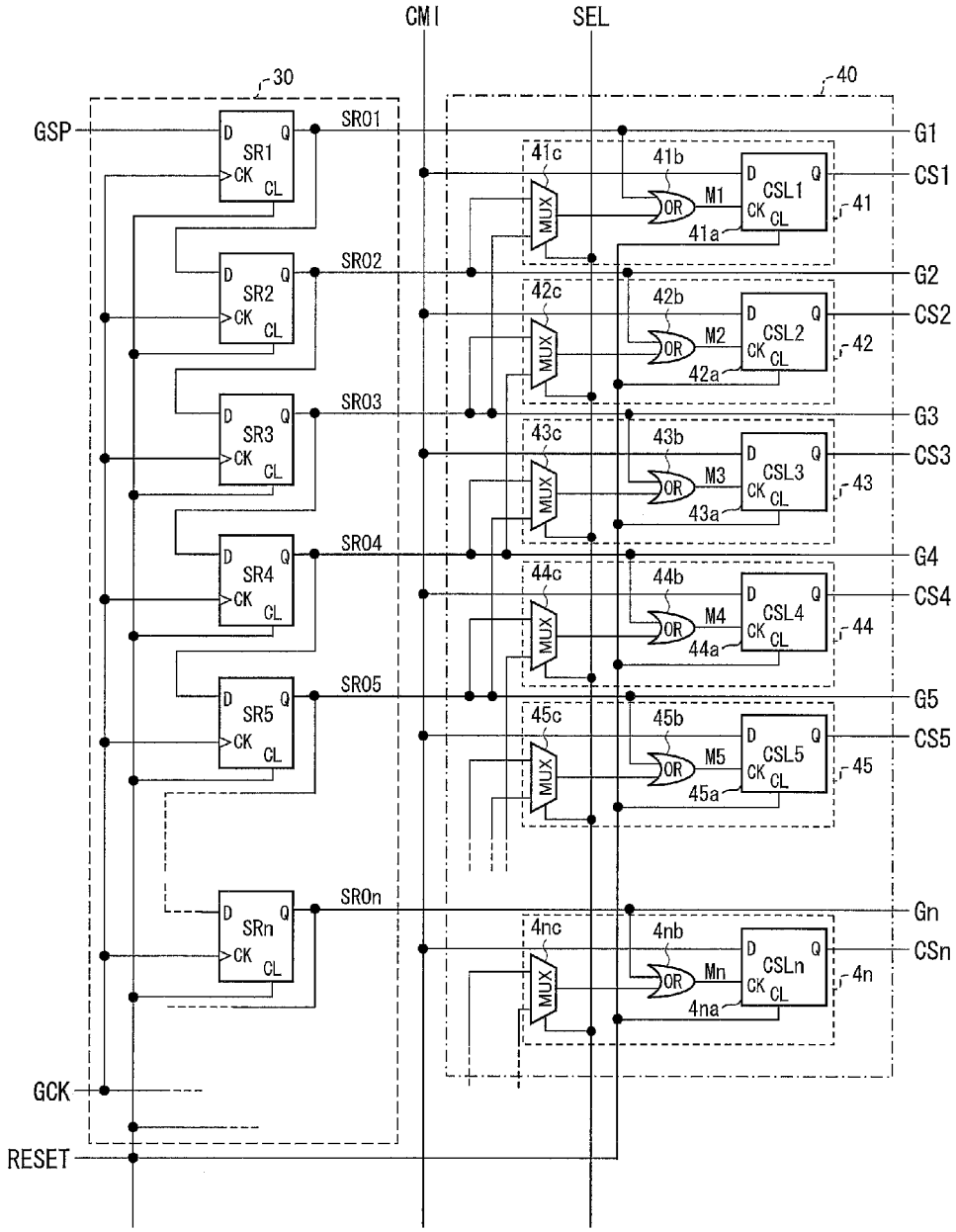
FIG. 3 is a block diagram showing a configuration of a gate line driving circuit and a CS bus line driving circuit in Example 1.

FIG. 3 shows a configuration of the gate line driving circuit 30 and the CS bus line driving circuit 40. The CS bus line driving circuit 40 includes a plurality of CS circuits 41, 42, 43, . . . , and 4*n* corresponding to respective rows. The CS circuits 41, 42, 43, . . . , and 4*n* include respective D latch circuits 41*a*, 42*a*, 43*a*, . . . , and 4*na*; respective OR circuits 41*b*, 42*b*, 43*b*, . . . , and 4*nb*; and respective MUX circuits (multiplexers) 41*c*, 42*c*, 43*c*, . . . , 4*nc*. The gate line driving circuit 30 includes a plurality of shift register circuits SR1, SR2, SR3, . . . , and SRn. Note here that, although the gate line driving circuit 30 and the CS bus line driving circuit 40 are located on one side of a liquid crystal display panel in FIGS. 1 and 3, this does not imply any limitation. The gate line driving circuit 30 and the CS bus line driving circuit 40 may be located on respective different sides of the liquid crystal display panel.

Input signals to the CS circuit 41 are a shift register output SRO1 corresponding to the gate signal G1, an output from the MUX circuit 41*c*, a polarity signal CMI, and a reset signal RESET. Input signals to the CS circuit 42 are a shift register output SRO2 corresponding to the gate signal G2, an output from the MUX circuit 42*c*, the polarity signal CMI, and the reset signal RESET. Input signals to the CS circuit 43 are a shift register output SRO3 corresponding to the gate signal G3, an output from the MUX circuit 43*c*, the polarity signal CMI, and the reset signal RESET. Input signals to the CS circuit 44 are a shift register output SRO4 corresponding to the gate signal G4, an output from the MUX circuit 44*c*, the polarity signal CMI, and the reset signal RESET. As described above, each CS circuit 4*n* receives a shift register output SROn in the corresponding nth row, an output from the MUX circuit 41*n*, and the polarity signal CMI. The polarity signal CMI and the reset signal RESET are supplied from the control circuit 50.

In the following, for convenience of description, mainly the CS circuits 42 and 43 corresponding to the second and third rows, respectively, are taken as an example.

The D latch circuit 42*a* receives the reset signal RESET via its reset terminal CL, receives the polarity signal CMI (rentention target signal) via its data terminal D, and receives an output from the OR circuit 42*b* via its clock terminal CK. In accordance with a change (from a low level to a high level or from a high level to a low level) in electric potential level of the signal that it receives via its clock terminal CK, the D latch circuit 41*a* outputs, as a CS signal CS2 indicative of the change in electric potential level, an input state (low level or high level) of the polarity signal CMI that it receives via its data terminal D.

Specifically, when the electric potential level of the signal that the D latch circuit 42*a* receives via its clock terminal CK is at a high level, the D latch circuit 42*a* outputs an input state (low level or high level) of the polarity signal CMI that it receives via its input terminal D. When the electric potential level of the signal that the D latch circuit 42*a* receives via its clock terminal CK has changed from a high level to a low level, the D latch circuit 42*a* latches an input state (low level or high level) of the polarity signal CMI that it receives via its terminal D at the time of change, and keeps the latched state until the next time when the electric potential level of the signal that the latch circuit 42*a* receives via its clock terminal CK is raised to a high level. Then, the D latch circuit 42*a* outputs the CS signal CS2, which indicates the change in electric potential level, via its output terminal Q.

Similarly, the D latch circuit 43*a* receives the resent signal RESET via its reset terminal CL, and receives the polarity signal CMI via its data terminal D. Meanwhile, the D latch circuit 43*a* receives, via its clock terminal CK, an output from the OR circuit 43*b*. This causes the D latch circuit 43*a* to output a CS signal CS2, which indicates a change in electric potential level, via its output terminal Q.

Figure 5:
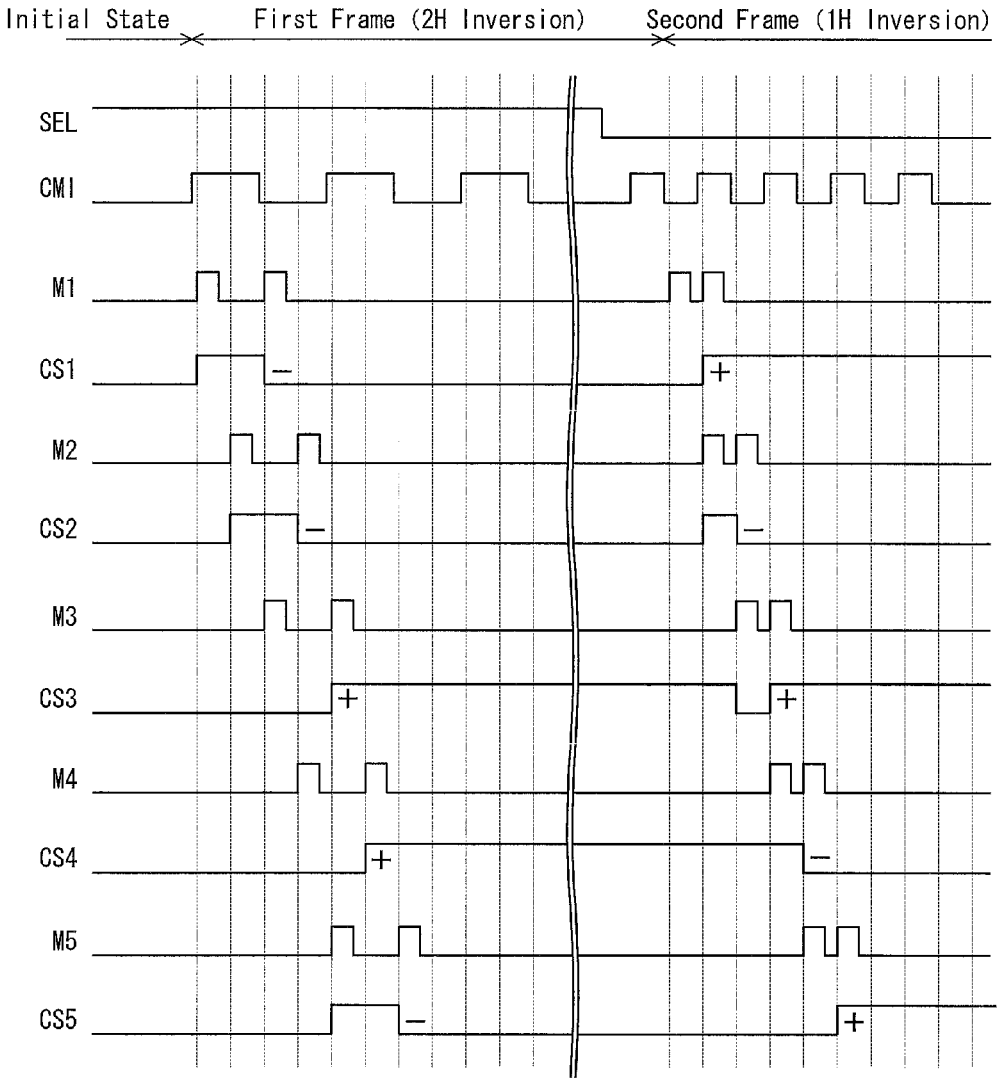
FIG. 5 is a timing chart showing waveforms of various signals that are inputted to and outputted from the CS bus line driving circuit in Example 1.

The OR circuit 42*b* receives the output signal SRO2 from the shift resister circuit SR2 and the output signal from the MUX circuit 42*c* in its corresponding second row and thereby outputs a signal M2 shown in FIGS. 3 and 5. Further, the OR circuit 43*b* receives the output signal SRO3 from the shift register circuit SR3 and the output signal from the MUX circuit 42*c* in its corresponding third row thereby outputs a signal M3 shown in FIGS. 3 and 5.

The MUX circuit 42*c* receives the output signal SRO3 from the shift register circuit SR3 in the third row, the output signal SRO4 from the shift register circuit SR4 in the fourth row, and a selection signal SEL, and outputs the shift register output SRO3 or the shift register output SRO4 to the OR circuit 42*b* in accordance with the selection signal SEL. For example, in a case where the selection signal SEL is at a high level, the MUX circuit 42*c* outputs the shift register output SRO4, and in a case where the selection signal SEL is at a low level, the MUX circuit 42*c* outputs the shift register output SRO3.

Thus, the OR circuit 4*nb* receives (i) an output signal SROn from the shift register circuit SRn in the nth row and (ii) either an output signal SROn+1 from the shift register circuit SRn+1 in the (n+1)th row or an output signal SROn+2 from the shift register circuit SRn+2 in the (n+2)th row.

The selection signal SEL is a switching signal for switching between 2-line inversion driving and 1-line inversion driving. In this example, 2-line inversion driving is carried out when the selection signal SEL is at a high level, and 1-line inversion driving is carried out when the selection signal SEL is at a low level. The polarity signal CMI varies in timing of polarity reversal according to the selection signal SEL. In this example, the polarity signal CMI reverses its polarity every two horizontal scanning periods when the selection signal SEL is at a high level, and reverses its polarity every single horizontal scanning period when the selection signal SEL is at a low level.

A shift register output SRO is generated by a well-known method in the gate line driving circuit 30 (see FIG. 3) which includes D-type flip-flop circuits. The gate line driving circuit 30. The gate line driving circuit 30 sequentially shifts a gate start pulse GSP, which is supplied from the control circuit 50, to a shift register circuit SR in the next stage at a timing of the gate clock GCK having a frequency of one horizontal scanning period. The gate line driving circuit 30 is not to be limited to this configuration, but may be configured differently.

FIG. 5 shows waveforms of various signals that are inputted to and outputted from the CS bus line driving circuit 40 of the liquid crystal display device 1 of Example 1. FIG. 5 shows waveforms as in a case where 2-line inversion driving is carried out in the first frame and 1-line inversion driving is carried out in the second frame. That is, in the first frame, the selection signal SEL is set to a high level, so that the polarity signal CMI reverses its polarity every two horizontal scanning periods, and in the second frame, the selection signal SEL is set to a low level, so that the polarity signal CMI reverses its polarity every single horizontal scanning period.

First, the following describes changes in waveforms of various signals in the second row. In an initial state, the D latch circuit 42*a* of the CS circuit 42 receives the polarity signal CMI via its terminal D and receives the reset signal RESET via its reset terminal CL. The reset signal RESET causes the electric potential of the CS signal CS2 that the D latch circuit 42*a* outputs via its output terminal Q to be retained at a low level.

After that, the shift register output SRO2 corresponding to the gate signal G2 supplied to the gate line 12 in the second row is outputted from the shift register circuit SR2, and is inputted to one input terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 via its clock terminal CK, the D latch circuit 42*a* transfers an input state of the polarity signal CMI that it received via its data terminal D at the point in time, i.e., transfers a high level. That is, the electric potential of the CS signal CS2 is switched from a low level to a high level at a time when there is a change (from low to high) in electric potential of the shift register output SRO2. The D latch circuit 42*a* outputs the high level until there is a change (from high to low) in electric potential of the shift register output SRO2 in the signal M2 inputted to the clock terminal CK (i.e., during a period of time in which the signal M2 is at a high level). Then, upon receiving a change (from high to low) in electric potential of the shift register output SRO2 in the signal M2 via its clock terminal CK, the D latch circuit 42*a* latches an input state of the polarity signal CMI that it received at the point in time, i.e., latches a high level. After that, the D latch circuit 42*a* retains the high level until the signal M2 is raised to a high level.

Then, the OR circuit 42*b* receives an output signal from the MUX circuit 42*c* via the other terminal of the OR circuit 42*b*. Since the selection signal SEL has been set to a high level here, the MUX circuit 42*c* outputs the shift register output SRO4, which is then inputted to the OR circuit 42*b*. It should be noted that the shift register output SRO4 is also inputted to one terminal of the OR circuit 44*b* of the CS circuit 44.

The D latch circuit 42*a* receives a change (from low to high) in electric potential of the shift register output SRO4 in the signal M2 via its clock terminal CK, and transfers an input state of the polarity signal CMI that it received via its terminal D at the point in time, i.e., transfers a low level. That is, the electric potential of the CS signal CS2 is switched from a high level to a low level at a time when there is a change (from low to high) in electric potential of the shift register output SRO4. The D latch circuit 42*a* outputs the low level until there is a change (from high to low) in electric potential of the shift register output SRO4 in the signal M2 inputted to the clock terminal CK (i.e., during a period of time in which the signal M2 is at a high level). Next, upon receiving a change (from high to low) in electric potential of the shift register output SRO4 in the signal M2 via its clock terminal CK, the D latch circuit 42*a* latches an input state of the polarity signal CMI that it received at the point in time, i.e., latches a low level. After that, the D latch circuit 42*a* retains the low level until the signal M2 is raised to a high level in the second frame.

In the second frame, the shift register circuit SR2 outputs the shift register output SRO2, which is then inputted to one terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 via its clock terminal CK, the D latch circuit 42*a* transfers an input state of the polarity signal CMI that it received via its data terminal D at the point in time, i.e., transfers a high level. That is, the electric potential of the CS signal CS2 is switched from a low level to a high level at a time when there is a change (from low to high) in electric potential of the shift register output SRO2. The D latch circuit 42*a* outputs the high level until there is a change (from high to low) in electric potential of the shift register output SRO2 in the signal M2 inputted to the clock terminal CK (i.e., during a period of time in which the signal M2 is at a high level). Then, upon receiving a change (from high to low) in electric potential of the shift register output SRO2 in the signal M2 via its clock terminal CK, the D latch circuit 42*a* latches an input state of the polarity signal CMI that it received at the point in time, i.e., latches a high level. After that, the D latch circuit 42*a* retains the high level until the signal M2 is raised to a high level.

Then, the OR circuit 42*b* receives an output signal from the MUX circuit 42*c* via the other terminal of the OR circuit 42*b*. Since the selection signal SEL has been set to a low level here, the MUX circuit 42*c* outputs the shift register output SRO3, which is then inputted to the OR circuit 42*b*. It should be noted that the shift register output SRO3 is also inputted to one terminal of the OR circuit 43*b* of the CS circuit 43.

The D latch circuit 42*a* receives a change (from low to high) in electric potential of the shift register output SRO3 in the signal M2 via its clock terminal CK, and transfers an input state of the polarity signal CMI that it received via its terminal D at the point in time, i.e., transfers a low level. That is, the electric potential of the CS signal CS2 is switched from a high level to a low level at a time when there is a change (from low to high) in electric potential of the shift register output SRO3. The D latch circuit 42*a* outputs the low level until there is a change (from high to low) in electric potential of the shift register output SRO3 in the signal M2 inputted to the clock terminal CK (i.e., during a period of time in which the signal M2 is at a high level). Next, upon receiving a change (from high to low) in electric potential of the shift register output SRO3 in the signal M2 via its clock terminal CK, the D latch circuit 42*a* latches an input state of the polarity signal CMI that it received at the point in time, i.e., latches a low level. After that, the D latch circuit 42*a* retains the low level until the signal M2 is raised to a high level in the third frame.

Next, the following describes changes in waveforms of various signals in the third row. In the initial state, the D latch circuit 43*a* of the CS circuit 43 receives the polarity signal CMI via its terminal D and receives the reset signal RESET via its reset terminal CL. The reset signal RESET causes the electric potential of the CS signal CS3 that the D latch circuit 43*a* outputs via its output terminal Q to be retained at a low level.

After that, the shift register output SRO3 corresponding to the gate signal G3 supplied to the gate line 12 in the third row is outputted from the shift register circuit SR3, and is inputted to one terminal of the OR circuit 43*b* of the CS circuit 43. Then, a change (from low to high) in electric potential of the shift register output SRO3 in the signal M3 is inputted to the clock terminal CK. Upon receiving the change in electric potential of the shift register output SRO3 in the signal M3, the D latch circuit 43*a* transfers an input state of the polarity signal CMI that it received via its data terminal D at the point in time, i.e., transfers a low level. Then, the D latch circuit 43*a* outputs the low level until the next time when there is a change (from high to low) in electric potential of the shift register output SRO3 in the signal M3 inputted to the clock terminal CK (i.e., during a period of time in which the signal M3 is at a high level). Then, upon receiving a change (from high to low) in electric potential of the shift register output SRO3 in the signal M3 via its clock terminal CK, the D latch circuit 43*a* latches an input state of the polarity signal CMI that it received at the point in time, i.e., latches a low level. After that, the D latch circuit 43*a* retains the low level until the signal M3 is raised to a high level.

Then, the OR circuit 43*b* receives an output signal from the MUX circuit 43*c* via the other terminal of the OR circuit 43*b*. Since the selection signal SEL has been set to a high level here, the MUX circuit 43*c* outputs the shift register output SRO5, which is then inputted to the OR circuit 43*b*. It should be noted that the shift register output SRO5 is also inputted to one terminal of the OR circuit 45*b* of the CS circuit 45.

The D latch circuit 43*a* receives a change (from low to high) in electric potential of the shift register output SRO5 in the signal M3 via its clock terminal CK, and transfers an input state of the polarity signal CMI that it received via its terminal D at the point in time, i.e., transfers a high level. That is, the electric potential of the CS signal CS3 is switched from a low level to a high level at a time when there is a change (from low to high) in electric potential of the shift register output SRO5. The D latch circuit 43*a* outputs the high level until there is a change (from high to low) in electric potential of the shift register output SRO5 in the signal M3 inputted to the clock terminal CK (i.e., during a period of time in which the signal M3 is at a high level). Next, upon receiving a change (from high to low) in electric potential of the shift register output SRO5 in the signal M3 via its clock terminal CK, the D latch circuit 43*a* latches an input state of the polarity signal CMI that it received at the point in time, i.e., latches a high level. After that, the D latch circuit 43*a* retains the high level until the signal M3 is raised to a high level in the second frame.

In the second frame, the shift register circuit SR3 outputs the shift register output SRO3, which is then inputted to one terminal of the OR circuit 43*b* of the CS circuit 43. Then, a change (from low to high) in electric potential of the shift register output SRO3 in the signal M3 is inputted to the clock terminal CK. Upon receiving the change (from low to high) in electric potential of the shift register output SRO3 via its clock terminal CK, the D latch circuit 43*a* transfers an input state of the polarity signal CMI that it received via its data terminal D at the point in time, i.e., transfers a low level. That is, the electric potential of the CS signal CS3 is switched from a high level to a low level at a time when there is a change (from low to high) in electric potential of the shift register output SRO3. The D latch circuit 43*a* outputs the low level until there is a change (from high to low) in electric potential of the shift register output SRO3 in the signal M3 inputted to the clock terminal CK (i.e., during a period of time in which the signal M3 is at a high level). Then, upon receiving a change (from high to low) in electric potential of the shift register output SRO3 in the signal M3 via its clock terminal CK, the D latch circuit 43*a* latches an input state of the polarity signal CMI that it received at the point in time, i.e., latches a low level. After that, the D latch circuit 43*a* retains the low level until the signal M3 is raised to a high level.

Then, the OR circuit 43*b* receives an output signal from the MUX circuit 43*c* via the other terminal of the OR circuit 43*b*. Since the selection signal SEL has been set to a low level here, the MUX circuit 43*c* outputs the shift register output SRO4, which is then inputted to the OR circuit 43*b*. It should be noted that the shift register output SRO4 is also inputted to one terminal of the OR circuit 44*b* of the CS circuit 44.

The D latch circuit 43*a* receives a change (from low to high) in electric potential of the shift register output SRO4 in the signal M3 via its clock terminal CK, and transfers an input state of the polarity signal CMI that it received via its terminal D at the point in time, i.e., transfers a high level. That is, the electric potential of the CS signal CS3 is switched from a low level to a high level at a time when there is a change (from low to high) in electric potential of the shift register output SRO4. The D latch circuit 43*a* outputs the high level until there is a change (from high to low) in electric potential of the shift register output SRO4 in the signal M3 inputted to the clock terminal CK (i.e., during a period of time in which the signal M3 is at a high level). Next, upon receiving a change (from high to low) in electric potential of the shift register output SRO4 in the signal M3 via its clock terminal CK, the D latch circuit 43*a* latches an input state of the polarity signal CMI that it received at the point in time, i.e., latches a high level. After that, the D latch circuit 43*a* retains the high level until the signal M3 is raised to a high level in the third frame.

Note that, in the fourth row, the polarity signal CMI is latched (i) in accordance with the shift register outputs SRO4 and SRO6 in the first frame and (ii) in accordance with the shift register outputs SRO4 and SRO5 in the second frame, whereby a CS signal CS4 shown in FIG. 5 is outputted.

As described above, in each first frame, each of the CS circuits 41, 42, 43, . . . , and 4*n* corresponding to the respective rows makes it possible, in 2-line inversion driving, to switch the electric potential of a CS signal at a point in time where a gate signal in a corresponding row falls (at a point in time where a TFT 13 is switched from on to off) between high and low levels after the gate signal in this row falls. Further, in each second frame, each of the CS circuits 41, 42, 43, . . . , and 4*n* corresponding to the respective rows makes it possible, in 1-line inversion driving, to switch the electric potential of a CS signal at a point in time where a gate signal in a corresponding row falls (at a point in time where a TFT 13 is switched from on to off) between high and low levels after the gate signal in this row falls.

That is, in the first frame in which 2-line inversion driving is carried out, (i) a CS signal CSn supplied to the CS bus line 15 in the nth row is generated by latching an electric potential level of the polarity signal CMI at a point in time where the gate signal Gn in the nth row rises and an electric potential level of the polarity signal CMI at a point in time where the gate signal G(n+2) in the (n+2)th row rises and (ii) a CS signal CSn+1 supplied to the CS bus line 15 in the (n+1)th row is generated by latching an electric potential level of the polarity signal CMI at a point in time where the gate signal G(n+1) in the (n+1)th row rises and an electric potential level of the polarity signal CMI at a point in time where the gate signal G(n+3) in the (n+3)th row rises.

Further, in the second frame in which 1-line inversion driving is carried out, (i) a CS signal CSn supplied to the CS bus line 15 in the nth row is generated by latching an electric potential level of the polarity signal CMI at a point in time where the gate signal Gn in the nth row rises and an electric potential level of the polarity signal CMI at a point in time where the gate signal G(n+1) in the (n+1)th row rises and (ii) a CS signal CSn+1 supplied to the CS bus line 15 in the (n+1)th row is generated by latching an electric potential level of the polarity signal CMI at a point in time where the gate signal G(n+1) in the (n+1)th row rises and an electric potential level of the polarity signal CMI at a point in time where the gate signal G(n+2) in the (n+2)th row rises.

This allows the CS bus line driving circuit 40 to operate properly both in longitudinal double-size display driving and normal display driving, thus making it possible to prevent the appearance of transverse stripes in the first frame and to eliminate possible appearance of transverse stripes due to a switch from longitudinal double-size display driving to normal display driving. Although Example 1 has been described by taking, as an example, the configuration for switching from resolution conversion driving (longitudinal double-size display driving) to normal display driving, a configuration for switching from normal display driving to resolution conversion driving (longitudinal double-size display driving) can also of course bring about the same effects in the same configuration as Example 1. This point applies to each of the embodiments below.

Example 2

Figure 6:
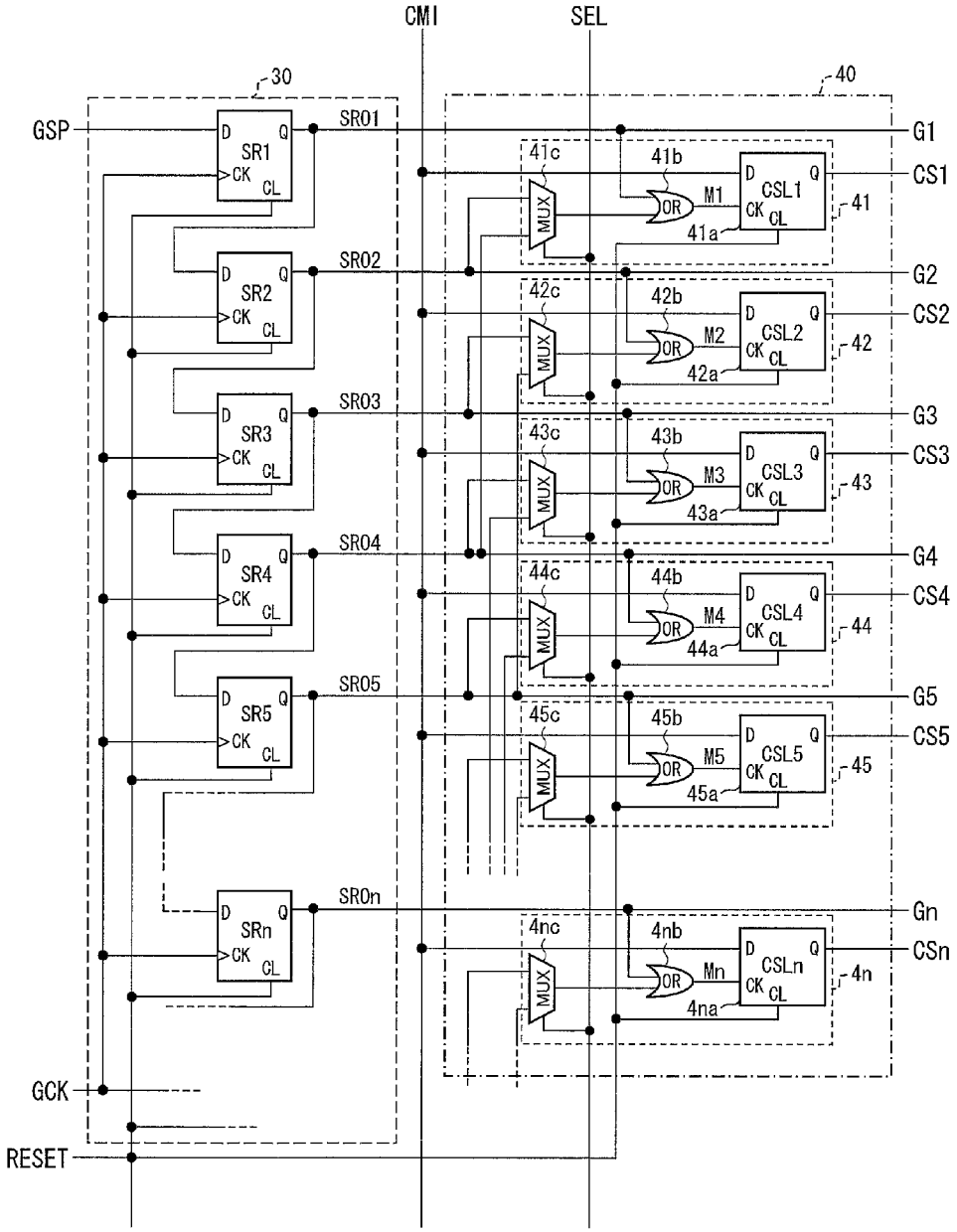
FIG. 6 is a block diagram showing a configuration of a gate line driving circuit and a CS bus line driving circuit in Example 2.
Figure 7:
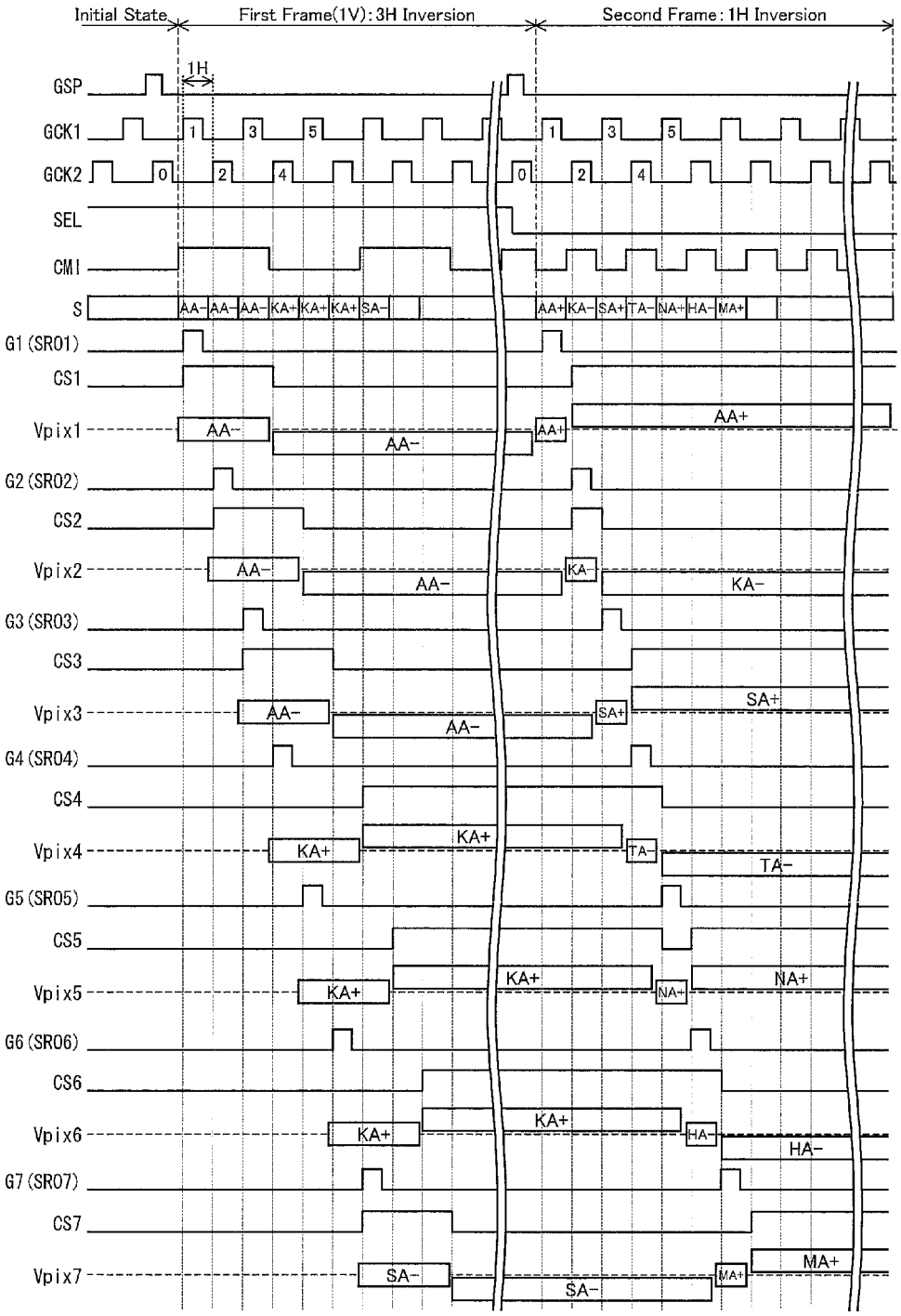
FIG. 7 is a timing chart showing waveforms of various signals of a liquid crystal display device in Example 2.

FIG. 7 is a timing chart showing waveforms of various signals observed in a case of changing from (i) using, in the first frame, a display mode (longitudinal triple-size display driving) in which to carry out a display by converting resolution of a video signal by a factor of 3 (n=3) only in the column-wise direction to (ii) using, in the second frame, a display mode (normal display driving) in which to carry out a display without converting the resolution of the video signal (m=1). FIG. 6 shows a configuration of the gate line driving circuit 30 and the CS bus line driving circuit 40 for achieving this operation.

In the liquid crystal display device 1 of the present Example 2, the MUX circuit 4*nc* receives a different output signal from the shift register circuit SR than it does in Example 1, and the polarity signal CMI reverses its polarity at a different timing than it does in Example 1.

In the present liquid crystal display device 1, as shown in FIG. 6, the MUX circuit 41*c* corresponding to the first row receives the output signal SRO2 from the shift register circuit SR2 in the second row, the output signal SRO4 from the shift register circuit SR4 in the fourth row, and a selection signal SEL, and outputs the shift register output SRO2 or the shift register output SRO4 to the OR circuit 41*b* in accordance with the selection signal SEL. The MUX circuit 42*c* corresponding to the second row receives the output signal SRO3 from the shift register circuit SR3 in the third row, the output signal SRO5 from the shift register circuit SR5 in the fifth row, and the selection signal SEL, and outputs the shift register output SRO3 or the shift register output SRO5 to the OR circuit 42*b* in accordance with the selection signal SEL. Taking the MUX circuit 42*c* in the second row as an example, in a case where the selection signal SEL is at a high level, the MUX circuit 42*c* outputs the shift register output SRO5, and in a case where the selection signal SEL is at a low level, the MUX circuit 42*c* outputs the shift register output SRO3.

That is, as shown in FIG. 6, the OR circuit 4*nb* receives (i) an output signal SROn from the shift register circuit SRn in the nth row and (ii) either an output signal SROn+1 from the shift register circuit SRn+1 in the (n+1)th row or an output signal SROn+3 from the shift register circuit SRn+3 in the (n+3)th row.

The selection signal SEL is a switching signal for switching between 3-line inversion driving and 1-line inversion driving. In this example, 3-line inversion driving is carried out when the selection signal SEL is at a high level, and 1-line inversion driving is carried out when the selection signal SEL is at a low level. The polarity signal CMI varies in timing of polarity reversal according to the selection signal SEL. In this example, the polarity signal CMI reverses its polarity every three horizontal scanning periods when the selection signal SEL is at a high level, and reverses its polarity every single horizontal scanning period when the selection signal SEL is at a low level.

As shown in FIG. 7, during an initial state, the CS signals CS1 to CS7 are all fixed at one electric potential (in FIG. 7, at a low level). In the first frame, the CS signal CS1 in the first row is at a high level at a point in time where the corresponding gate signal G1 (which corresponds to the output SRO1 from the corresponding shift register circuit SR1) falls. The CS signal CS2 in the second row is at a high level at a point in time where the corresponding gate signal G2 falls. The CS signal CS3 in the third row is at a low level at a point in time where the corresponding gate signal G3 falls. Meanwhile, the CS signal CS4 in the fourth row is at a low level at a point in time where the corresponding gate signal G4 falls, and the CS signal CS5 in the fifth row is at a low level at a point in time where the corresponding gate signal G5 falls. The CS signal CS6 in the sixth row is at a low level at a point in time where the corresponding gate signal G6 falls. The CS signal CS7 in the seventh row is at a high level at a point in time where the corresponding gate signal G7 falls.

Then, the CS signals CS1 to CS7 switch between high and low electric potential levels after their corresponding gate signals G1 to G7 fall. Specifically, in the first frame, the CS signals CS1, CS2, and CS3 fall after their corresponding gate signals G1, G2, and G3 fall, respectively, and the CS signals CS4, CS5, and CS6 rise after their corresponding signals G4, G5, and G6 fall, respectively.

The source signal S in the first frame is a signal which has amplitude corresponding to a gray scale represented by a video signal and which reverses its polarity every three horizontal scanning periods (3H). Further, the source signal S in the first frame has the same electric potential during three adjacent horizontal scanning periods (3H) and has the same electric potential during next three adjacent horizontal scanning periods (3H). That is, each of the reference signs "AA" to "SA" shown in FIG. 7 corresponds to a single horizontal scanning period, and indicates a signal potential (gray scale) during that horizontal scanning period. The source signal S exhibits identical signal potentials of a negative polarity ("AA") during the first, second, and third horizontal scanning periods, and exhibits identical signal potentials of a positive polarity ("KA") during the fourth, fifth, and sixth horizontal scanning periods. The gate signals G1 to G7 serve as gate-on potentials during the first to seventh 1H periods, respectively, in an active period (effective scanning period) of each frame, and serve as gate-off potentials during the other periods.

In the second frame, on the other hand, the source signal S is a signal which has amplitude corresponding to a gray scale represented by a video signal and which reverses its polarity every single horizontal scanning period (1H). Further, the source signal S in the second frame corresponds to the gray scale of the first frame, and the source signal S in the second frame is assigned the reference signs "AA" to "SA" respectively corresponding to the reference signs "AA" to "SA" of the first frame. That is, the gray scale ("AA") of the first, second, and third rows in the first frame and the gray scale ("AA") of the first row in the second frame are equal to each other. The gray scale ("KA") of the fourth, fifth and sixth rows in the first frame and the gray scale ("KA") of the second row in the second frame are equal to each other. The gate signals G1 to G7 serve as gate-on potentials during the first to seventh 1H periods, respectively, in an active period (effective scanning period) of each frame, and serve as gate-off potentials during the other periods.

In the second frame, the CS signal CS1 in the first row is at a low level at a point in time where the corresponding gate signal G1 (which corresponds to the output SRO1 from the corresponding shift register circuit SR1) falls. The CS signal CS2 in the second row is at a high level at a point in time where the corresponding gate signal G2 falls. The CS signal CS3 in the third row is at a low level at a point in time where the corresponding gate signal G3 falls. The CS signal CS4 in the fourth row is at a high level at a point in time where the corresponding gate signal G4 falls. The CS signal CS5 in the fifth row is at a low level at a point in time where the corresponding gate signal G5 falls.

Then, the CS signals CS1 and CS3 rise after their corresponding gate signals G1 and G3 fall, respectively, and the CS signals CS2 and CS4 fall after their corresponding signals G2 and G4 fall, respectively.

Thus, in the first frame in which longitudinal triple-size display diving is carried out, the electric potential of each CS signal at a point in time where the gate signal falls varies every three rows in correspondence with the polarity of the source signal S; therefore, the electric potentials Vpix1 to Vpix7 of the pixel electrodes 14 are all properly shifted by the CS signals CS1 to CS7, respectively. Therefore, inputting of source signals S of the same gray scale causes the positive and negative potential differences between the electric potential of the counter electrode and the shifted potential of each of the pixel electrodes 14 to be equal to each other. That is, in the first frame, in which source signals having a negative polarity and the same electric potential (gray scale) are written to pixels corresponding to three adjacent rows in the same column of pixels and source signals having a positive polarity and the same electric potential (gray scale) are written to pixels corresponding to three adjacent pixels next to the three rows in the same column of pixels, the electric potentials of the CS signals corresponding to the first three rows are not polarity-reversed during the writing to the pixels corresponding to the first three rows, are polarity-reversed in a negative direction after the writing, and are not polarity-reversed until the next writing, and the electric potentials of the CS signals corresponding to the next three rows are not polarity-reversed during the writing to the pixels corresponding to the next three rows, are polarity-reversed in a positive direction after the writing, and are not polarity-reversed until the next writing. This achieves longitudinal triple-size display driving (3-line inversion driving) in CC driving. Further, the foregoing configuration allows the electric potentials Vpix1 to Vpix7 of the pixel electrodes 14 to be properly shifted by the CS signals CS1 to CS7, thus making it possible to eliminate possible appearance of transverse stripes in the first frame of a display picture.

Further, in the second frame in which normal driving (1-line inversion driving) is carried out, the electric potential of each CS signal at a point in time where the gate signal falls varies every adjacent rows in correspondence with the polarity of the source signal S; therefore, the electric potentials Vpix1 to Vpix7 of the pixel electrodes 14 are all properly shifted by the CS signals CS1 to CS7, respectively. Therefore, inputting of source signals S of the same gray scale causes the positive and negative potential differences between the electric potential of the counter electrode and the shifted potential of each of the pixel electrodes 14 to be equal to each other. That is, in the second frame, in which source signals having a positive polarity are written to the odd-numbered pixels of the same column of pixels and source signals having a negative polarity are written to the even-numbered pixels, the electric potentials of the CS signals corresponding to the odd-numbered pixels are not polarity-reversed during the writing to the odd-numbered pixels corresponding to the first two rows, are polarity-reversed in a positive direction after the writing, and are not polarity-reversed until the next writing, and the electric potentials of the CS signals corresponding to the even-numbered pixels are not polarity-reversed during the writing to the even-numbered pixels, are polarity-reversed in a negative direction after the writing, and are not polarity-reversed until the next writing. This achieves 1-line inversion driving in CC driving.

Moreover, the foregoing configuration allows the electric potentials Vpix1 to Vpix7 of the pixel electrodes 14 to be properly shifted by the CS signals CS1 to CS7, respectively, even in a case of a switch from longitudinal triple-size display driving (3-line inversion driving) to normal display driving (1-line inversion driving). This allows pixel electrodes 14 that are supplied with the same signal potential during the first and second frames to be equal in electric potential to each other, thus making it possible to eliminate the appearance of transverse stripes shown in FIG. 29.

Figure 8:
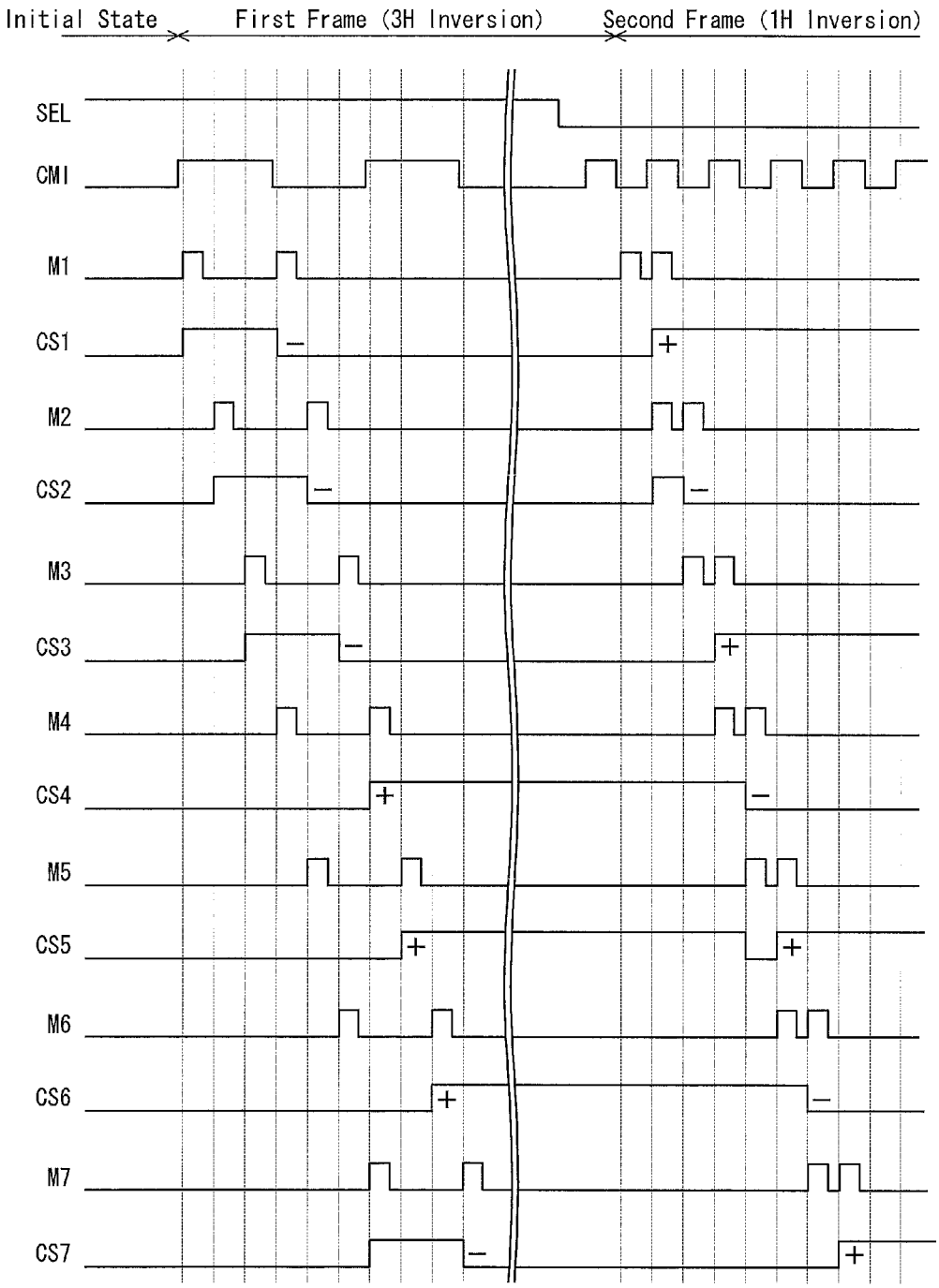
FIG. 8 is a timing chart showing waveforms of various signals that are inputted to and outputted from the CS bus line driving circuit in Example 2.

The operation of the liquid crystal display device 1 of Example 2 is described here with reference to FIGS. 7 and 8. FIG. 8 shows waveforms of various signals that are inputted to and outputted from the CS bus line driving circuit 40 of the liquid crystal display device 1 of Example 2. In the following, for convenience of description, mainly the CS circuits 42 and 43 corresponding to the second and third rows, respectively, are taken as an example.

First, the following describes changes in waveforms of various signals in the second row. In an initial state, the D latch circuit 42*a* of the CS circuit 42 receives the polarity signal CMI via its terminal D and receives the reset signal RESET via its reset terminal CL. The reset signal RESET causes the electric potential of the CS signal CS2 that the D latch circuit 42*a* outputs via its output terminal Q to be retained at a low level.

After that, the shift register output SRO2 corresponding to the gate signal G2 supplied to the gate line 12 in the second row is outputted from the shift register circuit SR2, and is inputted to one input terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 via its clock terminal CK, the D latch circuit 42*a* transfers an input state of the polarity signal CMI that it received via its data terminal D at the point in time, i.e., transfers a high level. That is, the electric potential of the CS signal CS2 is switched from a low level to a high level at a time when there is a change (from low to high) in electric potential of the shift register output SRO2. The D latch circuit 42*a* outputs the high level until there is a change (from high to low) in electric potential of the shift register output SRO2 in the signal M2 inputted to the clock terminal CK (i.e., during a period of time in which the signal M2 is at a high level). Then, upon receiving a change (from high to low) in electric potential of the shift register output SRO2 in the signal M2 via its clock terminal CK, the D latch circuit 42*a* latches an input state of the polarity signal CMI that it received at the point in time, i.e., latches a high level. After that, the D latch circuit 42*a* retains the high level until the signal M2 is raised to a high level.

Then, the OR circuit 42*b* receives an output signal from the MUX circuit 42*c* via the other terminal of the OR circuit 42*b*. Since the selection signal SEL has been set to a high level here, the MUX circuit 42*c* outputs the shift register output SRO5, which is then inputted to the OR circuit 42*b*. It should be noted that the shift register output SRO5 is also inputted to one terminal of the OR circuit 45*b* of the CS circuit 45.

The D latch circuit 42*a* receives a change (from low to high) in electric potential of the shift register output SRO5 in the signal M2 via its clock terminal CK, and transfers an input state of the polarity signal CMI that it received via its terminal D at the point in time, i.e., transfers a low level. That is, the electric potential of the CS signal CS2 is switched from a high level to a low level at a time when there is a change (from low to high) in electric potential of the shift register output SRO5. The D latch circuit 42*a* outputs the low level until there is a change (from high to low) in electric potential of the shift register output SRO5 in the signal M2 inputted to the clock terminal CK (i.e., during a period of time in which the signal M2 is at a high level). Next, upon receiving a change (from high to low) in electric potential of the shift register output SRO5 in the signal M2 via its clock terminal CK, the D latch circuit 42*a* latches an input state of the polarity signal CMI that it received at the point in time, i.e., latches a low level. After that, the D latch circuit 42*a* retains the low level until the signal M2 is raised to a high level in the second frame.

In the second frame, the shift register circuit SR2 outputs the shift register output SRO2, which is then inputted to one terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 via its clock terminal CK, the D latch circuit 42*a* transfers an input state of the polarity signal CMI that it received via its data terminal D at the point in time, i.e., transfers a high level. That is, the electric potential of the CS signal CS2 is switched from a low level to a high level at a time when there is a change (from low to high) in electric potential of the shift register output SRO2. The D latch circuit 42*a* outputs the high level until there is a change (from high to low) in electric potential of the shift register output SRO2 in the signal M2 inputted to the clock terminal CK (i.e., during a period of time in which the signal M2 is at a high level). Then, upon receiving a change (from high to low) in electric potential of the shift register output SRO2 in the signal M2 via its clock terminal CK, the D latch circuit 42*a* latches an input state of the polarity signal CMI that it received at the point in time, i.e., latches a high level. After that, the D latch circuit 42*a* retains the high level until the signal M2 is raised to a high level.

Then, the OR circuit 42*b* receives an output signal from the MUX circuit 42*c* via the other terminal of the OR circuit 42*b*. Since the selection signal SEL has been set to a low level here, the MUX circuit 42*c* outputs the shift register output SRO3, which is then inputted to the OR circuit 42*b*. It should be noted that the shift register output SRO3 is also inputted to one terminal of the OR circuit 43*b* of the CS circuit 43.

The D latch circuit 42*a* receives a change (from low to high) in electric potential of the shift register output SRO3 in the signal M2 via its clock terminal CK, and transfers an input state of the polarity signal CMI that it received via its terminal D at the point in time, i.e., transfers a low level. That is, the electric potential of the CS signal CS2 is switched from a high level to a low level at a time when there is a change (from low to high) in electric potential of the shift register output SRO3. The D latch circuit 42*a* outputs the low level until there is a change (from high to low) in electric potential of the shift register output SRO3 in the signal M2 inputted to the clock terminal CK (i.e., during a period of time in which the signal M2 is at a high level). Next, upon receiving a change (from high to low) in electric potential of the shift register output SRO3 in the signal M2 via its clock terminal CK, the D latch circuit 42*a* latches an input state of the polarity signal CMI that it received at the point in time, i.e., latches a low level. After that, the D latch circuit 42*a* retains the low level until the signal M2 is raised to a high level in the third frame.

Next, the following describes changes in waveforms of various signals in the third row. In the initial state, the D latch circuit 43*a* of the CS circuit 43 receives the polarity signal CMI via its terminal D and receives the reset signal RESET via its reset terminal CL. The reset signal RESET causes the electric potential of the CS signal CS3 that the D latch circuit 43*a* outputs via its output terminal Q to be retained at a low level.

After that, the shift register output SRO3 corresponding to the gate signal G3 supplied to the gate line 12 in the third row is outputted from the shift register circuit SR3, and is inputted to one terminal of the OR circuit 43*b* of the CS circuit 43. Then, a change (from low to high) in electric potential of the shift register output SRO3 in the signal M3 is inputted to the clock terminal CK. Upon receiving the change in electric potential of the shift register output SRO3 in the signal M3, the D latch circuit 43*a* transfers an input state of the polarity signal CMI that it received via its terminal D at the point in time, i.e., transfers a high level. Then, the D latch circuit 43*a* outputs the high level until the next time when there is a change (from high to low) in electric potential of the shift register output SRO3 in the signal M3 inputted to the clock terminal CK (i.e., during a period of time in which the signal M3 is at a high level). Then, upon receiving a change (from high to low) in electric potential of the shift register output SRO3 in the signal M3 via its clock terminal CK, the D latch circuit 43*a* latches an input state of the polarity signal CMI that it received at the point in time, i.e., latches a high level. After that, the D latch circuit 43*a* retains the high level until the signal M3 is raised to a high level.

Then, the OR circuit 43*b* receives an output signal from the MUX circuit 43*c* via the other terminal of the OR circuit 43*b*. Since the selection signal SEL has been set to a high level here, the MUX circuit 43*c* outputs the shift register output SRO6, which is then inputted to the OR circuit 43*b*. It should be noted that the shift register output SRO6 is also inputted to one terminal of the OR circuit 46*b* of the CS circuit 46.

The D latch circuit 43*a* receives a change (from low to high) in electric potential of the shift register output SRO6 in the signal M3 via its clock terminal CK, and transfers an input state of the polarity signal CMI that it received via its terminal D at the point in time, i.e., transfers a low level. That is, the electric potential of the CS signal CS3 is switched from a high level to a low level at a time when there is a change (from low to high) in electric potential of the shift register output SRO6. The D latch circuit 43*a* outputs the low level until there is a change (from high to low) in electric potential of the shift register output SRO6 in the signal M3 inputted to the clock terminal CK (i.e., during a period of time in which the signal M3 is at a high level). Next, upon receiving a change (from high to low) in electric potential of the shift register output SRO6 in the signal M3 via its clock terminal CK, the D latch circuit 43*a* latches an input state of the polarity signal CMI that it received at the point in time, i.e., latches a low level. After that, the D latch circuit 43*a* retains the low level until the signal M3 is raised to a high level in the second frame.

In the second frame, the shift register circuit SR3 outputs the shift register output SRO3, which is then inputted to one terminal of the OR circuit 43*b* of the CS circuit 43. Then, a change (from low to high) in electric potential of the shift register output SRO3 in the signal M3 is inputted to the clock terminal CK. Upon receiving the change (from low to high) in electric potential of the shift register output SRO3 via its clock terminal CK, the D latch circuit 43*a* transfers an input state of the polarity signal CMI that it received via its data terminal D at the point in time, i.e., transfers a low level. After the D latch circuit 43*a* transfers the input state (low level) of the polarity signal CMI that it received via its data terminal D during a period of time in which the shift register output SRO3 in the signal M3 is at a high level, the D latch circuit 43*a* latches an input state (low level) of the polarity signal CMI at a point in time where it receives a change (from high to low) in electric potential of the shift register output SRO3. Then, the D latch circuit 43*a* retains the low level until the next time when the signal M3 is raised to a high level.

Then, the OR circuit 43*b* receives an output signal from the MUX circuit 43*c* via the other terminal of the OR circuit 43*b*. Since the selection signal SEL has been set to a low level here, the MUX circuit 43*c* outputs the shift register output SRO4, which is then inputted to the OR circuit 43*b*. It should be noted that the shift register output SRO4 is also inputted to one terminal of the OR circuit 44*b* of the CS circuit 44.

The D latch circuit 43*a* receives a change (from low to high) in electric potential of the shift register output SRO4 via its clock terminal CK, and transfers an input state of the polarity signal CMI that it received via its terminal D at the point in time, i.e., transfers a high level. That is, the electric potential of the CS signal CS3 is switched from a low level to a high level at a time when there is a change (from low to high) in electric potential of the shift register output SRO4. Then, the latch circuit 43*a* outputs the high level until there is a change (from high to low) in electric potential of the shift register output SRO4 inputted to the clock terminal CK (i.e., during a period of time in which the signal M3 is at a high level). Next, upon receiving a change (from high to low) in electric potential of the shift register output SRO3 via its clock terminal CK, the D latch circuit 43*a* latches an input state of the polarity signal CMI that it received at the point in time, i.e., latches a high level. After that, the D latch circuit 43*a* retains the high level until the signal M3 is raised to a high level in the third frame.

Note that, in the fourth row, the polarity signal CMI is latched (i) in accordance with the shift register outputs SRO4 and SRO7 in the first frame and (ii) in accordance with the shift register outputs SRO4 and SRO5 in the second frame, whereby a CS signal CS4 shown in FIG. 8 is outputted.

As described above, in each first frame, each of the CS circuits 41, 42, 43, . . . , and 4*n* corresponding to the respective rows makes it possible, in 3-line inversion driving, to switch the electric potential of a CS signal at a point in time where a gate signal in a corresponding row falls (at a point in time where a TFT 13 is switched from on to off) between high and low levels after the gate signal in this row falls. Further, in each second frame, each of the CS circuits 41, 42, 43, . . . , and 4*n* corresponding to the respective rows makes it possible, in 1-line inversion driving, to switch the electric potential of a CS signal at a point in time where a gate signal in a corresponding row falls (at a point in time where a TFT 13 is switched from on to off) between high and low levels after the gate signal in this row falls.

That is, in the first frame in which 3-line inversion driving is carried out, (i) a CS signal CSn supplied to the CS bus line 15 in the nth row is generated by latching an electric potential level of the polarity signal CMI at a point in time where the gate signal Gn in the nth row rises and an electric potential level of the polarity signal CMI at a point in time where the gate signal G(n+3) in the (n+3)th row rises and (ii) a CS signal CSn+1 supplied to the CS bus line 15 in the (n+1)th row is generated by latching an electric potential level of the polarity signal CMI at a point in time where the gate signal G(n+1) in the (n+1)th row rises and an electric potential level of the polarity signal CMI at a point in time where the gate signal G(n+4) in the (n+4)th row rises.

Further, in the second frame in which 1-line inversion driving is carried out, (i) a CS signal CSn supplied to the CS bus line 15 in the nth row is generated by latching an electric potential level of the polarity signal CMI at a point in time where the gate signal Gn in the nth row rises and an electric potential level of the polarity signal CMI at a point in time where the gate signal G(n+1) in the (n+1)th row rises and (ii) a CS signal CSn+1 supplied to the CS bus line 15 in the (n+1)th row is generated by latching an electric potential level of the polarity signal CMI at a point in time where the gate signal G(n+1) in the (n+1)th row rises and an electric potential level of the polarity signal CMI at a point in time where the gate signal G(n+2) in the (n+2)th row rises.

This allows the CS bus line driving circuit 40 to operate properly both in longitudinal triple-size display driving and normal display driving, thus making it possible to prevent the appearance of transverse stripes in the first frame and to eliminate possible appearance of transverse stripes due to a switch from longitudinal triple-size display driving to normal display driving.

Example 3

Figure 9:
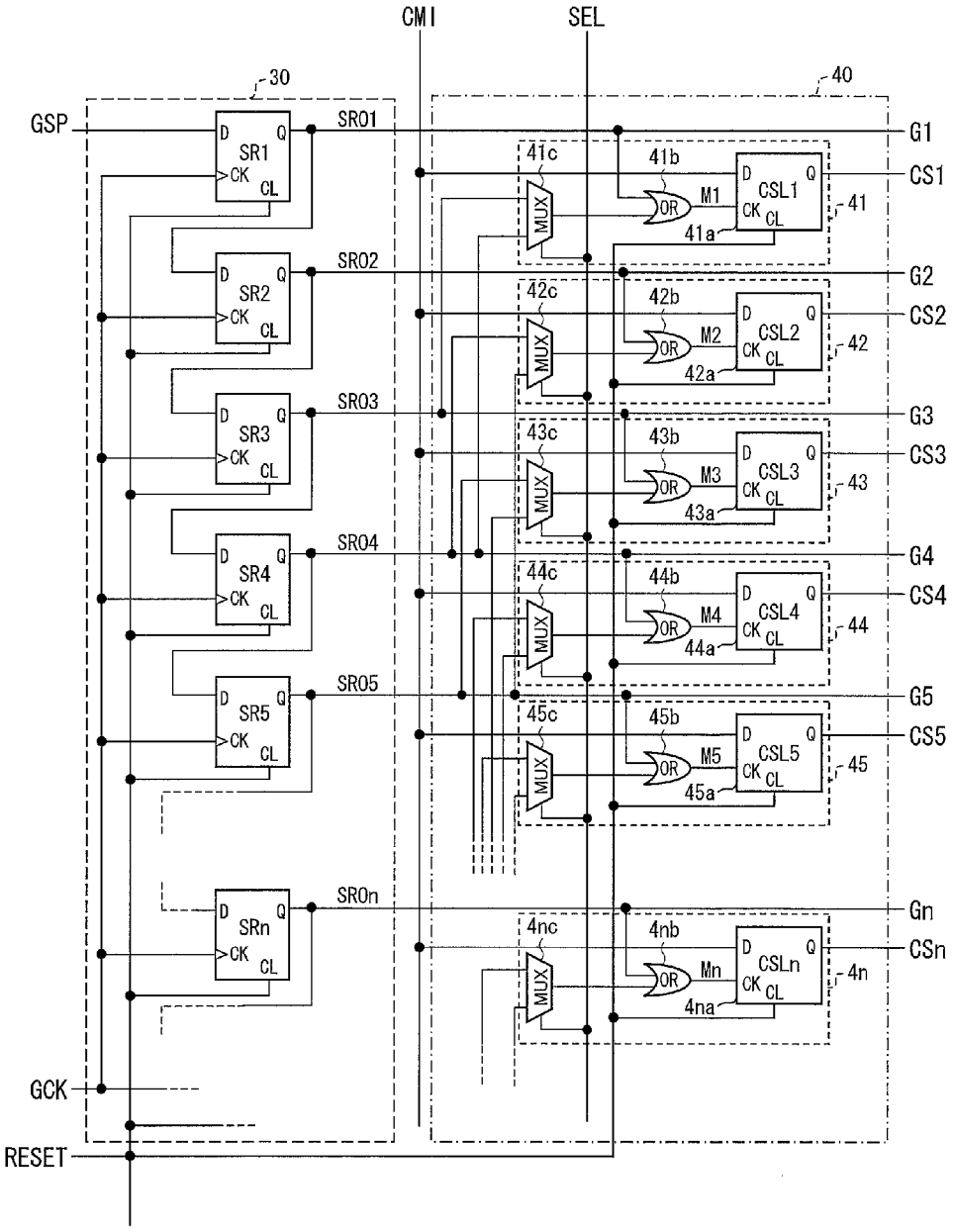
FIG. 9 is a block diagram showing a configuration of a gate line driving circuit and a CS bus line driving circuit in Example 3.
Figure 10:
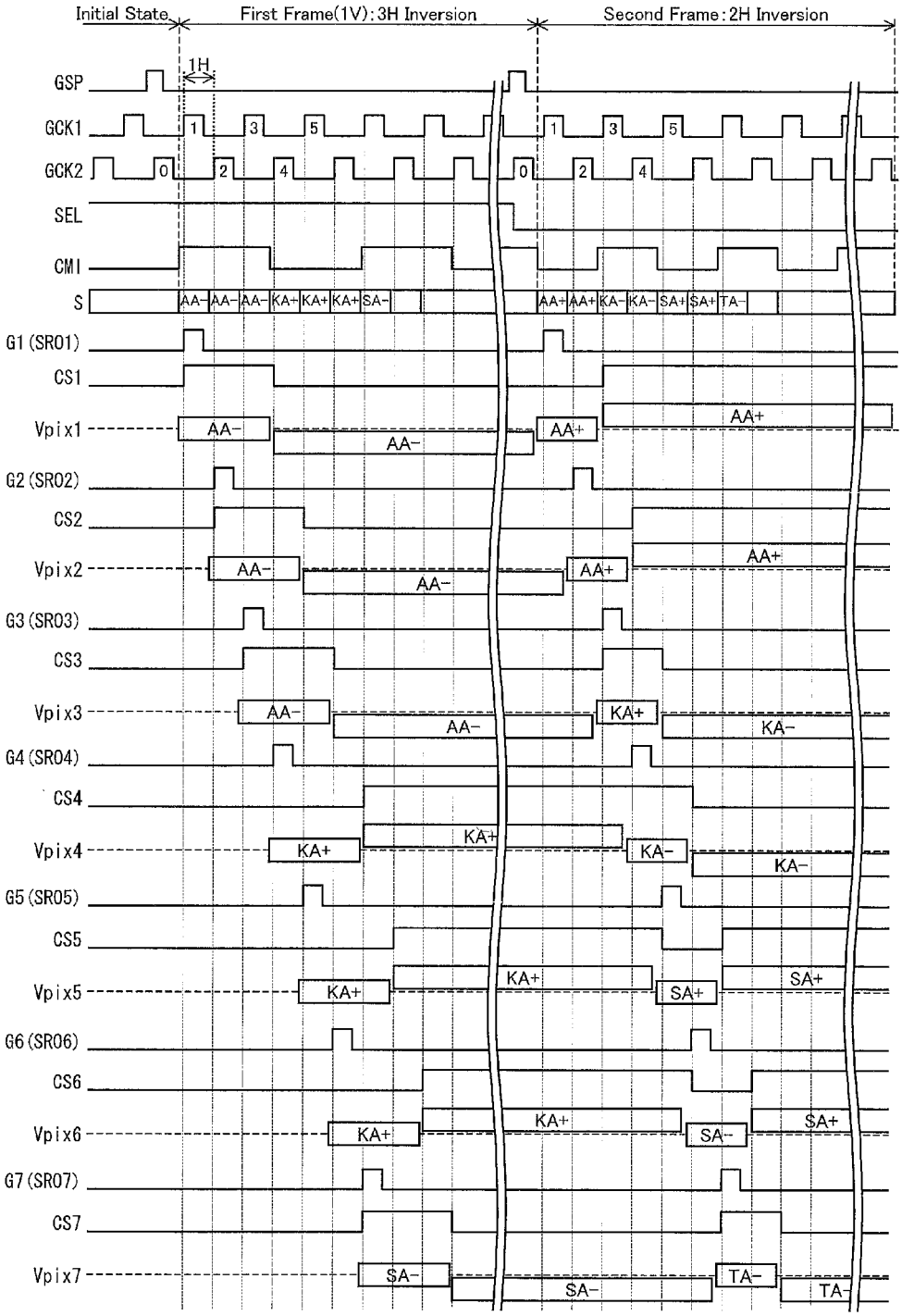
FIG. 10 is a timing chart showing waveforms of various signals of a liquid crystal display device in Example 3.

FIG. 10 is a timing chart showing waveforms of various signals observed in a case of changing from (i) using, in the first frame, a display mode (longitudinal triple-size display driving) in which to carry out a display by converting resolution of a video signal by a factor of 3 (n=3) only in the column-wise direction to (ii) using, in the second frame, a display mode (longitudinal double-size display driving) in which to carry out a display by converting resolution of a video signal by a factor of 2 (m=2) in the column-wise direction. FIG. 9 shows a configuration of the gate line driving circuit 30 and the CS bus line driving circuit 40 for achieving this operation.

In the liquid crystal display device 1 of the present Example 3, the MUX circuit 4*nc* receives a different output signal from the shift register circuit SR than it does in Example 1, and CMI reverses its polarity at a different timing than it does in Example 1.

In the present liquid crystal display device 1, as shown in FIG. 9, the MUX circuit 41*c* corresponding to the first row receives the output signal SRO3 from the shift register circuit SR3 in the third row, the output signal SRO4 from the shift register circuit SR4 in the fourth row, and a selection signal SEL, and outputs the shift register output SRO3 or the shift register output SRO4 to the OR circuit 41*b* in accordance with the selection signal SEL. The MUX circuit 42*c* corresponding to the second row receives the output signal SRO4 from the shift register circuit SR4 in the fourth row, the output signal SRO5 from the shift register circuit SR5 in the fifth row, and the selection signal SEL, and outputs the shift register output SRO4 or the shift register output SRO5 to the OR circuit 42*b* in accordance with the selection signal SEL. Taking the MUX circuit 42*c* in the second row as an example, in a case where the selection signal SEL is at a high level, the MUX circuit 42*c* outputs the shift register output SRO5, and in a case where the selection signal SEL is at a low level, the MUX circuit 42*c* outputs the shift register output SRO4.

That is, as shown in FIG. 9, the OR circuit 4*nb* receives (i) an output signal SROn from the shift register circuit SRn in the nth row and (ii) either an output signal SROn+2 from the shift register circuit SRn+2 in the (n+2)th row or an output signal SROn+3 from the shift register circuit SRn+3 in the (n+3)th row.

The selection signal SEL is a switching signal for switching between 3-line inversion driving and 2-line inversion driving. In this example, 3-line inversion driving is carried out when the selection signal SEL is at a high level, and 2-line inversion driving is carried out when the selection signal SEL is at a low level. The polarity signal CMI varies in timing of polarity reversal according to the selection signal SEL. In this example, the polarity signal CMI reverses its polarity every three horizontal scanning periods when the selection signal SEL is at a high level, and reverses its polarity every two horizontal scanning periods when the selection signal SEL is at a low level.

As shown in FIG. 10, during an initial state, the CS signals CS1 to CS7 are all fixed at one electric potential (in FIG. 10, at a low level). In the first frame, the CS signal CS1 in the first row is at a high level at a point in time where the corresponding gate signal G1 (which corresponds to the output SRO1 from the corresponding shift register circuit SR1) falls. The CS signal CS2 in the second row is at a high level at a point in time where the corresponding gate signal G2 falls. The CS signal CS3 in the third row is at a low level at a point in time where the corresponding gate signal G3 falls. Meanwhile, the CS signal CS4 in the fourth row is at a low level at a point in time where the corresponding gate signal G4 falls, and the CS signal CS5 in the fifth row is at a low level at a point in time where the corresponding gate signal G5 falls. The CS signal CS6 in the sixth row is at a low level at a point in time where the corresponding gate signal G6 falls. The CS signal CS7 in the seventh row is at a high level at a point in time where the corresponding gate signal G7 falls.

Then, the CS signals CS1 to CS7 switch between high and low electric potential levels after their corresponding gate signals G1 to G7 fall. Specifically, in the first frame, the CS signals CS1, CS2, and CS3 fall after their corresponding gate signals G1, G2, and G3 fall, respectively, and the CS signals CS4, CS5, and CS6 rise after their corresponding signals G4, G5, and G6 fall, respectively.

The source signal S in the first frame is a signal which has amplitude corresponding to a gray scale represented by a video signal and which reverses its polarity every three horizontal scanning periods (3H). Further, the source signal S in the first frame has the same electric potential during three adjacent horizontal scanning periods (3H) and has the same electric potential during next three adjacent horizontal scanning periods (3H). That is, each of the reference signs "AA" to "SA" shown in FIG. 10 corresponds to a single horizontal scanning period, and indicates a signal potential (gray scale) during that horizontal scanning period. The source signal S exhibits identical signal potentials of a negative polarity ("AA") during the first, second, and third horizontal scanning periods, and exhibits identical signal potentials of a positive polarity ("KA") during the fourth, fifth, and sixth horizontal scanning periods. The gate signals G1 to G7 serve as gate-on potentials during the first to seventh 1H periods, respectively, in an active period (effective scanning period) of each frame, and serve as gate-off potentials during the other periods.

In the second frame, on the other hand, the source signal S is a signal which has amplitude corresponding to a gray scale represented by a video signal and which reverses its polarity every two horizontal scanning periods (2H). Further, the source signal S in the second frame corresponds to the gray scale of the first frame, and the source signal S in the second frame is assigned the reference signs "AA" to "SA" respectively corresponding to the reference signs "AA" to "SA" of the first frame. That is, the gray scale ("AA") of the first, second, and third rows in the first frame and the gray scale ("AA") of the first and second rows in the second frame are equal to each other. The gray scale ("KA") of the fourth, fifth, and sixth rows in the first frame and the gray scale ("KA") of the third and fourth rows in the second frame are equal to each other. The gate signals G1 to G7 serve as gate-on potentials during the first to seventh 1H periods, respectively, in an active period (effective scanning period) of each frame, and serve as gate-off potentials during the other periods.

In the second frame, the CS signal CS1 in the first row is at a low level at a point in time where the corresponding gate signal G1 (which corresponds to the output SRO1 from the corresponding shift register circuit SR1) falls. The CS signal CS2 in the second row is at a low level at a point in time where the corresponding gate signal G2 falls. The CS signal CS3 in the third row is at a high level at a point in time where the corresponding gate signal G3 falls. The CS signal CS4 in the fourth row is at a high level at a point in time where the corresponding gate signal G4 falls. The CS signal CS5 in the fifth row is at a low level at a point in time where the corresponding gate signal G5 falls.

Then, the CS signals CS1 and CS2 rise after their corresponding gate signals G1 and G2 fall, respectively, and the CS signals CS3 and CS4 fall after their corresponding signals G3 and G4 fall, respectively.

Thus, in the first frame in which longitudinal triple-size display diving is carried out, the electric potential of each CS signal at a point in time where the gate signal falls varies every three rows in correspondence with the polarity of the source signal S; therefore, the electric potentials Vpix1 to Vpix7 of the pixel electrodes 14 are all properly shifted by the CS signals CS1 to CS7, respectively. Therefore, inputting of source signals S of the same gray scale causes the positive and negative potential differences between the electric potential of the counter electrode and the shifted potential of each of the pixel electrodes 14 to be equal to each other. That is, in the first frame, in which source signals having a negative polarity and the same electric potential (gray scale) are written to pixels corresponding to three adjacent rows in the same column of pixels and source signals having a positive polarity and the same electric potential (gray scale) are written to pixels corresponding to three adjacent pixels next to the three rows in the same column of pixels, the electric potentials of the CS signals corresponding to the first three rows are not polarity-reversed during the writing to the pixels corresponding to the first three rows, are polarity-reversed in a negative direction after the writing, and are not polarity-reversed until the next writing, and the electric potentials of the CS signals corresponding to the next three rows are not polarity-reversed during the writing to the pixels corresponding to the next three rows, are polarity-reversed in a positive direction after the writing, and are not polarity-reversed until the next writing. This achieves longitudinal triple-size display driving (3-line inversion driving) in CC driving. Further, the foregoing configuration allows the electric potentials Vpix1 to Vpix7 of the pixel electrodes 14 to be properly shifted by the CS signals CS1 to CS7, thus making it possible to eliminate possible appearance of transverse stripes in the first frame of a display picture.

Further, in the second frame in which longitudinal double-size display diving is carried out, the electric potential of each CS signal at a point in time where the gate signal falls varies every two rows in correspondence with the polarity of the source signal S; therefore, the electric potentials Vpix1 to Vpix7 of the pixel electrodes 14 are all properly shifted by the CS signals CS1 to CS7, respectively. Therefore, inputting of source signals S of the same gray scale causes the positive and negative potential differences between the electric potential of the counter electrode and the shifted potential of each of the pixel electrodes 14 to be equal to each other. That is, in the second frame, in which source signals having a positive polarity and the same electric potential (gray scale) are written to pixels corresponding to two adjacent rows in the same column of pixels and source signals having a negative polarity and the same electric potential (gray scale) are written to pixels corresponding to two adjacent pixels next to the two rows in the same column of pixels, the electric potentials of the CS signals corresponding to the first two rows are not polarity-reversed during the writing to the pixels corresponding to the first two rows, are polarity-reversed in a positive direction after the writing, and are not polarity-reversed until the next writing, and the electric potentials of the CS signals corresponding to the next two rows are not polarity-reversed during the writing to the pixels corresponding to the next two rows, are polarity-reversed in a negative direction after the writing, and are not polarity-reversed until the next writing. This achieves longitudinal 2-line inversion driving in CC driving.

Moreover, the foregoing configuration allows the electric potentials Vpix1 to Vpix7 of the pixel electrodes 14 to be properly shifted by the CS signals CS1 to CS7, respectively, even in a case of a switch from longitudinal triple-size display driving (3-line inversion driving) to longitudinal double-size display driving (2-line inversion driving). This allows pixel electrodes 14 that are supplied with the same signal potential during the first and second frames to be equal in electric potential to each other, thus making it possible to eliminate the appearance of transverse stripes shown in FIG. 29.

Figure 11:
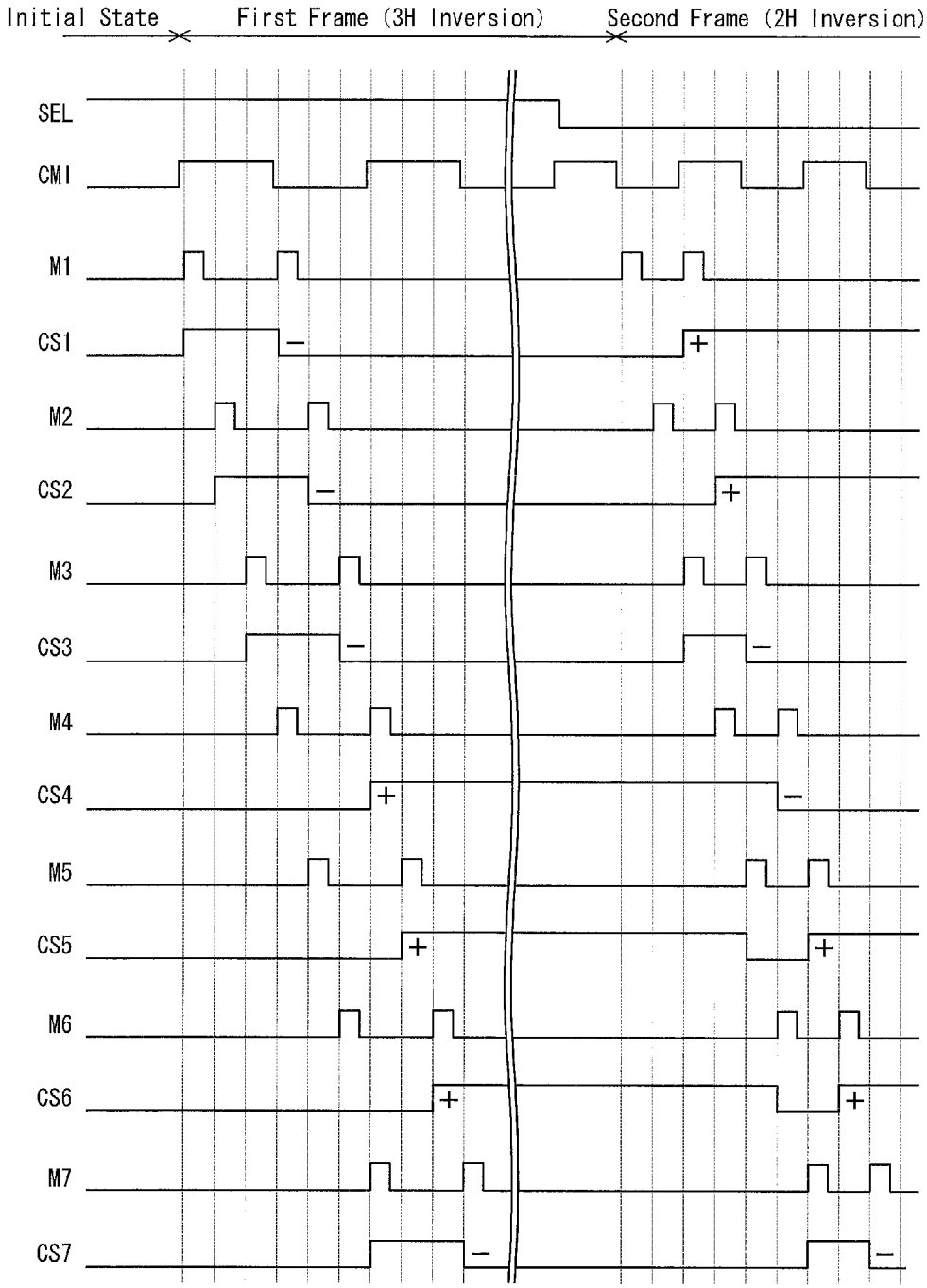
FIG. 11 is a timing chart showing waveforms of various signals that are inputted to and outputted from the CS bus line driving circuit in Example 3.

The operation of the liquid crystal display device 1 of Example 3 is described here with reference to FIGS. 10 and 11. FIG. 11 shows waveforms of various signals that are inputted to and outputted from the CS bus line driving circuit 40 of the liquid crystal display device 1 of Example 3. In the following, for convenience of description, mainly the CS circuits 42 and 43 corresponding to the second and third rows, respectively, are taken as an example.

First, the following describes changes in waveforms of various signals in the second row. In an initial state, the D latch circuit 42*a* of the CS circuit 42 receives the polarity signal CMI via its terminal D and receives the reset signal RESET via its reset terminal CL. The reset signal RESET causes the electric potential of the CS signal CS2 that the D latch circuit 42*a* outputs via its output terminal Q to be retained at a low level.

After that, the shift register output SRO2 corresponding to the gate signal G2 supplied to the gate line 12 in the second row is outputted from the shift register circuit SR2, and is inputted to one input terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 via its clock terminal CK, the D latch circuit 42*a* transfers an input state of the polarity signal CMI that it received via its data terminal D at the point in time, i.e., transfers a high level. That is, the electric potential of the CS signal CS2 is switched from a low level to a high level at a time when there is a change (from low to high) in electric potential of the shift register output SRO2. The D latch circuit 42*a* outputs the high level until there is a change (from high to low) in electric potential of the shift register output SRO2 in the signal M2 inputted to the clock terminal CK (i.e., during a period of time in which the signal M2 is at a high level). Then, upon receiving a change (from high to low) in electric potential of the shift register output SRO2 in the signal M2 via its clock terminal CK, the D latch circuit 42*a* latches an input state of the polarity signal CMI that it received at the point in time, i.e., latches a high level. After that, the D latch circuit 42*a* retains the high level until the signal M2 is raised to a high level.

Then, the OR circuit 42*b* receives an output signal from the MUX circuit 42*c* via the other terminal of the OR circuit 42*b*. Since the selection signal SEL has been set to a high level here, the MUX circuit 42*c* outputs the shift register output SRO5, which is then inputted to the OR circuit 42*b*. It should be noted that the shift register output SRO5 is also inputted to one terminal of the OR circuit 45*b* of the CS circuit 45.

The D latch circuit 42*a* receives a change (from low to high) in electric potential of the shift register output SRO5 in the signal M2 via its clock terminal CK, and transfers an input state of the polarity signal CMI that it received via its terminal D at the point in time, i.e., transfers a low level. That is, the electric potential of the CS signal CS2 is switched from a high level to a low level at a time when there is a change (from low to high) in electric potential of the shift register output SRO5. The D latch circuit 42*a* outputs the low level until there is a change (from high to low) in electric potential of the shift register output SRO5 in the signal M2 inputted to the clock terminal CK (i.e., during a period of time in which the signal M2 is at a high level). Next, upon receiving a change (from high to low) in electric potential of the shift register output SRO5 in the signal M2 via its clock terminal CK, the D latch circuit 42*a* latches an input state of the polarity signal CMI that it received at the point in time, i.e., latches a low level. After that, the D latch circuit 42*a* retains the low level until the signal M2 is raised to a high level in the second frame.

In the second frame, the shift register circuit SR2 outputs the shift register output SRO2, which is then inputted to one terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 via its clock terminal CK, the D latch circuit 42*a* transfers an input state of the polarity signal CMI that it received via its data terminal D at the point in time, i.e., transfers a low level. After the D latch circuit 42*a* transfers the input state (low level) of the polarity signal CMI that it received via its data terminal D during a period of time in which the shift register output SRO2 in the signal M2 is at a high level, the D latch circuit 42*a* latches an input state (low level) of the polarity signal CMI at a point in time where it receives a change (from high to low) in electric potential of the shift register output SRO2. Then, the D latch circuit 42*a* retains the low level until the next time when the signal M2 is raised to a high level.

Then, the OR circuit 42*b* receives an output signal from the MUX circuit 42*c* via the other terminal of the OR circuit 42*b*. Since the selection signal SEL has been set to a low level here, the MUX circuit 42*c* outputs the shift register output SRO4, which is then inputted to the OR circuit 42*b*. It should be noted that the shift register output SRO4 is also inputted to one terminal of the OR circuit 44*b* of the CS circuit 44.

The D latch circuit 42*a* receives a change (from low to high) in electric potential of the shift register output SRO4 in the signal M2 via its clock terminal CK, and transfers an input state of the polarity signal CMI that it received via its terminal D at the point in time, i.e., transfers a high level. That is, the electric potential of the CS signal CS2 is switched from a low level to a high level at a time when there is a change (from low to high) in electric potential of the shift register output SRO4. Then, the D latch circuit 42*a* outputs the high level until there is a change (from high to low) in electric potential of the shift register output SRO4 inputted to the clock terminal CK (i.e., during a period of time in which the signal M2 is at a high level). Next, upon receiving a change (from high to low) in electric potential of the shift register output SRO4 via its clock terminal CK, the D latch circuit 42*a* latches an input state of the polarity signal CMI that it received at the point in time, i.e., latches a high level. After that, the D latch circuit 42*a* retains the high level until the signal M2 is raised to a high level in the third frame.

Next, the following describes changes in waveforms of various signals in the third row. In the initial state, the D latch circuit 43*a* of the CS circuit 43 receives the polarity signal CMI via its data terminal D and receives the reset signal RESET via its reset terminal CL. The reset signal RESET causes the electric potential of the CS signal CS3 that the D latch circuit 43*a* outputs via its output terminal Q to be retained at a low level.

After that, the shift register output SRO3 corresponding to the gate signal G3 supplied to the gate line 12 in the third row is outputted from the shift register circuit SR3, and is inputted to one terminal of the OR circuit 43*b* of the CS circuit 43. Then, a change (from low to high) in electric potential of the shift register output SRO3 in the signal M3 is inputted to the clock terminal CK. Upon receiving the change in electric potential of the shift register output SRO3 in the signal M3, the D latch circuit 43*a* transfers an input state of the polarity signal CMI that it received via its terminal D at the point in time, i.e., transfers a high level. Then, the D latch circuit 43*a* outputs the high level until the next time when there is a change (from high to low) in electric potential of the shift register output SRO3 in the signal M3 inputted to the clock terminal CK (i.e., during a period of time in which the signal M3 is at a high level). Then, upon receiving a change (from high to low) in electric potential of the shift register output SRO3 in the signal M3 via its clock terminal CK, the D latch circuit 43*a* latches an input state of the polarity signal CMI that it received at the point in time, i.e., latches a high level. After that, the D latch circuit 43*a* retains the high level until the signal M3 is raised to a high level.

Then, the OR circuit 43*b* receives an output signal from the MUX circuit 43*c* via the other terminal of the OR circuit 43*b*. Since the selection signal SEL has been set to a high level here, the MUX circuit 43*c* outputs the shift register output SRO6, which is then inputted to the OR circuit 43*b*. It should be noted that the shift register output SRO6 is also inputted to one terminal of the OR circuit 46*b* of the CS circuit 46.

The D latch circuit 43*a* receives a change (from low to high) in electric potential of the shift register output SRO6 in the signal M3 via its clock terminal CK, and transfers an input state of the polarity signal CMI that it received via its terminal D at the point in time, i.e., transfers a low level. That is, the electric potential of the CS signal CS3 is switched from a high level to a low level at a time when there is a change (from low to high) in electric potential of the shift register output SRO6. The D latch circuit 43*a* outputs the low level until there is a change (from high to low) in electric potential of the shift register output SRO6 in the signal M3 inputted to the clock terminal CK (i.e., during a period of time in which the signal M3 is at a high level). Next, upon receiving a change (from high to low) in electric potential of the shift register output SRO6 in the signal M3 via its clock terminal CK, the D latch circuit 43*a* latches an input state of the polarity signal CMI that it received at the point in time, i.e., latches a low level. After that, the D latch circuit 43*a* retains the low level until the signal M3 is raised to a high level in the second frame.

In the second frame, the shift register circuit SR3 outputs the shift register output SRO3, which is then inputted to one terminal of the OR circuit 43*b* of the CS circuit 43. Then, a change (from low to high) in electric potential of the shift register output SRO3 in the signal M3 is inputted to the clock terminal CK. Upon receiving the change (from low to high) in electric potential of the shift register output SRO3 via its clock terminal CK, the D latch circuit 43*a* transfers an input state of the polarity signal CMI that it received via its data terminal D at the point in time, i.e., transfers a high level. That is, the electric potential of the CS signal CS3 is switched from a low level to a high level at a time when there is a change (from low to high) in electric potential of the shift register output SRO3. The D latch circuit 43*a* outputs the high level until there is a change (from high to low) in electric potential of the shift register output SRO3 in the signal M3 inputted to the clock terminal CK (i.e., during a period of time in which the signal M3 is at a high level). Then, upon receiving a change (from high to low) in electric potential of the shift register output SRO3 in the signal M3 via its clock terminal CK, the D latch circuit 43*a* latches an input state of the polarity signal CMI that it received at the point in time, i.e., latches a high level. After that, the D latch circuit 43*a* retains the high level until the signal M3 is raised to a high level.

Then, the OR circuit 43*b* receives an output signal from the MUX circuit 43*c* via the other terminal of the OR circuit 43*b*. Since the selection signal SEL has been set to a low level here, the MUX circuit 43*c* outputs the shift register output SRO5, which is then inputted to the OR circuit 43*b*. It should be noted that the shift register output SRO5 is also inputted to one terminal of the OR circuit 45*b* of the CS circuit 45.

The D latch circuit 43*a* receives a change (from low to high) in electric potential of the shift register output SRO5 in the signal M3 via its clock terminal CK, and transfers an input state of the polarity signal CMI that it received via its terminal D at the point in time, i.e., transfers a low level. That is, the electric potential of the CS signal CS3 is switched from a high level to a low level at a time when there is a change (from low to high) in electric potential of the shift register output SRO5. The latch circuit 43*a* outputs the low level until there is a change (from high to low) in electric potential of the shift register output SRO5 in the signal M3 inputted to the clock terminal CK (i.e., during a period of time in which the signal M3 is at a high level). Next, upon receiving a change (from high to low) in electric potential of the shift register output SRO5 in the signal M3 via its clock terminal CK, the D latch circuit 43*a* latches an input state of the polarity signal CMI that it received at the point in time, i.e., latches a low level. After that, the D latch circuit 43*a* retains the high level until the signal M3 is raised to a high level in the third frame.

Note that, in the fourth row, the polarity signal CMI is latched (i) in accordance with the shift register outputs SRO4 and SRO7 in the first frame and (ii) in accordance with the shift register outputs SRO4 and SRO6 in the second frame, whereby a CS signal CS4 shown in FIG. 11 is outputted.

As described above, in each first frame, each of the CS circuits 41, 42, 43, . . . , and 4*n* corresponding to the respective rows makes it possible, in 3-line inversion driving, to switch the electric potential of a CS signal at a point in time where a gate signal in a corresponding row falls (at a point in time where a TFT 13 is switched from on to off) between high and low levels after the gate signal in this row falls. Further, in each second frame, each of the CS circuits 41, 42, 43, . . . , and 4*n* corresponding to the respective rows makes it possible, in 2-line inversion driving, to switch the electric potential of a CS signal at a point in time where a gate signal in a corresponding row falls (at a point in time where a TFT 13 is switched from on to off) between high and low levels after the gate signal in this row falls.

That is, in the first frame in which 3-line inversion driving is carried out, (i) a CS signal CSn supplied to the CS bus line 15 in the nth row is generated by latching an electric potential level of the polarity signal CMI at a point in time where the gate signal Gn in the nth row rises and an electric potential level of the polarity signal CMI at a point in time where the gate signal G(n+3) in the (n+3)th row rises and (ii) a CS signal CSn+1 supplied to the CS bus line 15 in the (n+1)th row is generated by latching an electric potential level of the polarity signal CMI at a point in time where the gate signal G(n+1) in the (n+1)th row rises and an electric potential level of the polarity signal CMI at a point in time where the gate signal G(n+4) in the (n+4)th row rises.

Further, in the second frame in which 2-line inversion driving is carried out, (i) a CS signal CSn supplied to the CS bus line 15 in the nth row is generated by latching an electric potential level of the polarity signal CMI at a point in time where the gate signal Gn in the nth row rises and an electric potential level of the polarity signal CMI at a point in time where the gate signal G(n+2) in the (n+2)th row rises and (ii) a CS signal CSn+1 supplied to the CS bus line 15 in the (n+1)th row is generated by latching an electric potential level of the polarity signal CMI at a point in time where the gate signal G(n+1) in the (n+1)th row rises and an electric potential level of the polarity signal CMI at a point in time where the gate signal G(n+3) in the (n+3)th row rises.

This allows the CS bus line driving circuit 40 to operate properly both in longitudinal triple-size display driving and longitudinal double-size display driving, thus making it possible to prevent the appearance of transverse stripes in the first frame and to eliminate possible appearance of transverse stripes due to a switch from longitudinal triple-size display driving to longitudinal double-size display driving.

Embodiment 2

The configuration for alternately switching between (i) a first mode in which to carry out a display by converting resolution of a video signal by a factor of n (n is an integer) and (ii) a second mode in which to carry out a display by converting the resolution of the video signal by a factor of m (m is an integer different from n) is not to be limited to Example 1, (configuration for switching between 1-line inversion driving and 2-line inversion driving), Example 2 (configuration for switching between 1-line inversion driving and 3-line inversion driving), or Example 3 (configuration for switching between 2-line inversion driving and 3-line inversion driving) according to Embodiment 1. In the present Embodiment 2, other configurations (Examples 4 to 6) for switching between the first mode (n-line (nH) inversion driving) and the second mode (m-line (mH) inversion driving) are described.

It should be noted that a liquid crystal display device 2 according to the present embodiment is identical in schematic configuration to the liquid crystal display device 1 according to Embodiment 1 shown in FIGS. 1 and 2. In the following, for convenience of explanation, those members having the same functions as those shown in Embodiment 1 are given the same reference signs, and as such, are not described. Further, those terms defined in Embodiment 1 are based on the definitions unless otherwise noted.

Example 4

Figure 13:
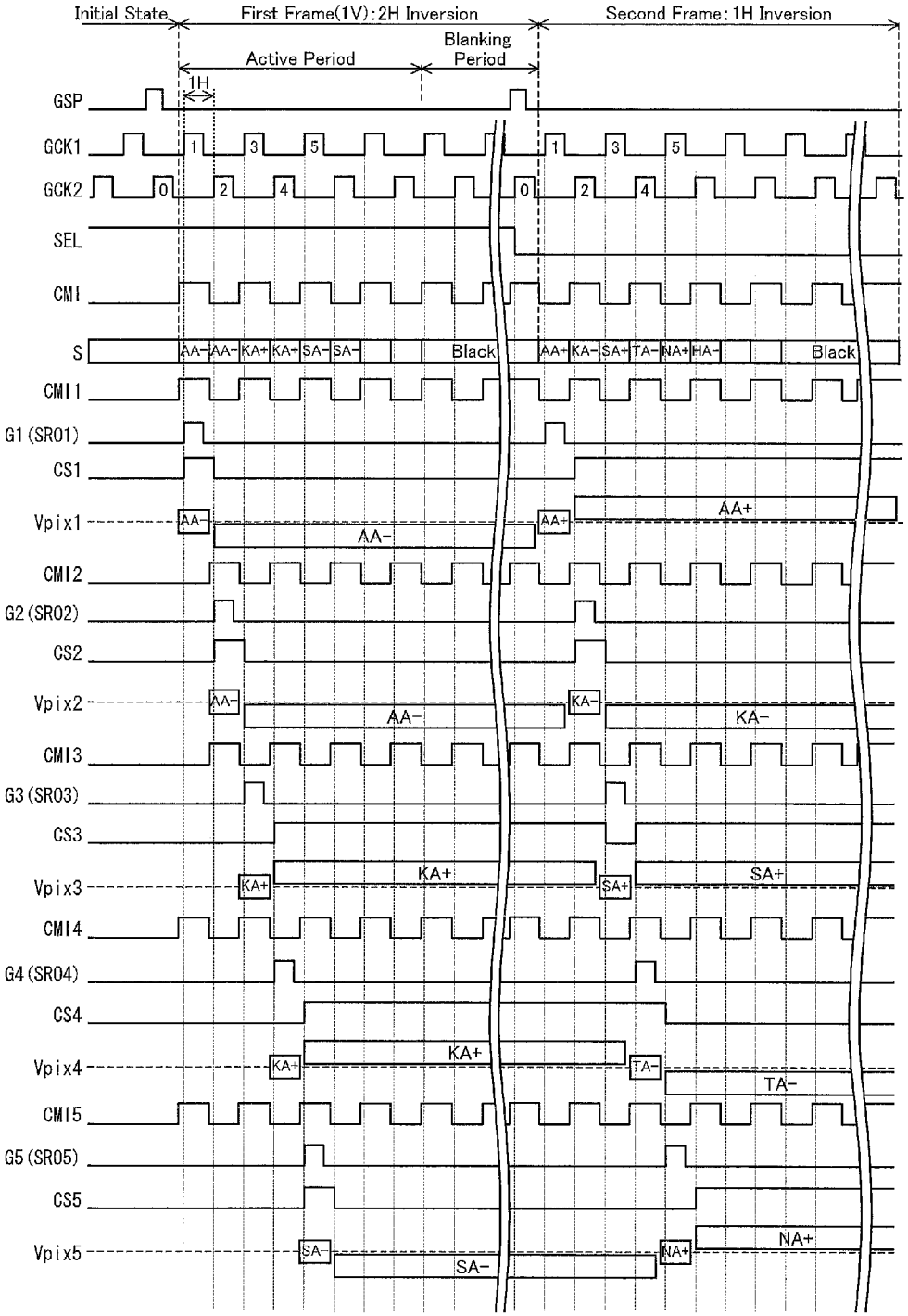
FIG. 13 is a timing chart showing waveforms of various signals of a liquid crystal display device in Example 4.

FIG. 13 is a timing chart showing waveforms of various signals observed in a case of changing from (i) using, in the first frame, a display mode (longitudinal double-size display driving) in which to carry out a display by converting resolution of a video signal by a factor of 2 (n=2) only in the column-wise direction to (ii) using, in the second frame, a display mode (normal display driving) in which to carry out a display without converting the resolution of the video signal (m=1). In FIG. 13, the polarity signal CMI reverses its polarity every single horizontal scanning period.

As shown in FIG. 13, during an initial state, the CS signals CS1 to CS5 are all fixed at one electric potential (in FIG. 13, at a low level). In the first frame, the CS signal CS1 in the first row is at a high level at a point in time where the corresponding gate signal G1 (which corresponds to the output SRO1 from the corresponding shift register circuit SR1) falls. The CS signal CS2 in the second row is at a high level at a point in time where the corresponding gate signal G2 falls. The CS signal CS3 in the third row is at a low level at a point in time where the corresponding gate signal G3 falls. The CS signal CS4 in the fourth row is at a low level at a point in time where the corresponding gate signal G4 falls. The CS signal CS5 in the fifth row is at a high level at a point in time where the corresponding gate signal G5 falls.

Then, the CS signals CS1 to CS5 switch between high and low electric potential levels after their corresponding gate signals G1 to G5 fall. Specifically, in the first frame, the CS signals CS1 and CS2 fall after their corresponding gate signals G1 and G2 fall, respectively, and the CS signals CS3 and CS4 rise after their corresponding signals G3 and G4 fall, respectively.

The source signal S in the first frame is a signal which has amplitude corresponding to a gray scale represented by a video signal and which reverses its polarity every two horizontal scanning periods (2H). Further, the source signal S in the first frame has the same electric potential (gray scale) during two adjacent horizontal scanning periods (2H) and has the same electric potential (gray scale) during next two adjacent horizontal scanning periods (2H). That is, each of the reference signs "AA" to "SA" shown in FIG. 13 corresponds to a single horizontal scanning period, and indicates a signal potential (gray scale) during that horizontal scanning period. The source signal S exhibits identical signal potentials of a negative polarity ("AA") during the first and second horizontal scanning periods, and exhibits identical signal potentials of a positive polarity ("KA") during the third and fourth horizontal scanning periods. The gate signals G1 to G5 serve as gate-on potentials during the first to fifth 1H periods, respectively, in an active period (effective scanning period) of each frame, and serve as gate-off potentials during the other periods.

In the second frame, on the other hand, the source signal S is a signal which has amplitude corresponding to a gray scale represented by a video signal and which reverses its polarity every single horizontal scanning period (1H). Further, the source signal S in the second frame corresponds to the gray scale of the first frame, and the source signal S in the second frame is assigned the reference signs "AA" to "SA" respectively corresponding to the reference signs "AA" to "SA" of the first frame. That is, the gray scale ("AA") of the first and second rows in the first frame and the gray scale ("AA") of the first row in the second frame are equal to each other. The gray scale ("KA") of the third and fourth rows in the first frame and the gray scale ("KA") of the second row in the second frame are equal to each other. The gray scale ("SA") of the fifth and sixth rows in the first frame and the gray scale ("SA") of the third row in the second frame are equal to each other. The gate signals G1 to G5 serve as gate-on potentials during the first to fifth 1H periods, respectively, in an active period (effective scanning period) of each frame, and serve as gate-off potentials during the other periods.

In the second frame, the CS signal CS1 in the first row is at a low level at a point in time where the corresponding gate signal G1 (which corresponds to the output SRO1 from the corresponding shift register circuit SR1) falls. The CS signal CS2 in the second row is at a high level at a point in time where the corresponding gate signal G2 falls. The CS signal CS3 in the third row is at a low level at a point in time where the corresponding gate signal G3 falls. The CS signal CS4 in the fourth row is at a high level at a point in time where the corresponding gate signal G4 falls. The CS signal CS5 in the fifth row is at a low level at a point in time where the corresponding gate signal G5 falls.

Then, the CS signals CS1 and CS3 rise after their corresponding gate signals G1 and G3 fall, respectively, and the CS signals CS2 and CS4 fall after their corresponding signals G3 and G4 fall, respectively.

Thus, in the first frame in which longitudinal double-size display diving is carried out, the electric potential of each CS signal at a point in time where the gate signal falls varies every two rows in correspondence with the polarity of the source signal S; therefore, the electric potentials Vpix1 to Vpix5 of the pixel electrodes 14 are all properly shifted by the CS signals CS1 to CS5, respectively. Therefore, inputting of source signals S of the same gray scale causes the positive and negative potential differences between the electric potential of the counter electrode and the shifted potential of each of the pixel electrodes 14 to be equal to each other. That is, in the first frame, in which source signals having a negative polarity and the same electric potential (gray scale) are written to pixels corresponding to two adjacent rows in the same column of pixels and source signals having a positive polarity and the same electric potential (gray scale) are written to pixels corresponding to two adjacent pixels next to the two rows in the same column of pixels, the electric potentials of the CS signals corresponding to the first two rows are not polarity-reversed during the writing to the pixels corresponding to the first two rows, are polarity-reversed in a negative direction after the writing, and are not polarity-reversed until the next writing, and the electric potentials of the CS signals corresponding to the next two rows are not polarity-reversed during the writing to the pixels corresponding to the next two rows, are polarity-reversed in a positive direction after the writing, and are not polarity-reversed until the next writing. This achieves longitudinal double-size display driving (2-line inversion driving) in CC driving. Further, the foregoing configuration allows the electric potentials Vpix1 to Vpix7 of the pixel electrodes 14 to be properly shifted by the CS signals CS1 to CS7, thus making it possible to eliminate the appearance of transverse stripes in the first frame of a display picture.

Further, in the second frame in which normal driving (1-line inversion driving) is carried out, the electric potential of each CS signal at a point in time where the gate signal falls varies every adjacent rows in correspondence with the polarity of the source signal S; therefore, the electric potentials Vpix1 to Vpix5 of the pixel electrodes 14 are all properly shifted by the CS signals CS1 to CS5, respectively. Therefore, inputting of source signals S of the same gray scale causes the positive and negative potential differences between the electric potential of the counter electrode and the shifted potential of each of the pixel electrodes 14 to be equal to each other. That is, in the second frame, in which source signals having a positive polarity are written to the odd-numbered pixels of the same column of pixels and source signals having a negative polarity are written to the even-numbered pixels, the electric potentials of the CS signals corresponding to the odd-numbered pixels are not polarity-reversed during the writing to the odd-numbered pixels corresponding to the first two rows, are polarity-reversed in a positive direction after the writing, and are not polarity-reversed until the next writing, and the electric potentials of the CS signals corresponding to the even-numbered pixels are not polarity-reversed during the writing to the even-numbered pixels, are polarity-reversed in a negative direction after the writing, and are not polarity-reversed until the next writing. This achieves 1-line inversion driving in CC driving.

Moreover, the foregoing configuration allows the electric potentials Vpix1 to Vpix5 of the pixel electrodes 14 to be properly shifted by the CS signals CS1 to CS5, respectively, even in a case of a switch from longitudinal double-size display driving (2-line inversion driving) to normal display driving (1-line inversion driving). This allows pixel electrodes 14 that are supplied with the same signal potential during the first and second frames to be equal in electric potential to each other, thus making it possible to eliminate the appearance of transverse stripes shown in FIG. 29.

A specific configuration of the gate line driving circuit 30 and the CS bus line driving circuit 40 for achieving the aforementioned control is described here.

Figure 12:
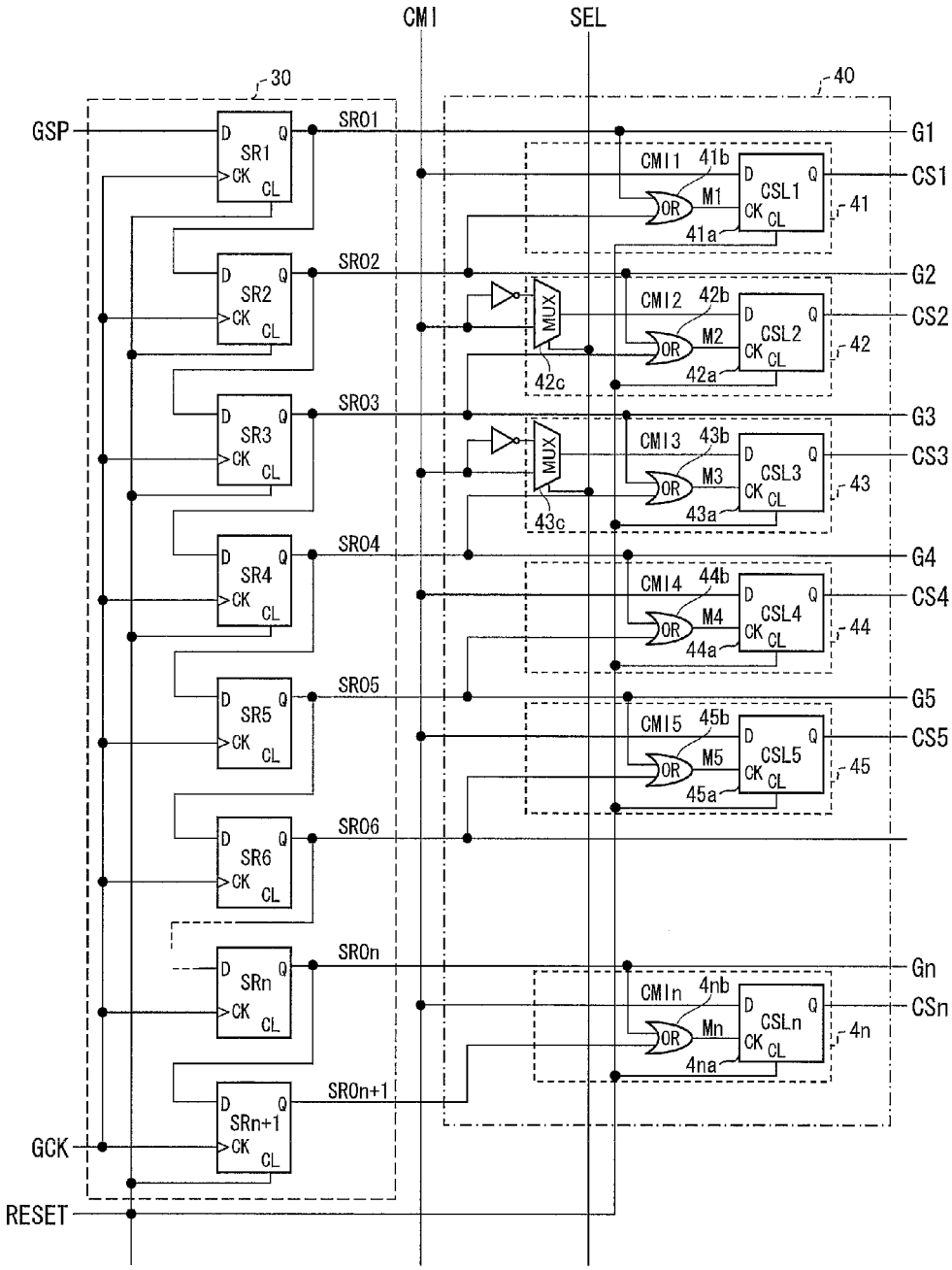
FIG. 12 is a block diagram showing a configuration of a gate line driving circuit and a CS bus line driving circuit in Example 4.

FIG. 12 shows a configuration of the gate line driving circuit 30 and the CS bus line driving circuit 40. The CS bus line driving circuit 40 includes a plurality of CS circuits 41, 42, 43, . . . , and 4*n* corresponding to respective rows. The CS circuits 41, 42, 43, . . . , and 4*n* include respective D latch circuits 41*a*, 42*a*, 43*a*, . . . , and 4*na*; respective OR circuits 41*b*, 42*b*, 43*b*, . . . , and 4*nb*; and respective MUX circuits (multiplexers) 42*c*, 43*c*, . . . , 4*nc*. The gate line driving circuit 30 includes a plurality of shift register circuits SR1, SR2, SR3, . . . , and SRn. Note that MUX circuits are provided in such a way as to correspond to predetermined rows. In FIG. 12, the MUX circuits are provided in two consecutive rows every two rows such that they are provided in the second row, third row, sixth row, seventh row, tenth row, eleventh row, and so on.

Input signals to the CS circuit 41 are shift register outputs SRO1 and SRO2 corresponding to the gate signals G1 and G2, a polarity signal CMI, and a reset signal RESET. Input signals to the CS circuit 42 are shift register outputs SRO2 and SRO3 corresponding to the gate signals G2 and G3, an output from the MUX circuit 42*c*, the polarity signal CMI, and the reset signal RESET. Input signals to the CS circuit 43 are shift register outputs SRO3 and SRO4 corresponding to the gate signals G3 and G4, an output from the MUX circuit 43*c*, the polarity signal CMI, and the reset signal RESET. Input signals to the CS circuit 44 are shift register outputs SRO4 and SRO6 corresponding to the gate signals G4 and G5, an output from the MUX circuit 44*c*, the polarity signal CMI, and the reset signal RESET. As described above, each CS circuit receives a shift register output SROn in the corresponding nth row and a shift register output SROn+1 in the (n+1)th row. The polarity signal CMI and the reset signal RESET are supplied from the control circuit 50.

In the following, for convenience of description, mainly the CS circuits 41 and 42 corresponding to the first and second rows, respectively, are taken as an example.

The D latch circuit 41*a* receives the reset signal RESET via its reset terminal CL, receives the polarity signal CMI via its data terminal D, and receives an output from the OR circuit 41*a* via its clock terminal CK. In accordance with a change (from a low level to a high level or from a high level to a low level) in electric potential level of the signal that it receives via its clock terminal CK, the D latch circuit 41*a* outputs, as a CS signal CS1 indicative of the change in electric potential level, an input state (low level or high level) of the polarity signal CMI that it receives via its data terminal D.

Specifically, when the electric potential level of the signal that the D latch circuit 41*a* receives via its clock terminal CK is at a high level, the D latch circuit 41*a* outputs an input state (low level or high level) of the polarity signal CMI that it receives via its input terminal D. When the electric potential level of the signal that the D latch circuit 41*a* receives via its clock terminal CK has changed from a high level to a low level, the latch circuit 41*a* latches an input state (low level or high level) of the polarity signal CMI that it receives via its terminal D at the time of change, and keeps the latched state until the next time when the electric potential level of the signal that the latch circuit 41*a* receives via its clock terminal CK is raised to a high level. Then, the D latch circuit 41*a* outputs the CS signal CS1, which indicates the change in electric potential level, via its output terminal Q.

The D latch circuit 42*a* receives the reset signal RESET via its reset terminal CL, receives an output (polarity signal CMI or logically inversed signal CMIB which is logically inversed version of CMI) from the MUX circuit 42*c* via its data terminal D, and receives an output from the OR circuit 42*b* via its clock terminal CK. In accordance with a change (from a low level to a high level or from a high level to a low level) in electric potential level of the signal that the D latch circuit 42*a* receives via its clock terminal CK, the D latch circuit 42*a* outputs, as a CS signal CS2 indicative of the change in electric potential level, an input state (low level or high level) of the polarity signal (CMI or CMIB) that it receives via its data terminal D.

Figure 14:
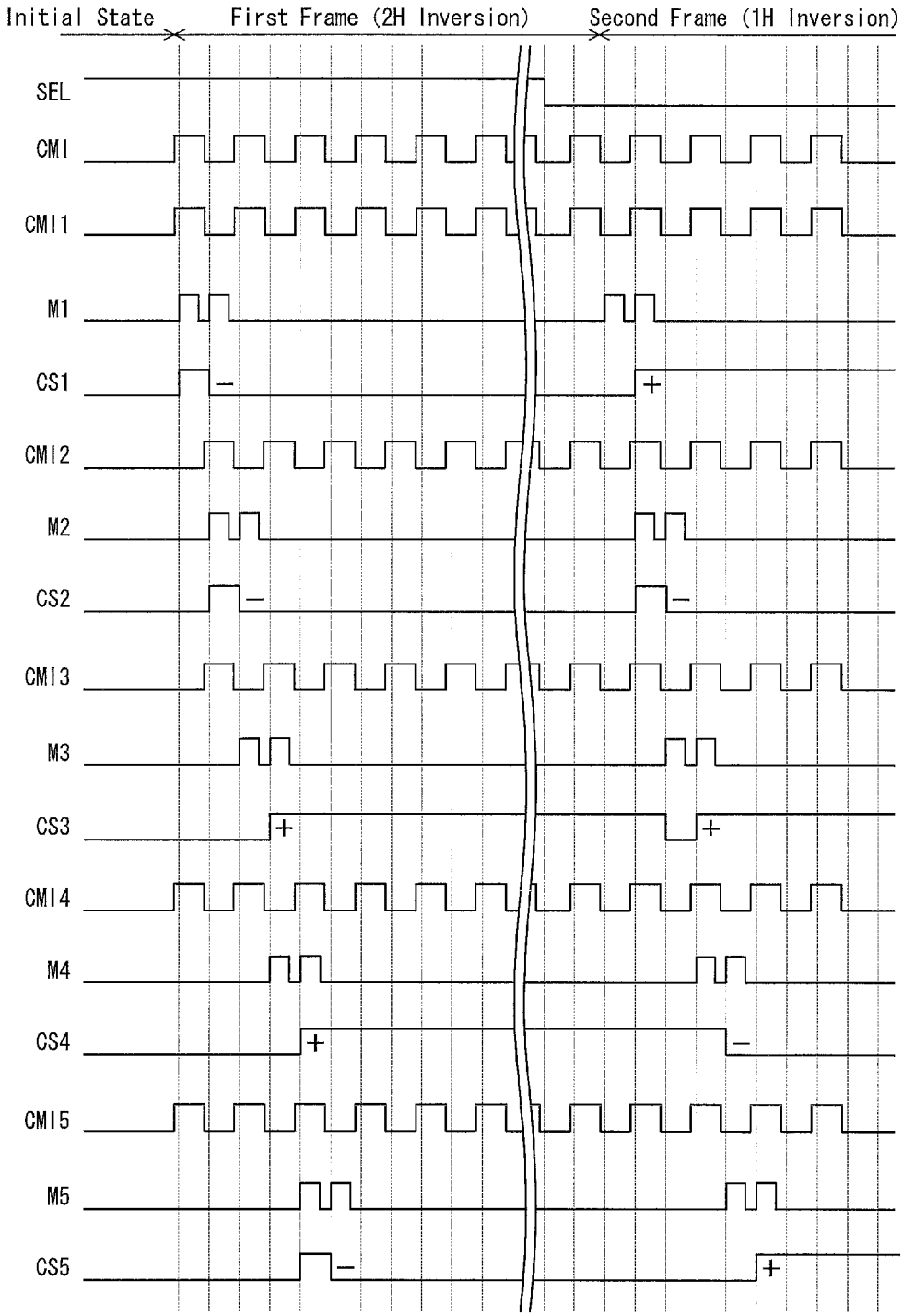
FIG. 14 is a timing chart showing waveforms of various signals that are inputted to and outputted from the CS bus line driving circuit in Example 4.

The OR circuit 41*b* receives an output signal SRO1 from a corresponding shift register circuit SR1 in the first row and an output signal SRO2 from the shift register circuit SR2, thereby outputting a signal M1 shown in FIGS. 12 and 14. The OR circuit 42*b* receives an output signal SRO2 from a corresponding shift register circuit SR2 in the second row and an output signal SRO3 from the shift register circuit SR3, thereby outputting a signal M2 shown in FIGS. 12 and 14.

The MUX circuit 42*c* receives the polarity signals CMI and CMIB, and the selection signal SEL. In accordance with the selection signal SEL, the MUX circuit 42*c* supplies the polarity signal CMI or CMIB to the OR circuit 42*b*. For example, in a case where the selection signal SEL is at a high level, the MUX circuit 42*c* outputs the polarity signal CMI. In a case where the selection signal SEL is at a low level, the MUX circuit 42*c* outputs the polarity signal CMIB.

The selection signal SEL is a switching signal for switching between 2-line inversion driving and 1-line inversion driving. In this example, 2-line inversion driving is carried out when the selection signal SEL is at a high level, and 1-line inversion driving is carried out when the selection signal SEL is at a low level.

FIG. 14 shows waveforms of various signals that are inputted to and outputted from the CS bus line driving circuit 40 of the liquid crystal display device 1 of Example 4. Note here that the waveforms shown in FIG. 14 are those obtained in a case where 2-line inversion driving is carried out in the first frame and 1-line inversion driving is carried out in the second frame. That is, in the first frame, the selection signal SEL is set to a high level, and, in the second frame, the selection signal SEL is set to a low level. In the rows in which the MUX circuits are provided, the polarity signal CMIB is supplied to a D latch circuit when the selection signal SEL is at a high level (i.e., 2-line inversion driving), and the polarity signal CMI is supplied to the D latch circuit when the selection signal SEL is at a low level (i.e., 1-line inversion driving).

First, the following describes changes in waveforms of various signals in the first row. In an initial state, the D latch circuit 41*a* of the CS circuit 41 receives the polarity signal CMI via its terminal D and receives the reset signal RESET via its reset terminal CL. The reset signal RESET causes the electric potential of the CS signal CS1 that the D latch circuit 41*a* outputs via its output terminal Q to be retained at a low level.

After that, the shift register output SRO1 corresponding to the gate signal G1 supplied to the gate line 12 in the first row is outputted from the shift register circuit SR1, and is inputted to one input terminal of the OR circuit 41*b* of the CS circuit 41. Then, a change (from low to high) in electric potential of the shift register output SRO1 in the signal M1 is inputted to the clock terminal CK. Upon receiving the change (from low to high) in electric potential of the shift register output SRO1 in the signal M1 via its clock terminal CK, the D latch circuit 41*a* transfers an input state of the polarity signal CMI (CMI1 in FIG. 12) that it received via its terminal D at the point in time i.e., transfers a high level. That is, the electric potential of the CS signal CS1 is switched from a low level to a high level at a time when there is a change (from low to high) in electric potential of the shift register output SRO1. The D latch circuit 41*a* outputs the high level until there is a change (from high to low) in electric potential of the shift register output SRO1 in the signal M1 inputted to the clock terminal CK (i.e., during a period of time in which the signal M1 is at a high level). Next, upon receiving a change (from high to low) in electric potential of the shift register output SRO1 in the signal M1 via its clock terminal CK, the D latch circuit 41*a* latches an input state of the polarity signal CMI1 that it received at the point in time, i.e., latches a high level. After that, the D latch circuit 41*a* retains the high level until the signal M1 is raised to a high level.

Then, the shift register output SRO2 that has been shifted to the second row in the gate line driving circuit 30 is supplied to the other input terminal of the OR circuit 41*b*. Note that the shift register output SRO2 is supplied also to one input terminal of the OR circuit 42*b* of the CS circuit 42.

The D latch circuit 41*a* receives a change (from low to high) in electric potential of the shift register output SRO2 in the signal M1 via its clock terminal CK, and transfers an input state of the polarity signal CMI1 that it received via its terminal D at the point in time, i.e., transfers a low level. That is, the electric potential of the CS signal CS1 is switched from a high level to a low level at a time when there is a change (from low to high) in electric potential of the shift register output SRO2. The D latch circuit 41*a* outputs the low level until there is a change (from high to low) in the electric potential of the shift register output SRO2 in the signal M1 inputted to the clock terminal CK (i.e., during a period of time in which the signal M1 is at a high level). Next, upon receiving a change (from high to low) in electric potential of the shift register output SRO2 in the signal M1 via its clock terminal CK, the D latch circuit 41*a* latches an input state of the polarity signal CMI1 that it received at the point in time, i.e., latches a low level. After that, the D latch circuit 41*a* retains the low level until the signal M1 is raised to a high level in the second frame.

In the second frame, the shift register output SRO1 is outputted from the shift register circuit SR1 and inputted to one input terminal of the OR circuit 41*b* of the CS circuit 41. Then, a change (from low to high) in electric potential of the shift register output SRO1 in the signal M1 is inputted to the clock terminal CK. Upon receiving the change (from low to high) in electric potential of the shift register output SRO1 in the signal M1 via its clock terminal CK, the D latch circuit 41*a* transfers an input state of the polarity signal CMI1 that it received via its terminal D at the point in time, i.e., transfers a low level. After the D latch circuit 41*a* transfers the input state (low level) of the polarity signal CMI1 that it received via its data terminal D during a period of time in which the shift register output SRO1 in the signal M1 is at a high level, the D latch circuit 41*a* latches an input state (low level) of the polarity signal CMI1 at a point in time where it receives a change (from high to low) in electric potential of the shift register output SRO1. Thereafter, the D latch circuit 41*a* retains the low level until the next time when the signal M1 is raised to a high level.

Then, the shift register output SRO2 that has been shifted to the second row in the gate line driving circuit 30 is supplied to the other input terminal of the OR circuit 41*b*. The shift register output SRO2 is supplied also to one input terminal of the OR circuit 42*b* of the CS circuit 42.

The D latch circuit 41*a* receives a change (from low to high) in electric potential of the shift register output SRO2 in the signal M1 via its clock terminal CK, and transfers an input state of the polarity signal CMI1 that it received via its terminal D at the point in time, i.e., transfers a high level. That is, the electric potential of the CS signal CS1 is switched from a low level to a high level at a time when there is a change (from low to high) in electric potential of the shift register output SRO2. The D latch circuit 41*a* outputs the high level until there is a change (from high to low) in electric potential of the shift register output SRO2 in the signal M1 inputted to the clock terminal CK (i.e., during a period of time in which the signal M1 is at a high level). Next, upon receiving a change (from high to low) in electric potential of the shift register output SRO2 in the signal M1 via its clock terminal CK, the D latch circuit 41*a* latches an input state of the polarity signal CMI1 that it received at the point in time, i.e., latches a high level. After that, the D latch circuit 41*a* retains the high level until the signal M1 is raised to a high level in the third frame.

Next, the following describes changes in waveforms of various signals in the second row. In the initial state, the D latch circuit 42*a* of the CS circuit 42 receives the polarity signal CMI via its terminal D and receives the reset signal RESET via its reset terminal CL. The reset signal RESET causes the electric potential of the CS signal CS2 that the D latch circuit 42*a* outputs via its the output terminal Q to be retained at a low level.

After that, the shift register output SRO2 corresponding to the gate signal G2 supplied to the gate line 12 in the second row is outputted from the shift register circuit SR2, and is inputted to one input terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 via its clock terminal CK, the D latch circuit 42*a* transfers an input state of the polarity signal CMIB (CMI2 in FIG. 12) that it received via its data terminal D at the point in time, i.e., transfers a high level. That is, the electric potential of the CS signal CS2 is switched from a low level to a high level at a time when there is a change (from low to high) in electric potential of the shift register output SRO2. The D latch circuit 42*a* outputs the high level until there is a change (from high to low) in electric potential of the shift register output SRO2 in the signal M2 inputted to the clock terminal CK (i.e., during a period of time in which the signal M2 is at a high level). Then, upon receiving a change (from high to low) in electric potential of the shift register output SRO2 in the signal M2 via its clock terminal CK, the D latch circuit 42*a* latches an input state of the polarity signal CMI2 that it received at the point in time, i.e., latches a high level. After that, the D latch circuit 42*a* retains the high level until the signal M2 is raised to a high level.

Then, the shift register output SRO3 that has been shifted to the third row in the gate line driving circuit 30 is supplied to the other input terminal of the OR circuit 42*b*. The shift register output SRO3 is supplied also to one input terminal of the OR circuit 43*b* of the CS circuit 43.

The D latch circuit 42*a* receives a change (from low to high) in electric potential of the shift register output SRO3 in the signal M2 via its clock terminal CK, and transfers an input state of the polarity signal CMI2 that it received via its terminal D at the point in time, i.e., transfers a low level. That is, the electric potential of the CS signal CS2 is switched from a high level to a low level at a time when there is a change SRO3 (from low to high) in electric potential of the shift register output. The D latch circuit 42*a* outputs the low level until there is a change (from high to low) in electric potential of the shift register output SRO3 in the signal M2 inputted to the clock terminal CK (i.e., during a period of time in which the signal M2 is at a high level). Next, upon receiving a change (from high to low) in electric potential of the shift register output SRO3 in the signal M2 via its clock terminal CK, the D latch circuit 42*a* latches an input state of the polarity signal CMI2 that it received at the point in time, i.e., latches a low level. After that, the D latch circuit 42*a* retains the low level until the signal M2 is raised to a high level in the second frame.

In the second frame, the shift register output SRO2 is outputted from the shift register circuit SR2 and inputted to one input terminal of the OR circuit 42*b* of the CS circuit 42. Then, upon receiving a change (from low to high) in electric potential of the shift register output SRO2 in the signal M2 via its clock terminal CK, the D latch circuit 42*a* transfers an input state of the polarity signal CMI2 (CMI) that it received via its terminal D at the point in time, i.e., transfers a high level. That is, the electric potential of the CS signal CS2 is switched from a low level to a high level at a time when there is a change (from low to high) in electric potential of the shift register output SRO3. The D latch circuit 42*a* outputs the high level until there is a change (from high to low) in electric potential of the shift register output SRO2 in the signal M2 inputted to the clock terminal CK (i.e., during a period of time in which the signal M2 is at a high level). Next, upon receiving a change (from high to low) in electric potential of the shift register output SRO2 in the signal M2 via its clock terminal CK, the D latch circuit 42*a* latches an input state of the polarity signal CMI2 that it received at the point in time, i.e., latches a high level. After that, the D latch circuit 42*a* retains the high level until the signal M2 is raised to a high level.

Then, the shift register output SRO3 that has been shifted to the third row in the gate line driving circuit 30 is supplied to the other input terminal of the OR circuit 42*b*. The shift register output SRO3 is supplied also to one input terminal of the OR circuit 43*b* of the CS circuit 43.

The D latch circuit 42*a* receives a change (from low to high) in electric potential of the shift register output SRO3 in the signal M2 via its clock terminal CK, and transfers an input state of the polarity signal CMI2 that it received via its terminal D at the point in time, i.e., transfers a low level. That is, the electric potential of the CS signal CS2 is switched from a high level to a low level at a time when there is a change (from low to high) in electric potential of the shift register output SRO3. The D latch circuit 42*a* outputs the low level until there is a change (from high to low) in electric potential of the shift register output SRO3 in the signal M2 inputted to the clock terminal CK (i.e., during a period of time in which the signal M2 is at a high level). Next, upon receiving a change (from high to low) in electric potential of the shift register output SRO3 in the signal M2 via its clock terminal CK, the D latch circuit 42*a* latches an input state of the polarity signal CMI2 that it received at the point in time, i.e., latches a low level. After that, the D latch circuit 42*a* retains the low level until the signal M2 is raised to a high level in the third frame.

Note that, in the third row, the polarity signal CMI is latched (i) in accordance with the shift register outputs SRO3 and SRO4 in the first frame and (ii) in accordance with the shift register outputs SRO3 and SRO4 in the second frame, whereby a CS signal CS3 shown in FIG. 14 is outputted.

As described above, in each first frame, each of the CS circuits 41, 42, 43, . . . , and 4*n* corresponding to the respective rows makes it possible, in 2-line inversion driving, to switch the electric potential of a CS signal at a point in time where a gate signal in a corresponding row falls (at a point in time where a TFT 13 is switched from on to off) between high and low levels after the gate signal in this row falls. Further, in each second frame, each of the CS circuits 41, 42, 43, . . . , and 4*n* corresponding to the respective rows makes it possible, in 1-line inversion driving, to switch the electric potential of a CS signal at a point in time where a gate signal in a corresponding row falls (at a point in time where a TFT 13 is switched from on to off) between high and low levels after the gate signal in this row falls.

That is, in the first frame in which 2-line inversion driving is carried out, (i) a CS signal CSn supplied to the CS bus line 15 in the nth row is generated by latching an electric potential level of the polarity signal CMI or CMIB at a point in time where the gate signal Gn in the nth row rises and an electric potential level of the polarity signal CMI or CMIB at a point in time where the gate signal G(n+1) in the (n+1)th row rises and (ii) a CS signal CSn+1 supplied to the CS bus line 15 in the (n+1)th row is generated by latching an electric potential level of the polarity signal CMI or CMIB at a point in time where the gate signal G(n+1) in the (n+1)th row rises and an electric potential level of the polarity signal CMI or CMIB at a point in time where the gate signal G(n+2) in the (n+2)th row rises.

Further, in the second frame in which 1-line inversion driving is carried out, (i) a CS signal CSn supplied to the CS bus line 15 in the nth row is generated by latching an electric potential level of the polarity signal CMI at a point in time where the gate signal Gn in the nth row rises and an electric potential level of the polarity signal CMI at a point in time where the gate signal G(n+1) in the (n+1)th row rises and (ii) a CS signal CSn+1 supplied to the CS bus line 15 in the (n+1)th row is generated by latching an electric potential level of the polarity signal CMI at a point in time where the gate signal G(n+1) in the (n+1)th row rises and an electric potential level of the polarity signal CMI at a point in time where the gate signal G(n+2) in the (n+2)th row rises.

This allows the CS bus line driving circuit 40 to operate properly both in longitudinal double-size display driving and normal display driving, thus making it possible to prevent the appearance of transverse stripes in the first frame and to eliminate possible appearance of transverse stripes due to a switch from longitudinal double-size display driving to normal display driving. Although Example 4 has been described by taking, as an example, the configuration for switching from resolution conversion driving (longitudinal double-size display driving) to normal display driving, a configuration for switching from normal display driving to resolution conversion driving (longitudinal double-size display driving) can also of course bring about the same effects in the same configuration as Example 4. This point applies to each of the embodiments below.

Example 5

Figure 15:
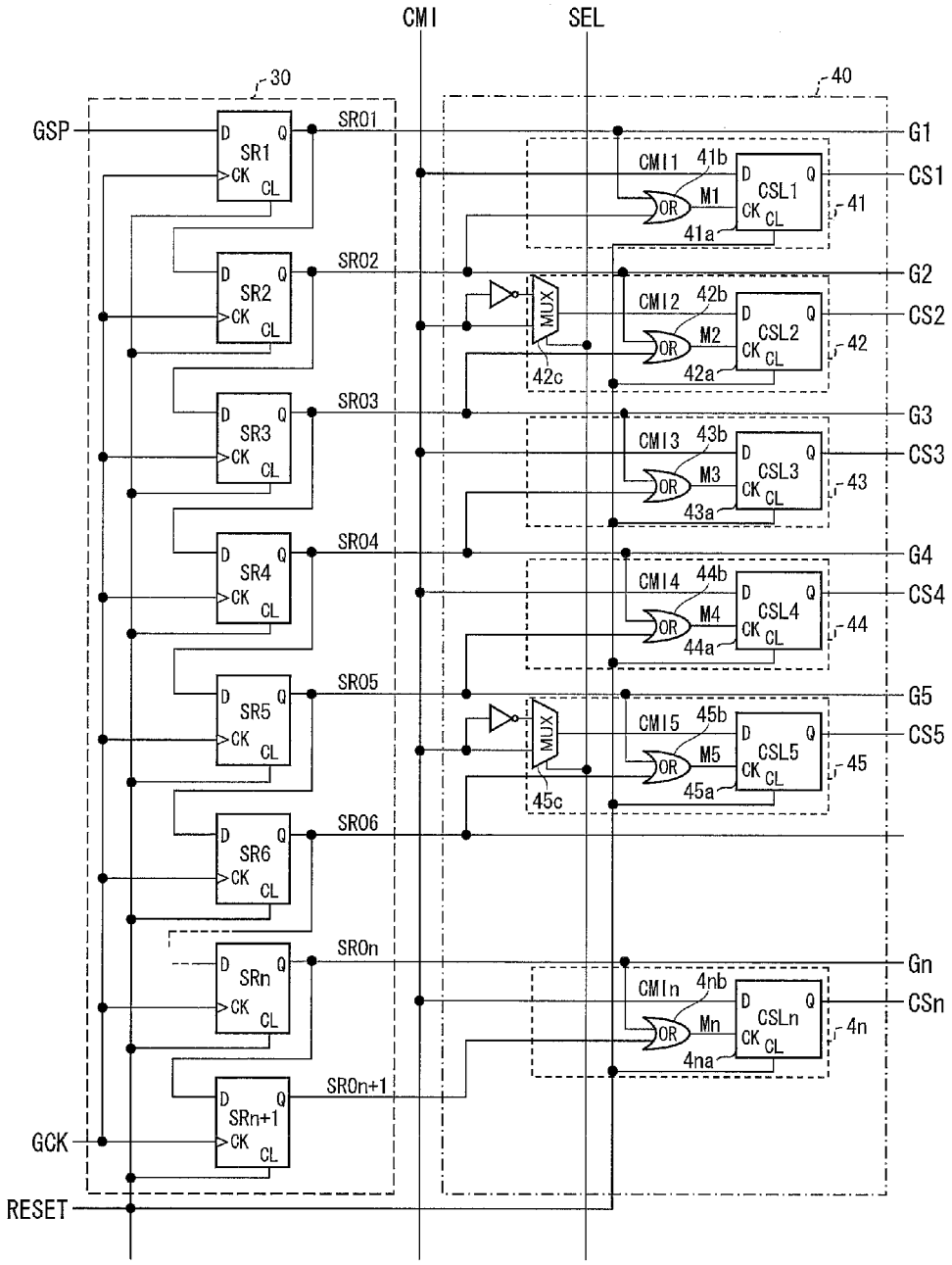
FIG. 15 is a block diagram showing a configuration of a gate line driving circuit and a CS bus line driving circuit in Example 5.
Figure 16:
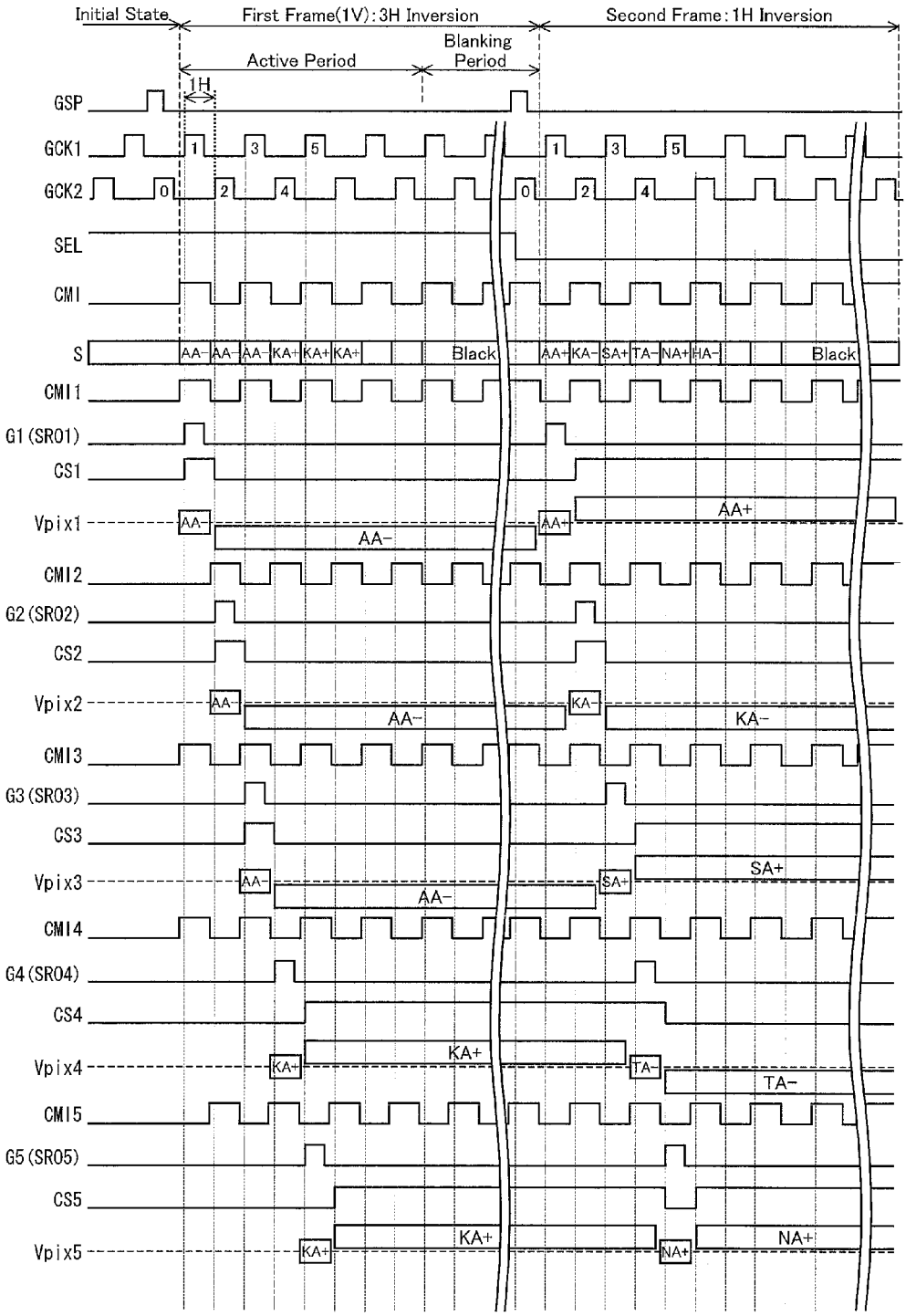
FIG. 16 is a timing chart showing waveforms of various signals of a liquid crystal display device in Example 5.

FIG. 16 is a timing chart showing waveforms of various signals observed in a case of changing from (i) using, in the first frame, a display mode (longitudinal triple-size display driving) in which to carry out a display by converting resolution of a video signal by a factor of 3 (n=3) only in the column-wise direction to (ii) using, in the second frame, a display mode (normal display driving) in which to carry out a display without converting the resolution of the video signal (m=1). FIG. 15 shows a configuration of the gate line driving circuit 30 and the CS bus line driving circuit 40 for achieving this operation.

The liquid crystal display device 1 of Example 5 has the same configuration as that shown in FIG. 12, except that MUX circuits 4*nc* are provided in every third row such that these are provided in the second row, fifth row, eighth row, eleventh row, and so on.

The selection signal SEL is a switching signal for switching between 3-line inversion driving and 1-line inversion driving. Note here that 3-line inversion driving is carried out when the selection signal SEL is at a high level and 1-line inversion driving is carried out when the selection signal SEL is at a low level. The polarity signal CMI reverses its polarity every single horizontal scanning period.

As shown in FIG. 16, in an initial state, the CS signals CS1 to CS5 are all fixed at one electric potential (in FIG. 16, at a low level). In the first frame, the CS signal CS1 in the first row is at a high level at a point in time where its corresponding gate signal G1 falls, the CS signal CS2 in the second row is at a high level at a point in time where its corresponding gate signal G2 falls, and the CS signal CS3 in the third row is at a high level at a point in time where its corresponding gate signal G3 falls. On the other hand, the CS signal SC4 in the fourth row is at a low level at a point in time where its corresponding gate signal G4 falls, and the CS signal CS5 in the fifth row is at a low level at a point in time where its corresponding gate signal G5 falls. The CS signal CS6 in the sixth row is at a low level at a point in time where its corresponding gate signal G6 falls. The CS signal CS7 in the seventh row is at a high level at a point in time where its corresponding gate signal G7 falls.

Then, the CS signals CS1 to CS7 switch between high and low electric potential levels after their corresponding gate signals G1 to G7 fall. Specifically, in the first frame, the CS signals CS1, CS2, and CS3 fall after their corresponding gate signals G1, G2, and G3 fall, respectively, and the CS signals CS4, CS5, and CS6 rise after their corresponding gate signals G4, G5, and G6 fall, respectively.

The source signal S in the first frame is a signal which has amplitude corresponding to a gray scale represented by a video signal and which reverses its polarity every three horizontal scanning periods (3H). Further, the source signal S in the first frame has the same electric potential during three adjacent horizontal scanning periods (3H) and has the same electric potential during next three adjacent horizontal scanning periods (3H). That is, each of the reference signs "AA" to "SA" shown in FIG. 7 corresponds to a single horizontal scanning period, and indicates a signal potential (gray scale) during that horizontal scanning period. The source signal S exhibits identical signal potentials of a negative polarity ("AA") during the first, second, and third horizontal scanning periods, and exhibits identical signal potentials of a positive polarity ("KA") during the fourth, fifth, and sixth horizontal scanning periods. The gate signals G1 to G5 serve as gate-on potentials during the first to fifth 1H periods, respectively, in an active period (effective scanning period) of each frame, and serve as gate-off potentials during the other periods.

In the second frame, on the other hand, the source signal S is a signal which has amplitude corresponding to a gray scale represented by a video signal and which reverses its polarity every single horizontal scanning period (1H). Further, the source signal S in the second frame corresponds to the gray scale of the first frame, and the source signal S in the second frame is assigned the reference signs "AA" to "SA" respectively corresponding to the reference signs "AA" to "SA" of the first frame. That is, the gray scale ("AA") of the first, second, and third rows in the first frame and the gray scale ("AA") of the first row in the second frame are equal to each other. The gray scale ("KA") of the fourth, fifth, and sixth rows in the first frame and the gray scale ("KA") of the second row in the second frame are equal to each other. The gate signals G1 to G7 serve as gate-on potentials during the first to seventh 1H periods, respectively, in an active period (effective scanning period) of each frame, and serve as gate-off potentials during the other periods.

In the second frame, the CS signal CS1 in the first row is at a low level at a point in time where the corresponding gate signal G1 (which corresponds to the output SRO1 from the corresponding shift register circuit SR1) falls. The CS signal CS2 in the second row is at a high level at a point in time where the corresponding gate signal G2 falls. The CS signal CS3 in the third row is at a low level at a point in time where the corresponding gate signal G3 falls. The CS signal CS4 in the fourth row is at a high level at a point in time where the corresponding gate signal G4 falls. The CS signal CS5 in the fifth row is at a low level at a point in time where the corresponding gate signal G5 falls.

Then, the CS signals CS1 and CS3 rise after their corresponding gate signals G1 and G3 fall, respectively, and the CS signals CS2 and CS4 fall after their corresponding signals G2 and G4 fall, respectively.

Thus, in the first frame in which longitudinal triple-size display diving is carried out, the electric potential of each CS signal at a point in time where the gate signal falls varies every three rows in correspondence with the polarity of the source signal S; therefore, the electric potentials Vpix1 to Vpix5 of the pixel electrodes 14 are all properly shifted by the CS signals CS1 to CS5, respectively. Therefore, inputting of source signals S of the same gray scale causes the positive and negative potential differences between the electric potential of the counter electrode and the shifted potential of each of the pixel electrodes 14 to be equal to each other. That is, in the first frame, in which source signals having a negative polarity and the same electric potential (gray scale) are written to pixels corresponding to three adjacent rows in the same column of pixels and source signals having a positive polarity and the same electric potential (gray scale) are written to pixels corresponding to three adjacent pixels next to the three rows in the same column of pixels, the electric potentials of the CS signals corresponding to the first three rows are not polarity-reversed during the writing to the pixels corresponding to the first three rows, are polarity-reversed in a negative direction after the writing, and are not polarity-reversed until the next writing, and the electric potentials of the CS signals corresponding to the next three rows are not polarity-reversed during the writing to the pixels corresponding to the next three rows, are polarity-reversed in a positive direction after the writing, and are not polarity-reversed until the next writing. This achieves longitudinal triple-size display driving (3-line inversion driving) in CC driving. Further, the foregoing configuration allows the electric potentials Vpix1 to Vpix5 of the pixel electrodes 14 to be properly shifted by the CS signals CS1 to CS5, thus making it possible to eliminate possible appearance of transverse stripes in the first frame of a display picture.

Further, in the second frame in which normal driving (1-line inversion driving) is carried out, the electric potential of each CS signal at a point in time where the gate signal falls varies every adjacent rows in correspondence with the polarity of the source signal S; therefore, the electric potentials Vpix1 to Vpix5 of the pixel electrodes 14 are all properly shifted by the CS signals CS1 to CS5, respectively. Therefore, inputting of source signals S of the same gray scale causes the positive and negative potential differences between the electric potential of the counter electrode and the shifted potential of each of the pixel electrodes 14 to be equal to each other. That is, in the second frame, in which source signals having a positive polarity are written to the odd-numbered pixels of the same column of pixels and source signals having a negative polarity are written to the even-numbered pixels, the electric potentials of the CS signals corresponding to the odd-numbered pixels are not polarity-reversed during the writing to the odd-numbered pixels corresponding to the first two rows, are polarity-reversed in a positive direction after the writing, and are not polarity-reversed until the next writing, and the electric potentials of the CS signals corresponding to the even-numbered pixels are not polarity-reversed during the writing to the even-numbered pixels, are polarity-reversed in a negative direction after the writing, and are not polarity-reversed until the next writing. This achieves 1-line inversion driving in CC driving.

Moreover, the foregoing configuration allows the electric potentials Vpix1 to Vpix5 of the pixel electrodes 14 to be properly shifted by the CS signals CS1 to CS5, respectively, even in a case of a switch from longitudinal triple-size display driving (3-line inversion driving) to normal display driving (1-line inversion driving). This allows pixel electrodes 14 that are supplied with the same signal potential during the first and second frames to be equal in electric potential to each other, thus making it possible to eliminate the appearance of transverse stripes shown in FIG. 29.

Figure 17:
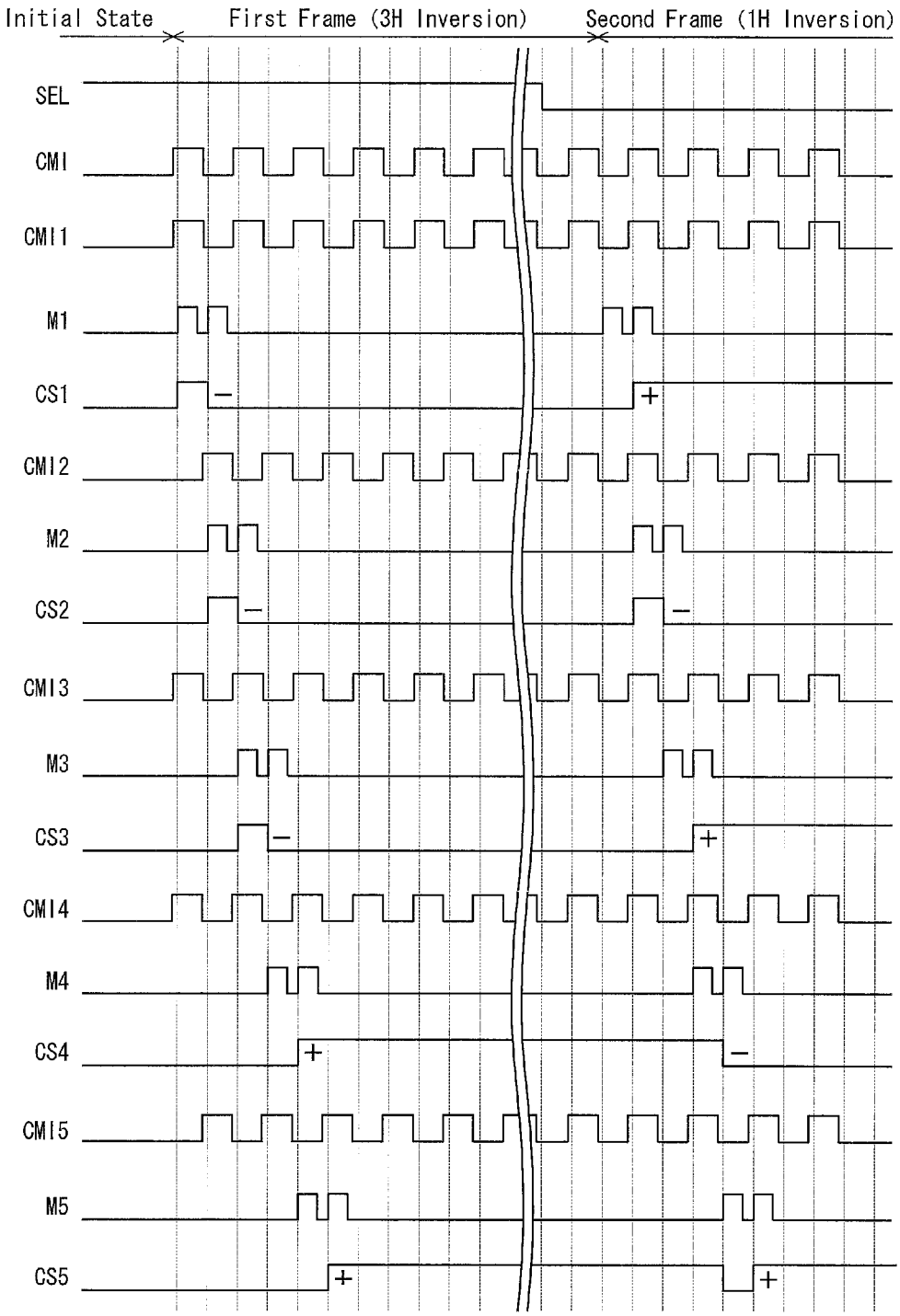
FIG. 17 is a timing chart showing waveforms of various signals that are inputted to and outputted from the CS bus line driving circuit in Example 5.

The following description discusses, with reference to FIGS. 16 and 17, how the liquid crystal display device 1 of Example 5 operates. FIG. 17 shows waveforms of various signals inputted to and outputted from the CS bus line driving circuit 40 of the liquid crystal display device 1 of Example 5. Note here that the waveforms shown in FIG. 17 are those obtained in a case where 3-line inversion driving is carried out in the first frame and 1-line inversion driving is carried out in the second frame. That is, the selection signal SEL is set to a high level in the first frame and is set to a low level in the second frame. In the rows in which the MUX circuits are provided, the polarity signal CMIB is inputted to a D latch circuit when the selection signal SEL is at a high level (3-line inversion driving) and the polarity signal CMI is inputted to the D latch circuit when the selection signal SEL is at a low level (1-line inversion driving). In the following, for convenience of description, the CS circuits 42 and 43 corresponding to the respective second and third rows are taken as an example.

First, the following describes changes in waveforms of various signals in the second row. In the initial state, the D latch circuit 42*a* of the CS circuit 42 receives the polarity signal CMI via its terminal D and receives the reset signal RESET via its reset terminal CL. The reset signal RESET causes the electric potential of the CS signal CS2 that the D latch circuit 42*a* outputs via its output terminal Q to be retained at a low level.

After that, the shift register output SRO2 corresponding to the gate signal G2 supplied to the gate line 12 in the second row is outputted from the shift register circuit SR2, and is inputted to one input terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 in the signal M2 via its clock terminal CK, the D latch circuit 42*a* transfers an input state of the polarity signal CMIB (CMI2 in FIG. 15) that it received via its terminal D at the point in time, i.e., transfers a high level. That is, the electric potential of the CS signal CS2 is switched from a low level to a high level at a time when there is a change (from low to high) in electric potential of the shift register output SRO2. The D latch circuit 42*a* outputs the high level until there is a change (from high to low) in the electric potential of the shift register output SRO2 in the signal M2 inputted to the clock terminal CK (i.e., during a period of time in which the signal M2 is at a high level). Next, upon receiving a change (from high to low) in electric potential of the shift register output SRO2 in the signal M2 via its clock terminal CK, the D latch circuit 42*a* latches an input state of the polarity signal CMI2 that it received at the point in time, i.e., latches a high level. After that, the D latch circuit 42*a* retains the high level until the signal M2 is raised to a high level.

Then, the shift register output SRO3 that has been shifted to the third row in the gate line driving circuit 30 is supplied to the other input terminal of the OR circuit 42*b*. Note that the shift register output SRO3 is supplied also to one input terminal of the OR circuit 43*b* of the CS circuit 43.

The D latch circuit 42*a* receives a change (from low to high) in electric potential of the shift register output SRO3 in the signal M2 via its clock terminal CK, and transfers an input state of the polarity signal CMI2 that it received via its terminal D at the point in time, i.e., transfers a low level. That is, the electric potential of the CS signal CS2 is switched from a high level to a low level at a time when there is a change (from low to high) in electric potential of the shift register output SRO3. The D latch circuit 42*a* outputs the low level until there is a change (from high to low) in electric potential of the shift register output SRO3 in the signal M2 inputted to the clock terminal CK (i.e., during a period of time in which the signal M2 is at a high level). Next, upon receiving a change (from high to low) in electric potential of the shift register output SRO3 in the signal M2 via its clock terminal CK, the D latch circuit 42*a* latches an input state of the polarity signal CMI2 that it received at the point in time, i.e., latches a low level. After that, the D latch circuit 42*a* retains the low level until the signal M2 is raised to a high level in the second frame.

In the second frame, the shift register output SRO2 is outputted from the shift register circuit SR2 and inputted to one input terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 in the signal M2 via its clock terminal CK, the D latch circuit 42*a* transfers an input state of the polarity signal CMI2 (CMI) that it received via its terminal D at the point in time, i.e., transfers a high level. That is, the electric potential of the CS signal CS2 is switched from a low level to a high level at a time when there is a change (from low to high) in electric potential of the shift register output SRO2. The D latch circuit 42*a* outputs the high level until there is a change (from high to low) in electric potential of the shift register output SRO2 in the signal M2 inputted to the clock terminal CK (i.e., during a period of time in which the signal M2 is at a high level). Next, upon receiving a change (from high to low) in electric potential of the shift register output SRO2 in the signal M2 via its clock terminal CK, the D latch circuit 42*a* latches an input state of the polarity signal CMI2 that it received at the point in time, i.e., latches a high level. After that, the D latch circuit 42*a* retains the high level until the signal M2 is raised to a high level.

Then, the shift register output SRO3 that has been shifted to the third row in the gate line driving circuit 30 is supplied to the other input terminal of the OR circuit 42*b*. The shift register output SRO3 is supplied also to one input terminal of the OR circuit 43*b* of the CS circuit 43.

The D latch circuit 42*a* receives a change (from low to high) in electric potential of the shift register output SRO3 in the signal M2 via its clock terminal CK, and transfers an input state of the polarity signal CMI2 that it received via its terminal D at the point in time, i.e., transfers a low level. That is, the electric potential of the CS signal CS2 is switched from a high level to a low level at a time when there is a change (from low to high) in electric potential of the shift register output SRO3. The D latch circuit 42*a* outputs the low level until there is a change (from high to low) in electric potential of the shift register output SRO3 in the signal M2 inputted to the clock terminal CK (i.e., during a period of time in which the signal M2 is at a high level). Next, upon receiving a change (from high to low) in electric potential of the shift register output SRO3 in the signal M2 via its clock terminal CK, the D latch circuit 42*a* latches an input state of the polarity signal CMI2 that it received at the point in time, i.e., latches a low level. After that, the D latch circuit 42*a* retains the low level until the signal M2 is raised to a high level in the third frame.

Next, the following describes changes in waveforms of various signals in the third row. In the initial state, the D latch circuit 43*a* of the CS circuit 43 receives the polarity signal CMI via its terminal D and receives the reset signal RESET via its reset terminal CL. The reset signal RESET causes the electric potential of the CS signal CS3 that the D latch circuit 43*a* outputs via its output terminal Q to be retained at a low level.

After that, the shift register output SRO3 corresponding to the gate signal G3 supplied to the gate line 12 in the third row is outputted from the shift register circuit SR3, and is inputted to one input terminal of the OR circuit 43*b* of the CS circuit 43. Then, a change (from low to high) in electric potential of the shift register output SRO3 in the signal M3 is inputted to the clock terminal CK. Upon receiving the change (from low to high) in electric potential of the shift register output SRO3 in the signal M3 via its clock terminal CK, the D latch circuit 43*a* transfers an input state of the polarity signal CMI (CMI3 in FIG. 15) that it received via its data terminal D at the point in time, i.e., transfers a high level. That is, the electric potential of the CS signal CS3 is switched from a low level to a high level at a time when there is a change (from low to high) in electric potential of the shift register output SRO3. Then, the D latch circuit 43*a* outputs the high level until there is a change (from high to low) in electric potential of the shift register output SRO3 in the signal M3 inputted to the clock terminal CK (i.e., during a period of time in which the signal M3 is at a high level). Then, upon receiving a change (from high to low) in electric potential of the shift register output SRO3 in the signal M3 via its clock terminal CK, the D latch circuit 43*a* latches an input state of the polarity signal CMI3 that it received at the point in time, i.e., latches a high level. After that, the D latch circuit 43*a* retains the high level until the signal M3 is raised to a high level.

Then, the shift register output SRO4 that has been shifted to the fourth row in the gate line driving circuit 30 is supplied to the other input terminal of the OR circuit 43*b*. The shift register output SRO4 is supplied also to one input terminal of the OR circuit 44*b* of the CS circuit 44.

The D latch circuit 43*a* receives a change (from low to high) in electric potential of the shift register output SRO4 in the signal M3 via its clock terminal CK, and transfers an input state of the polarity signal CMI3 that it received via its terminal D at the point in time, i.e., transfers a low level. That is, the electric potential of the CS signal CS3 is switched from a high level to a low level at a time when there is a change (from low to high) in electric potential of the shift register output SRO4. The D latch circuit 43*a* outputs the low level until the next time when there is a change (from high to low) in electric potential of the shift register output SRO4 in the signal M3 inputted to the clock terminal CK (i.e., during a period of time in which the signal M3 is at a high level). Next, upon receiving a change (from high to low) in electric potential of the shift register output SRO4 in the signal M3 via its clock terminal CK, the D latch circuit 43*a* latches an input state of the polarity signal CMI3 that it received at the point in time, i.e., latches a low level. After that, the D latch circuit 43*a* retains the low level until the signal M3 is raised to a high level in the second frame.

In the second frame, the shift register output SRO3 is outputted from the shift register circuit SR3 and inputted to one input terminal of the OR circuit 43*b* of the CS circuit 43. Then, a change (from low to high) in electric potential of the shift register output SRO3 in the signal M3 is inputted to the clock terminal CK. Upon receiving the change (from low to high) in electric potential of the shift register output SRO3 in the signal M3 via its clock terminal CK, the D latch circuit 43*a* transfers an input state of the polarity signal CMI3 (CMI) that it received via its terminal D at the point in time, i.e., transfers a low level. After the D latch circuit 43*a* transfers the input state (low level) of the polarity signal CMI3 that it received via its data terminal D during a period of time in which the shift register output SRO3 in the signal M3 is at a high level, the D latch circuit 43*a* latches an input state (low level) of the polarity signal CMI3 at a point in time where it received a change (from high to low) in electric potential of the shift register output SRO3. Then, the D latch circuit 43*a* retains the low level until the signal M3 is raised to a high level.

Then, the shift register output SRO4 that has been shifted to the fourth row in the gate line driving circuit 30 is supplied to the other input terminal of the OR circuit 43*b*. The shift register output SRO4 is supplied also to one input terminal of the OR circuit 44*b* of the CS circuit 44.

The D latch circuit 43*a* receives a change (from low to high) in electric potential of the shift register output SRO4 via its clock terminal CK, and transfers an input state of the polarity signal CMI3 that it received via its terminal D at the point in time, i.e., transfers a high level. That is, the electric potential of the CS signal CS3 is switched from a low level to a high level at a time when there is a change (from low to high) in electric potential of the shift register output SRO4. The D latch circuit 43*a* outputs the high level until there is a change (from high to low) in electric potential of the shift register output SRO4 inputted to the clock terminal CK (i.e., during a period of time in which the signal M3 is at a high level). Next, upon receiving a change (from high to low) in electric potential of the shift register output SRO3 via its clock terminal CK, the D latch circuit 43*a* latches an input state of the polarity signal CMI3 that it received at the point in time, i.e., latches a high level. After that, the D latch circuit 43*a* retains the high level until the signal M3 is raised to a high level in the third frame.

Note that, in the fourth row, the polarity signal CMI is latched (i) in accordance with the shift register outputs SRO4 and SRO5 in the first frame and (ii) in accordance with the shift register outputs SRO4 and SRO5 in the second frame, thereby a CS signal CS4 shown in FIG. 17 is outputted.

As described above, in each first frame, each of the CS circuits 41, 42, 43, . . . , and 4*n* corresponding to the respective rows makes it possible, in 3-line inversion driving, to switch the electric potential of a CS signal at a point in time where a gate signal in a corresponding row falls (at a point in time where a TFT13 is switched from on to off) between high and low levels after the gate signal in this row falls. Further, in each second frame, each of the CS circuits 41, 42, 43, . . . , and 4*n* corresponding to the respective rows makes it possible, in 1-line inversion driving, to switch the electric potential of the CS signal at a point in time where a gate signal in a corresponding row falls (at a point in time where a TFT13 is switched from on to off) between high and low levels after the gate signal in this row falls.

This allows the CS bus line driving circuit 40 to operate properly both in longitudinal triple-size display driving and normal display driving, thus making it possible to prevent the appearance of transverse stripes in the first frame and to eliminate possible appearance of transverse stripes due to a switch from longitudinal triple-size display driving to normal display driving.

Example 6

Figure 18:
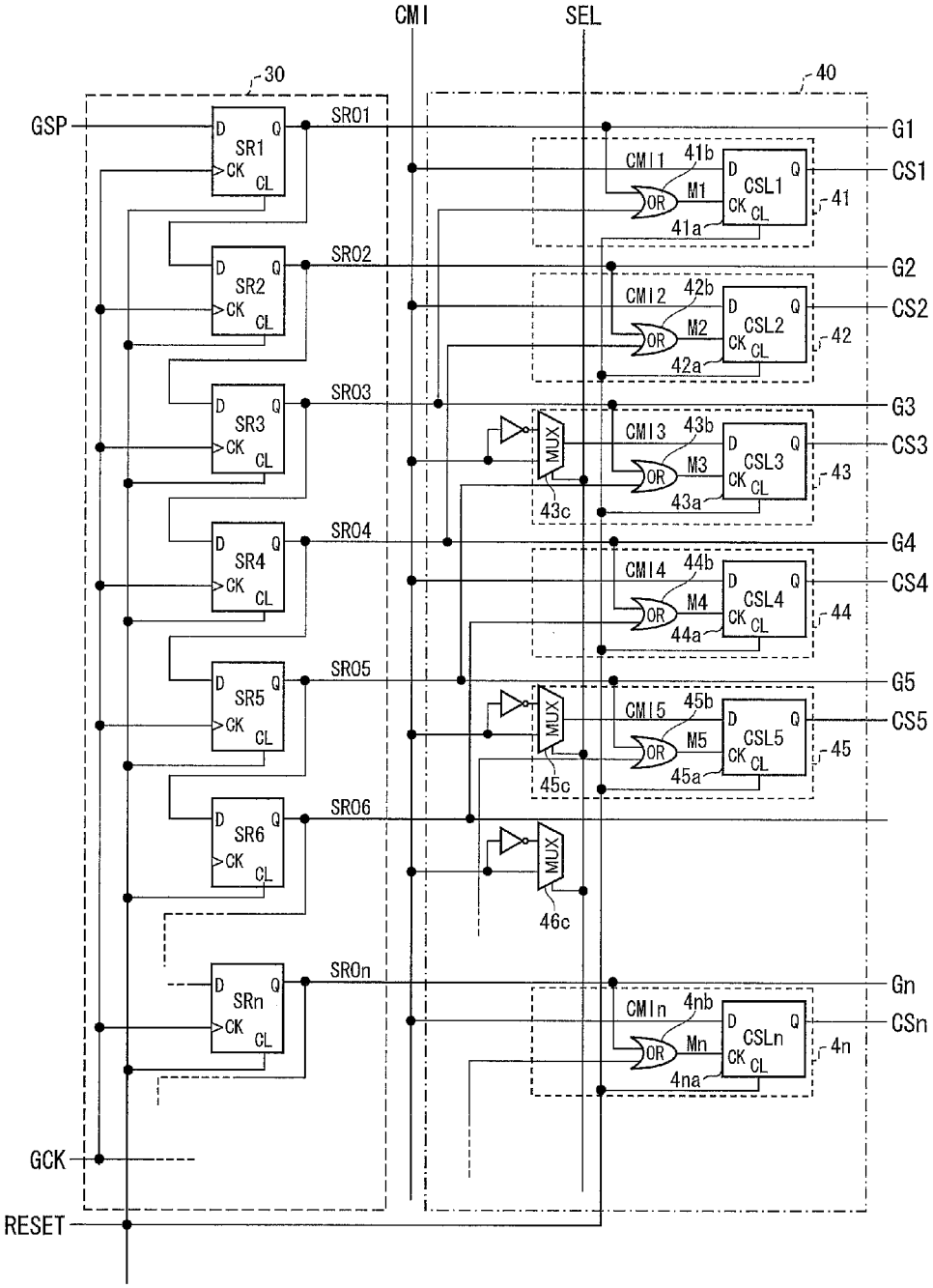
FIG. 18 is a block diagram showing a configuration of a gate line driving circuit and a CS bus line driving circuit in Example 6.
Figure 19:
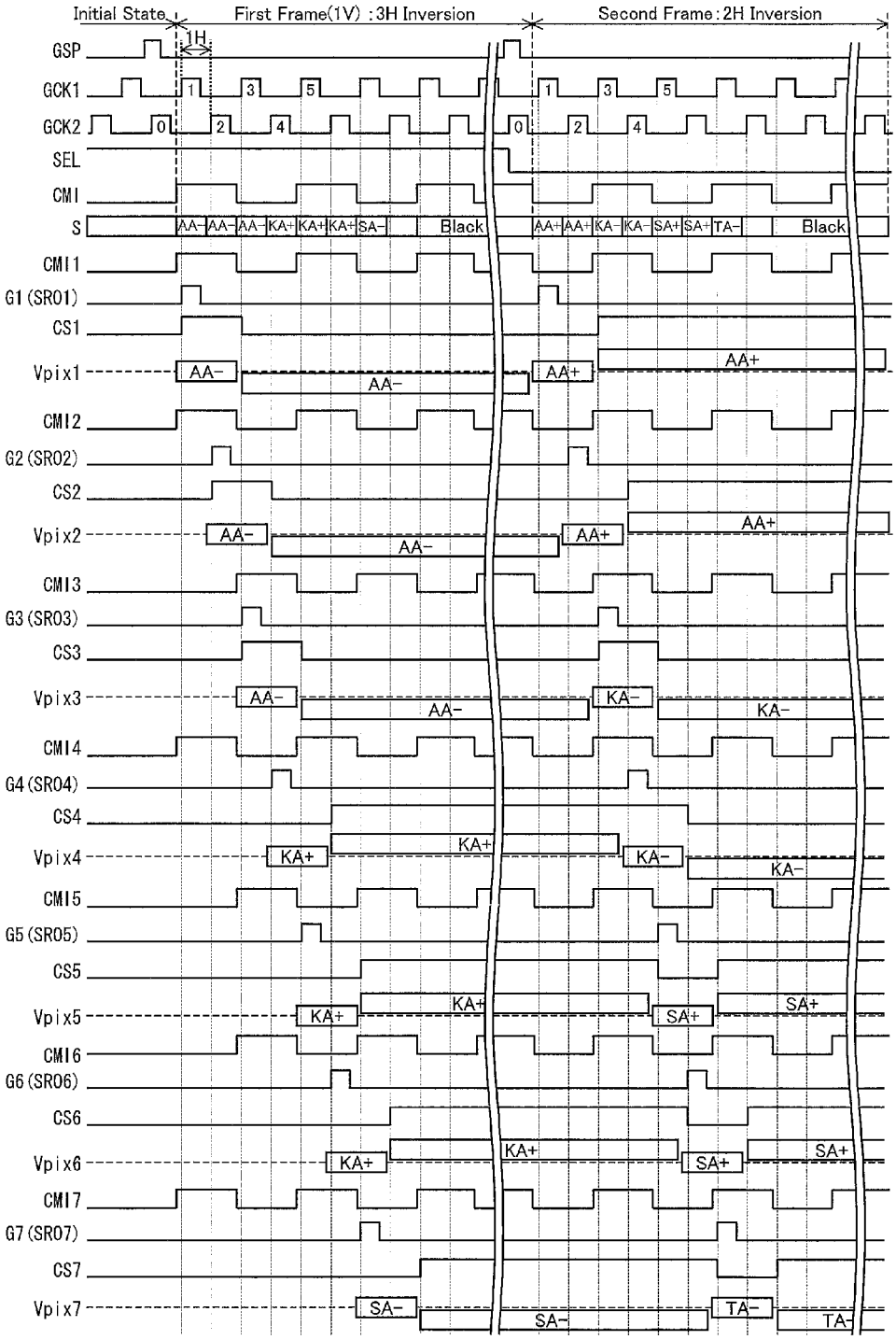
FIG. 19 is a timing chart showing waveforms of various signals of a liquid crystal display device in Example 6.

FIG. 19 is a timing chart showing waveforms of various signals observed in a case of changing from (i) using, in the first frame, a display mode (longitudinal triple-size display driving) in which to carry out a display by converting resolution of a video signal by a factor of 3 (n=3) only in the column-wise direction to (ii) using, in the second frame, a display mode (longitudinal double-size display driving) in which to carry out a display by converting resolution of a video signal by a factor of 2 (m=2) in the column-wise direction. FIG. 18 shows a configuration of the gate line driving circuit 30 and the CS bus line driving circuit 40 for achieving this operation.

In the liquid crystal display device 1 of Example 6, the MUX circuits 4*nc* are provided regularly, for example, in the third row, fifth row, sixth row, seventh row, eighth row, tenth row, and so on. The polarity signal CMI reverses its polarity every two horizontal scanning periods. Further, each OR circuit 4*nb* receives an output signal SROn from a shift register circuit SRn in the nth row and an output signal SROn+2 from a shift register circuit SRn+2 in the (n+2)th row.

The selection signal SEL is a switching signal for switching between 3-line inversion driving and 2-line inversion driving. Note here that 3-line inversion driving is carried out when the selection signal SEL is at a high level and 2-line inversion driving is carried out when the selection signal SEL is at a low level.

As shown in FIG. 19, in an initial state, the CS signals CS1 to CS7 are all fixed at one electric potential (in FIG. 19, at a low level). In the first frame, the CS signal CS1 in the first row is at a high level at a point in time where its corresponding gate signal G1 falls, the CS signal CS2 in the second row is at a high level at a point in time where its corresponding gate signal G2 falls, and the CS signal CS3 in the third row is at a high level at a point in time where its corresponding gate signal G3 falls. On the other hand, the CS signal SC4 in the fourth row is at a low level at a point in time where its corresponding gate signal G4 falls, and the CS signal CS5 in the fifth row is at a low level at a point in time where its corresponding gate signal G5 falls. The CS signal CS6 in the sixth row is at a low level at a point in time where its corresponding gate signal G6 falls. The CS signal CS7 in the seventh row is at a high level at a point in time where its corresponding gate signal G7 falls.

Then, the CS signals CS1 to CS7 switch between high and low electric potential levels after their corresponding gate signals G1 to G7 fall. Specifically, in the first frame, the CS signals CS1, CS2, and CS3 fall after their corresponding gate signals G1, G2, and G3 fall, respectively, and the CS signals CS4, CS5, and CS6 rise after their corresponding gate signals G4, G5, and G6 fall, respectively.

The source signal S in the first frame is a signal which has amplitude corresponding to a gray scale represented by a video signal and which reverses its polarity every three horizontal scanning periods (3H). Further, the source signal S in the first frame has the same electric potential during three adjacent horizontal scanning periods (3H) and has the same electric potential during next three adjacent horizontal scanning periods (3H). That is, each of the reference signs "AA" to "SA" shown in FIG. 19 corresponds to a single horizontal scanning period, and indicates a signal potential (gray scale) during that horizontal scanning period. The source signal S exhibits identical signal potentials of a negative polarity ("AA") during the first, second, and third horizontal scanning periods, and exhibits identical signal potentials of a positive polarity ("KA") during the fourth, fifth, and sixth horizontal scanning periods. The gate signals G1 to G7 serve as gate-on potentials during the first to seventh 1H periods, respectively, in an active period (effective scanning period) of each frame, and serve as gate-off potentials during the other periods.

In the second frame, on the other hand, the source signal S is a signal which has amplitude corresponding to a gray scale represented by a video signal and which reverses its polarity every two horizontal scanning periods (2H). Further, the source signal S in the second frame corresponds to the gray scale of the first frame, and the source signal S in the second frame is assigned the reference signs "AA" to "SA" respectively corresponding to the reference signs "AA" to "SA" of the first frame. That is, the gray scale ("AA") of the first, second, and third rows in the first frame and the gray scale ("AA") of the first and second rows in the second frame are equal to each other. The gray scale ("KA") of the fourth, fifth, and sixth rows in the first frame and the gray scale ("KA") of the third and fourth rows in the second frame are equal to each other. The gate signals G1 to G7 serve as gate-on potentials during the first to seventh 1H periods, respectively, in an active period (effective scanning period) of each frame, and serve as gate-off potentials during the other periods.

In the second frame, the CS signal CS1 in the first row is at a low level at a point in time where the corresponding gate signal G1 (which corresponds to the output SRO1 from the corresponding shift register circuit SR1) falls. The CS signal CS2 in the second row is at a low level at a point in time where the corresponding gate signal G2 falls. The CS signal CS3 in the third row is at a high level at a point in time where the corresponding gate signal G3 falls. The CS signal CS4 in the fourth row is at a high level at a point in time where the corresponding gate signal G4 falls. The CS signal CS5 in the fifth row is at a low level at a point in time where the corresponding gate signal G5 falls.

Then, the CS signals CS1 and CS2 rise after their corresponding gate signals G1 and G2 fall, respectively, and the CS signals CS3 and CS4 fall after their corresponding signals G3 and G4 fall, respectively, and the CS signals CS5 and CS6 rise after their corresponding gate signals G1 and G2 fall, respectively.

Thus, in the first frame in which longitudinal triple-size display diving is carried out, the electric potential of each CS signal at a point in time where the gate signal falls varies every three rows in correspondence with the polarity of the source signal S; therefore, the electric potentials Vpix1 to Vpix7 of the pixel electrodes 14 are all properly shifted by the CS signals CS1 to CS7, respectively. Therefore, inputting of source signals S of the same gray scale causes the positive and negative potential differences between the electric potential of the counter electrode and the shifted potential of each of the pixel electrodes 14 to be equal to each other. That is, in the first frame, in which source signals having a negative polarity and the same electric potential (gray scale) are written to pixels corresponding to three adjacent rows in the same column of pixels and source signals having a positive polarity and the same electric potential (gray scale) are written to pixels corresponding to three adjacent pixels next to the three rows in the same column of pixels, the electric potentials of the CS signals corresponding to the first three rows are not polarity-reversed during the writing to the pixels corresponding to the first three rows, are polarity-reversed in a negative direction after the writing, and are not polarity-reversed until the next writing, and the electric potentials of the CS signals corresponding to the next three rows are not polarity-reversed during the writing to the pixels corresponding to the next three rows, are polarity-reversed in a positive direction after the writing, and are not polarity-reversed until the next writing. This achieves longitudinal triple-size display driving (3-line inversion driving) in CC driving. Further, the foregoing configuration allows the electric potentials Vpix1 to Vpix7 of the pixel electrodes 14 to be properly shifted by the CS signals CS1 to CS7, thus making it possible to eliminate possible appearance of transverse stripes in the first frame of a display picture.

Further, in the second frame in which longitudinal double-size display diving is carried out, the electric potential of each CS signal at a point in time where the gate signal falls varies every two rows in correspondence with the polarity of the source signal S; therefore, the electric potentials Vpix1 to Vpix7 of the pixel electrodes 14 are all properly shifted by the CS signals CS1 to CS7, respectively. Therefore, inputting of source signals S of the same gray scale causes the positive and negative potential differences between the electric potential of the counter electrode and the shifted potential of each of the pixel electrodes 14 to be equal to each other. That is, in the second frame, in which source signals having a positive polarity and the same electric potential (gray scale) are written to pixels corresponding to two adjacent rows in the same column of pixels and source signals having a negative polarity and the same electric potential (gray scale) are written to pixels corresponding to two adjacent pixels next to the two rows in the same column of pixels, the electric potentials of the CS signals corresponding to the first two rows are not polarity-reversed during the writing to the pixels corresponding to the first two rows, are polarity-reversed in a positive direction after the writing, and are not polarity-reversed until the next writing, and the electric potentials of the CS signals corresponding to the next two rows are not polarity-reversed during the writing to the pixels corresponding to the next two rows, are polarity-reversed in a negative direction after the writing, and are not polarity-reversed until the next writing. This achieves longitudinal 2-line inversion driving in CC driving.

Moreover, the foregoing configuration allows the electric potentials Vpix1 to Vpix7 of the pixel electrodes 14 to be properly shifted by the CS signals CS1 to CS7, respectively, even in a case of a switch from longitudinal triple-size display driving (3-line inversion driving) to longitudinal double-size display driving (2-line inversion driving). This allows pixel electrodes 14 that are supplied with the same signal potential during the first and second frames to be equal in electric potential to each other, thus making it possible to eliminate the appearance of transverse stripes shown in FIG. 29.

Figure 20:
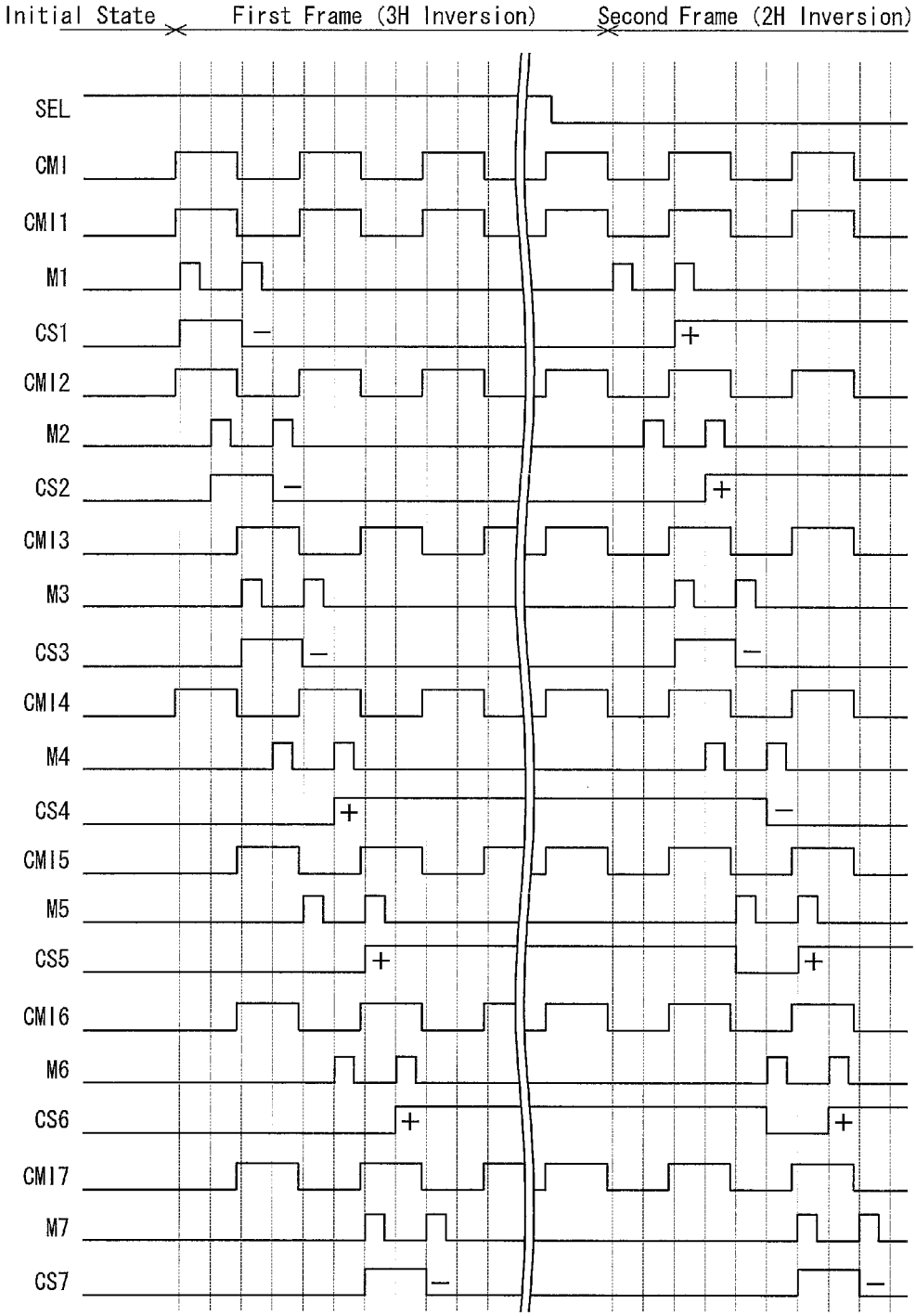
FIG. 20 is a timing chart showing waveforms of various signals that are inputted to and outputted from the CS bus line driving circuit in Example 6.

The operation of the liquid crystal display device 1 of Example 6 is described here with reference to FIGS. 19 and 20. FIG. 20 shows waveforms of various signals that are inputted to and outputted from the CS bus line driving circuit 40 of the liquid crystal display device 1 of Example 6. In the following, for convenience of description, mainly the CS circuits 42 and 43 corresponding to the second and third rows, respectively, are taken as an example.

First, the following describes changes in waveforms of various signals in the second row. In an initial state, the D latch circuit 42*a* of the CS circuit 42 receives the polarity signal CMI via its terminal D and receives the reset signal RESET via its reset terminal CL. The reset signal RESET causes the electric potential of the CS signal CS2 that the D latch circuit 42*a* outputs via its output terminal Q to be retained at a low level.

After that, the shift register output SRO2 corresponding to the gate signal G2 supplied to the gate line 12 in the second row is outputted from the shift register circuit SR2, and is inputted to one input terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 in the signal M2 via its clock terminal CK, the D latch circuit 42*a* transfers an input state of the polarity signal CMI (CMI2 in FIG. 18) that it received via its terminal D at the point in time, i.e., transfers a high level. That is, the electric potential of the CS signal CS2 is switched from a low level to a high level at a time when there is a change (from low to high) in electric potential of the shift register output SRO2. The D latch circuit 42*a* outputs the high level until there is a change (from high to low) in electric potential of the shift register output SRO2 in the signal M2 inputted to the clock terminal CK (i.e., during a period of time in which the signal M2 is at a high level). Next, upon receiving a change (from high to low) in electric potential of the shift register output SRO2 in the signal M2 via its clock terminal CK, the D latch circuit 42*a* latches an input state of the polarity signal CMI2 that it received at the point in time, i.e., latches a high level. After that, the D latch circuit 42*a* retains the high level until the signal M2 is raised to a high level.

Then, the shift register output SRO4 that has been shifted to the fourth row in the gate line driving circuit 30 is supplied to the other input terminal of the OR circuit 42*b*. The shift register output SRO4 is supplied also to one input terminal of the OR circuit 44*b* of the CS circuit 44.

The D latch circuit 42*a* receives a change (from low to high) in electric potential of the shift register output SRO4 in the signal M2 via its clock terminal CK, and transfers an input state of the polarity signal CMI2 that it received via its terminal D at the point in time, i.e., transfers a low level. That is, the electric potential of the CS signal CS2 is switched from a high level to a low level at a time when there is a change (from low to high) in electric potential of the shift register output SRO4. The D latch circuit 42*a* outputs the low level until there is a change (from high to low) in electric potential of the shift register output SRO4 in the signal M2 inputted to the clock terminal CK (i.e., during a period of time in which the signal M2 is at a high level). Next, upon receiving a change (from high to low) in electric potential of the shift register output SRO4 in the signal M2 via its clock terminal CK, the D latch circuit 42*a* latches an input state of the polarity signal CMI2 that it received at the point in time, i.e., latches a low level.

After that, the D latch circuit 42*a* retains the low level until the signal M2 is raised to a high level in the second frame.

In the second frame, the shift register output SRO2 is outputted from the shift register circuit SR2 and inputted to one input terminal of the OR circuit 42*b* of the CS circuit 42. Then, a change (from low to high) in electric potential of the shift register output SRO2 in the signal M2 is inputted to the clock terminal CK. Upon receiving the change (from low to high) in electric potential of the shift register output SRO2 in the signal M2 via its clock terminal CK, the D latch circuit 42*a* transfers an input state of the polarity signal CMI2 (CMI) that it received via its terminal D at the point in time, i.e., transfers a low level. After the D latch circuit 42*a* transfers the input state (low level) of the polarity signal CMI2 that it received via its data terminal D during a period of time in which the shift register output SRO2 in the signal M2 is at a high level, the D latch circuit 42*a* latches an input state (low level) of the polarity signal CMI2 at a point in time where it received a change (from high to low) in electric potential of the shift register output SRO2. Then, the D latch circuit 42*a* retains the low level until the next time when the signal M2 is raised to a high level.

Then, the shift register output SRO4 that has been shifted to the fourth row in the gate line driving circuit 30 is supplied to the other input terminal of the OR circuit 42*b*. The shift register output SRO4 is supplied also to one input terminal of the OR circuit 44*b* of the CS circuit 44.

The D latch circuit 42*a* receives a change (from low to high) in electric potential of the shift register output SRO4 via its clock terminal CK, and transfers an input state of the polarity signal CMI2 that it received via its terminal D at the point in time, i.e., transfers a high level. That is, the electric potential of the CS signal CS2 is switched from a low level to a high level at a time when there is a change (from low to high) in electric potential of the shift register output SRO4. The D latch circuit 42*a* outputs the high level until there is a change (from high to low) in electric potential of the shift register output SRO4 inputted to the clock terminal CK (i.e., during a period of time in which the signal M2 is at a high level). Next, upon receiving a change (from high to low) in electric potential of the shift register output SRO2 via its clock terminal CK, the D latch circuit 42*a* latches an input state of the polarity signal CMI2 that it received at the point in time, i.e., latches a high level. After that, the D latch circuit 42*a* retains the high level until the signal M2 is raised to a high level in the third frame.

Next, the following describes changes in waveforms of various signals in the third row. In an initial state, the D latch circuit 43*a* of the CS circuit 43 receives the polarity signal CMI via its data terminal D and receives the reset signal RESET via its reset terminal CL. The reset signal RESET causes the electric potential of the CS signal CS3 that the D latch circuit 43*a* outputs via its output terminal Q to be retained at a low level.

After that, the shift register output SRO3 corresponding to the gate signal G3 supplied to the gate line 12 in the third row is outputted from the shift register circuit SR3, and is inputted to one input terminal of the OR circuit 43*b* of the CS circuit 43. Then, a change (from low to high) in electric potential of the shift register output SRO3 in the signal M3 is inputted to the clock terminal CK. Upon receiving the change (from low to high) in electric potential of the shift register output SRO3 in the signal M3 via its clock terminal CK, the D latch circuit 43*a* transfers an input state of the polarity signal CMIB (CMI3 in FIG. 18) that it received via its data terminal D at the point in time, i.e., transfers a high level. Then, the D latch circuit 43*a* outputs the high level until the next time when there is a change (from high to low) in electric potential of the shift register output SRO3 in the signal M3 inputted to the clock terminal CK (i.e., during a period of time in which the signal M3 is at a high level). Then, upon receiving a change (from high to low) in electric potential of the shift register output SRO3 in the signal M3 via its clock terminal CK, the D latch circuit 43*a* latches an input state of the polarity signal CMI3 that it received at the point in time, i.e., latches a high level. After that, the D latch circuit 43*a* retains the high level until the signal M3 is raised to a high level.

Then, the shift register output SRO5 that has been shifted to the fifth row in the gate line driving circuit 30 is supplied to the other input terminal of the OR circuit 43*b*. The shift register output SRO5 is supplied also to one input terminal of the OR circuit 45*b* of the CS circuit 45.

The D latch circuit 43*a* receives a change (from low to high) in electric potential of the shift register output SRO5 in the signal M3 via its clock terminal CK, and transfers an input state of the polarity signal CMI3 that it received via its terminal D at the point in time, i.e., transfers a low level. That is, the electric potential of the CS signal CS3 is switched from a high level to a low level at a time when there is a change (from low to high) in electric potential of the shift register output SRO5. The D latch circuit 43*a* outputs the low level until the next time when there is a change (from high to low) in electric potential of the shift register output SRO5 in the signal M3 inputted to the clock terminal CK (i.e., during a period of time in which the signal M3 is at a high level). Next, upon receiving a change (from high to low) in electric potential of the shift register output SRO5 in the signal M3 via its clock terminal CK, the D latch circuit 43*a* latches an input state of the polarity signal CMI3 that it received at the point in time, i.e., latches a low level. After that, the D latch circuit 43*a* retains the low level until the signal M3 is raised to a high level in the second frame.

In the second frame, the shift register output SRO3 is outputted from the shift register circuit SR3 and inputted to one input terminal of the OR circuit 43*b* of the CS circuit 43. Then, a change (from low to high) in electric potential of the shift register output SRO3 in the signal M3 is inputted to the clock terminal CK. Upon receiving the change (from low to high) in electric potential of the shift register output SRO3 in the signal M3 via its clock terminal CK, the D latch circuit 43*a* transfers an input state of the polarity signal CMI3 (CMI) that it received via its terminal D at the point in time, i.e., transfers a high level. That is, the electric potential of the CS signal CS3 is switched from a low level to a high level at a time when there is a change (from low to high) in electric potential of the shift register output SRO3. The D latch circuit 43*a* outputs the high level until there is a change (from high to low) in electric potential of the shift register output SRO3 in the signal M3 inputted to the clock terminal CK (i.e., during a period of time in which the signal M3 is at a high level). Next, upon receiving a change (from high to low) in electric potential of the shift register output SRO3 in the signal M3 via its clock terminal CK, the D latch circuit 43*a* latches an input state of the polarity signal CMI3 that it received at the point in time, i.e., latches a high level. After that, the D latch circuit 43*a* retains the high level until the signal M3 is raised to a high level.

Then, the shift register output SRO5 that has been shifted to the fifth row in the gate line driving circuit 30 is supplied to the other input terminal of the OR circuit 43*b*. The shift register output SRO5 is supplied also to one input terminal of the OR circuit 45*b* of the CS circuit 45.

The D latch circuit 43*a* receives a change (from low to high) in electric potential of the shift register output SRO5 in the signal M3 via its clock terminal CK, and transfers an input state of the polarity signal CMI3 that it received via its terminal D at the point in time, i.e., transfers a low level. That is, the electric potential of the CS signal CS3 is switched from a high level to a low level at a time when there is a change SRO5 (from low to high) in electric potential of the shift register output. The D latch circuit 43*a* outputs the low level until there is a change (from high to low) in electric potential of the shift register output SRO5 in the signal M3 inputted to the clock terminal CK (i.e., during a period of time in which the signal M3 is at a high level). Next, upon receiving a change (from high to low) in electric potential of the shift register output SRO5 in the signal M3 via its clock terminal CK, the D latch circuit 43*a* latches an input state of the polarity signal CMI3 that it received at the point in time, i.e., latches a low level. After that, the D latch circuit 43*a* retains the low level until the signal M3 is raised to a high level in the third frame.

Note that, in the fourth row, the polarity signal CMI is latched (i) in accordance with the shift register outputs SRO4 and SRO6 in the first frame and (ii) in accordance with the shift register outputs SRO4 and SRO6 in the second frame, thereby a CS signal CS4 shown in FIG. 20 is outputted. In the fifth row, (a) the polarity signal CMIB is latched in accordance with the shift register outputs SRO5 and SRO7 in the first frame and (b) the polarity signal CMI is latched in accordance with the shift register outputs SRO5 and SRO7 in the second frame, thereby a CS signal CS5 shown in FIG. 20 is outputted.

As described above, in each first frame, each of the CS circuits 41, 42, 43, . . . , and 4*n* corresponding to the respective rows makes it possible, in 3-line inversion driving, to switch the electric potential of a CS signal at a point in time where a gate signal in a corresponding row falls (at a point in time where a TFT13 is switched from on to off) between high and low levels after the gate signal in this row falls. Further, in each second frame, each of the CS circuits 41, 42, 43, . . . , and 4*n* corresponding to the respective rows makes it possible, in 2-line inversion driving, to switch the electric potential of a CS signal at a point in time where a gate signal in a corresponding row falls (at a point in time where a TFT13 is switched from on to off) between high and low levels after the gate signal in this row falls.

That is, in the first frame in which 3-line inversion driving is carried out, (i) a CS signal CSn supplied to the CS bus line 15 in the nth row is generated by latching an electric potential level of the polarity signal CMI or CMIB at a point in time where the gate signal Gn in the nth row rises and an electric potential level of the polarity signal CMI or CMIB at a point in time where the gate signal G(n+2) in the (n+2)th row rises and (ii) a CS signal CSn+1 supplied to the CS bus line 15 in the (n+1)th row is generated by latching an electric potential level of the polarity signal CMI or CMIB at a point in time where the gate signal G(n+1) in the (n+1)th row rises and an electric potential level of the polarity signal CMI or CMIB at a point in time where the gate signal G(n+3) in the (n+3)th row rises.

Further, in the second frame in which 2-line inversion driving is carried out, (i) a CS signal CSn supplied to the CS bus line 15 in the nth row is generated by latching an electric potential level of the polarity signal CMI at a point in time where the gate signal Gn in the nth row rises and an electric potential level of the polarity signal GMI at a point in time where the gate signal G(n+2) in the (n+2)th row rises and (ii) a CS signal CSn+1 supplied to the CS bus line 15 in the (n+1)th row is generated by latching an electric potential level of the polarity signal CMI at a point in time where the gate signal G(n+1) in the (n+1)th row rises and an electric potential level of the polarity signal CMI at a point in time where the gate signal G(n+3) in the (n+3)th row rises.

This allows the CS bus line driving circuit 40 to operate properly both in longitudinal triple-size display driving and longitudinal double-size display driving, thus making it possible to prevent the appearance of transverse stripes in the first frame and to eliminate possible appearance of transverse stripes due to a switch from longitudinal triple-size display driving to longitudinal double-size display driving.

Figure 21:
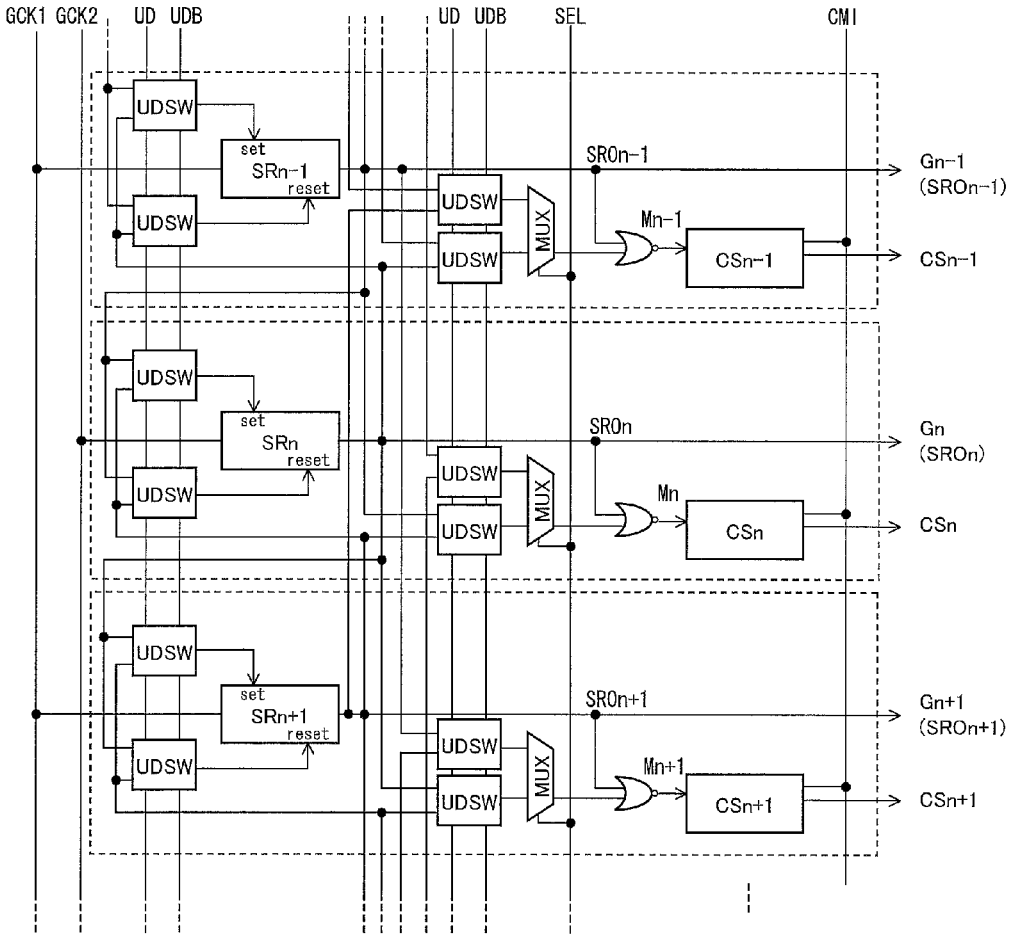
FIG. 21 is a block diagram showing another configuration of a gate line driving circuit and a CS bus line driving circuit shown in FIG. 3.

FIG. 21 shows a liquid crystal display device, which is the same as that shown in FIG. 3 except that it has a function of switching between scanning directions. According to the liquid crystal display device shown in FIG. 21, up-and-down switching circuits UDSW are provided in such a way as to correspond to each row. Each of the up-and-down switching circuits UDSW receives a UD signal and a UDB signal (logically inverted version of the UD signal) which are supplied from the control circuit 60 (see FIG. 1). Specifically, up-and-down switching circuits UDSW in the nth row receive a shift register output SRBOn−1 in the (n−1)th row and a shift register output SRBOn+1 in the (n+1)th row, and select one of these outputs in accordance with the UD signal and the UDB signal supplied from the control circuit 60. For example, when the UD signal is at a high level (UDB signal is at a low level), the up-and-down switching circuits UDSW in the nth row select the shift register output SRBOn−1 in the (n−1)th row, thereby choosing a downward scanning direction (i.e., the (n−1)th row→the nth row→the (n+1)th row). When the UD signal is at a low level (UDB signal is at a high level), the up-and-down switching circuits UDSW in the nth row select the shift register output SRBOn+1 in the (n+1)th row, thereby choosing an upward scanning direction (that is, the (n+1)th row→the nth row→the (n−1)th row). This makes it possible to achieve a two-scanning-direction display driving circuit.

Figure 22:
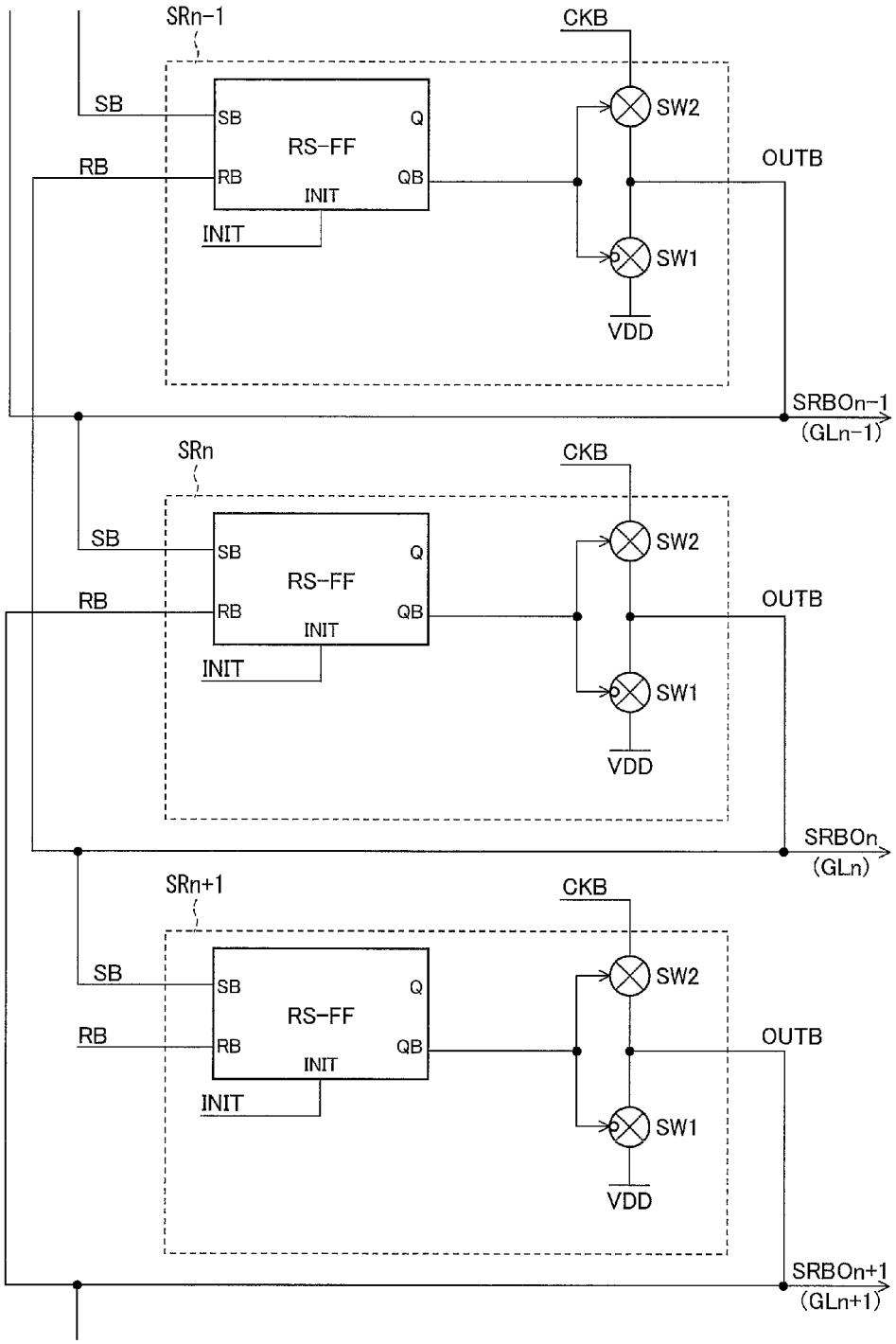
FIG. 22 is a block diagram showing details of the gate line driving signal shown in FIG. 21.
Figure 23:
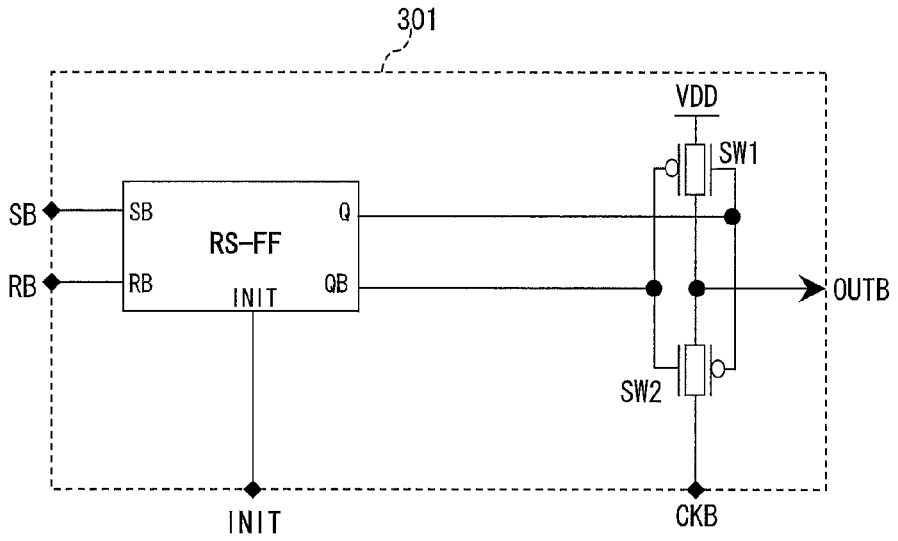
FIG. 23 is a block diagram showing a configuration of a shift register circuit constituting the gate line driving circuit shown in FIG. 22.
Figure 24:
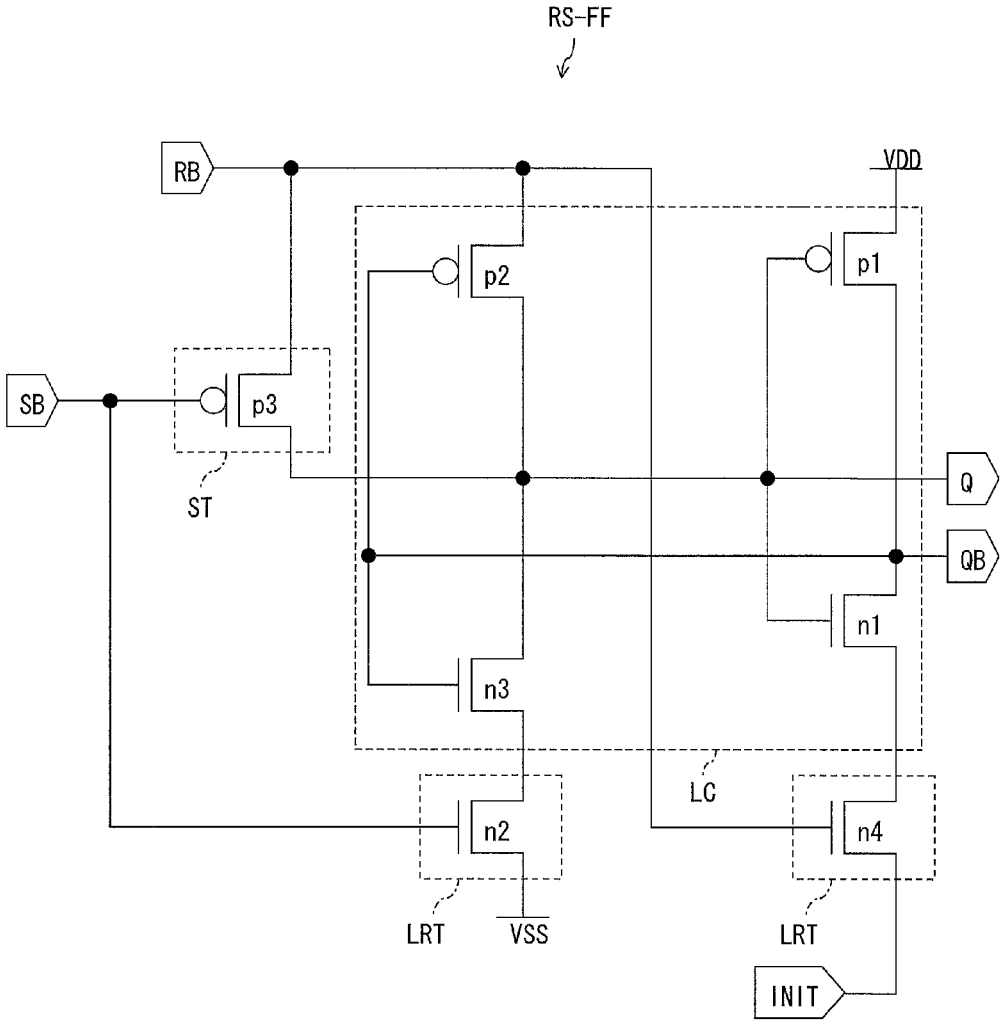
FIG. 24 is a circuit diagram showing a configuration of a flip-flop constituting the shift register circuit shown in FIG. 23.

Further, the gate line driving circuit 30 in the liquid crystal display device in accordance with the present invention can be configured as shown in FIG. 22. FIG. 21, described above, is a block diagram showing a configuration of a liquid crystal display device including this gate line driving circuit 30. FIG. 23 is a block diagram showing a configuration of a shift register circuit 301 constituting this gate line driving circuit 30. The shift register circuit 301 in each stage includes a flip-flop RS-FF and switch circuits SW1 and SW2. FIG. 24 is a circuit diagram showing a configuration of the flip-flop RS-FF.

As shown in FIG. 24, the flip-flop RS-FF has: a P-channel transistor p2 and an N-channel transistor n3 which constitute a CMOS circuit; a P-channel transistor p1 and an N-channel transistor n1 which constitute a CMOS circuit; a P-channel transistor p3; an N-channel transistor n2; an N-channel transistor 4; an SB terminal; an RB terminal; an INIT terminal; a Q terminal; and a QB terminal. In the flip-flop RS-FF, a gate of the p2, a gate of the n3, a drain of the p1, a drain of the n1 and the QB terminal are connected with one another; a drain of the p2, a drain of the n3, a drain of the p3, a gate of the p1, a gate of the n1 and the Q terminal are connected with one another; a source of the n3 is connected with a drain of the n2; the SB terminal is connected with a gate of the p3 and a gate of the n2; the RB terminal is connected with a source of the p3, a source of the p2 and a gate of the n4; a source of the n1 and a drain of the n4 are connected with each other; the INIT terminal is connected with a source of the n4; a source of the p1 is connected with a VDD; and a source of the n2 is connected with a VSS. Note here that the p2, n3, p1 and n1 constitute a latch circuit LC; the p3 functions as a set transistor ST; and the n2 and n4 each function as a latch release transistor LRT.

Figure 25:
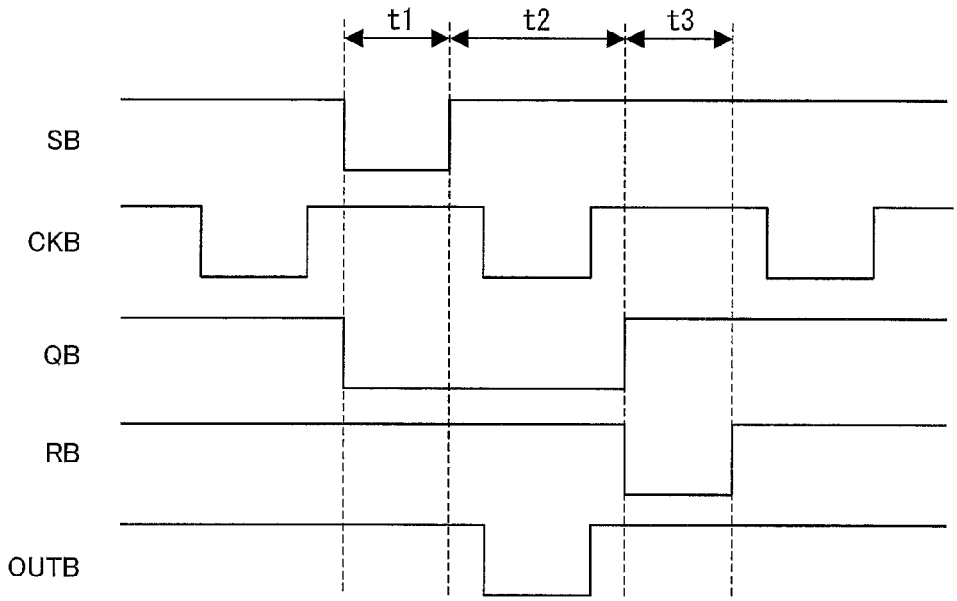
FIG. 25 is a timing chart showing an operation of the flip-flop shown in FIG. 24.
Figure 26:
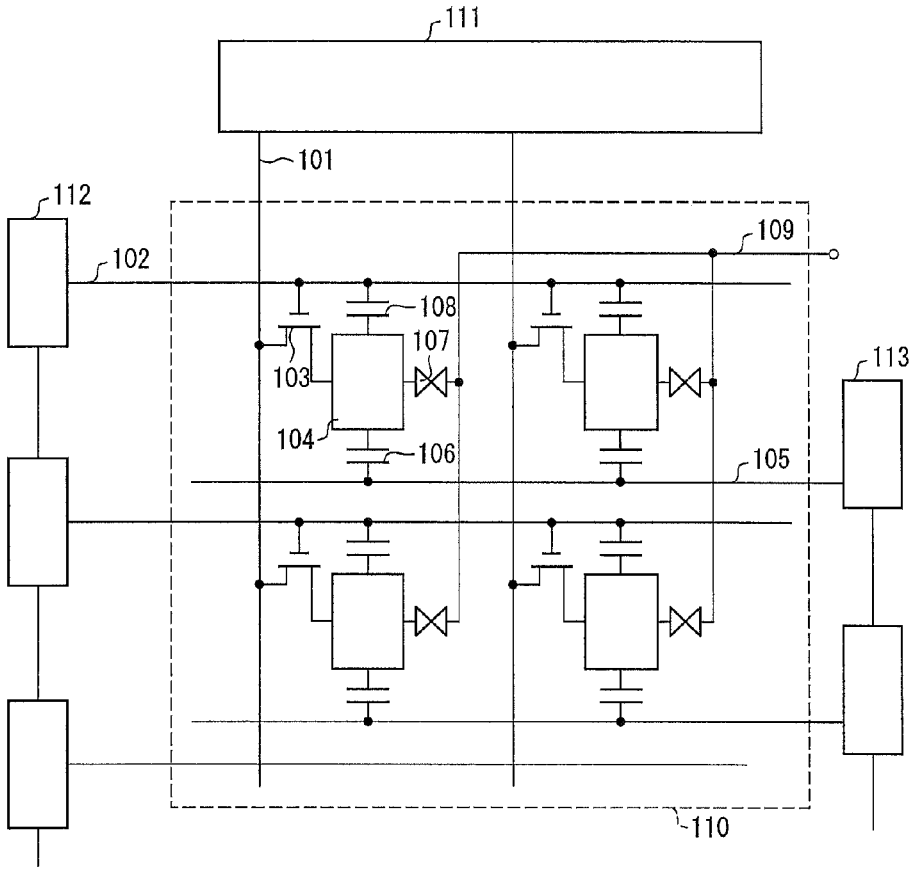
FIG. 26 is a block diagram showing a configuration of a conventional liquid crystal display device employing CC driving.
Figure 27:
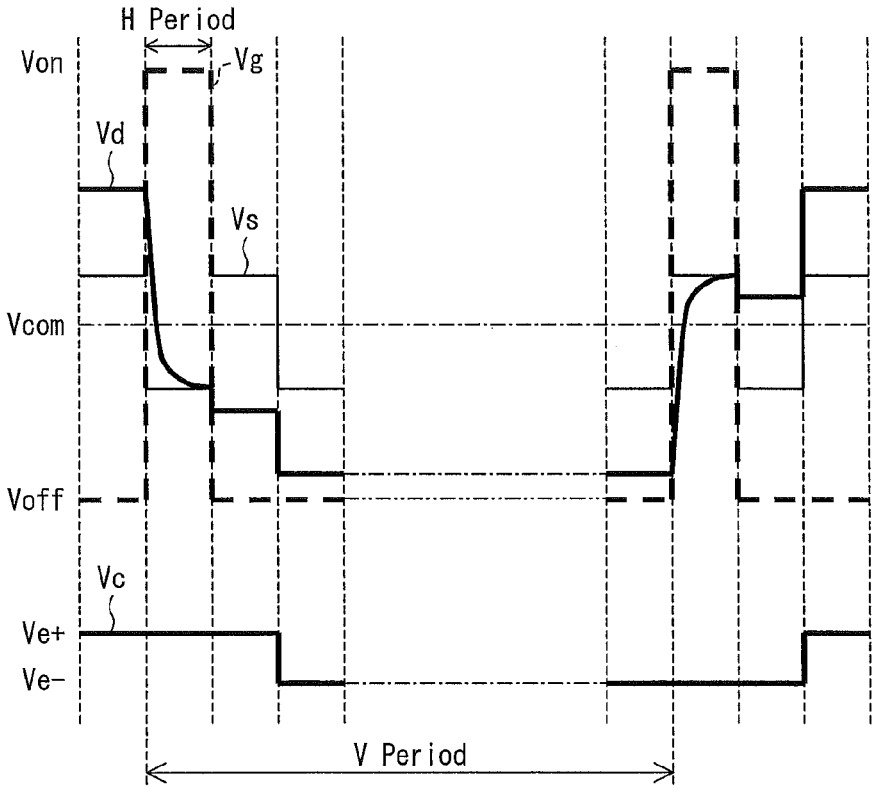
FIG. 27 is a timing chart showing waveforms of various signals in the liquid crystal display device shown in FIG. 26.

FIG. 25 is a timing chart illustrating how the flip-flop RS-FF operates. For example, at t1 in FIG. 25, Vdd from the RB terminal is supplied to the Q terminal, whereby the n1 is switched ON and INIT (Low) is supplied to the QB terminal. At t2, the SB signal becomes High and the p3 is switched OFF and the n2 is switched ON, whereby the state at t1 is maintained. At t3, the RB signal becomes Low, whereby the p1 is switched ON and Vdd (High) is supplied to the QB terminal.

As shown in FIG. 23, the QB terminal of the flip-flop RS-FF is connected with a gate of the switch circuit SW1 which gate is on the N-channel side, and with a gate of the switch circuit SW2 which gate is on the P-channel side. A conductive electrode of the switch circuit SW1 is connected with the VDD. The other conductive electrode of the switch circuit SW1 is connected with an OUTB terminal serving as an output terminal in this stage and with a conductive electrode of the switch circuit SW2. The other conductive electrode of the switch circuit SW2 is connected with a CKB terminal for receiving a clock signal.

According to the shift register circuit 301, while the QB signal from the flip-flop FF is Low, the switch SW2 is OFF and the switch circuit SW1 is ON, whereby the OUTB signal becomes High. While the QB signal is High, the switch circuit SW2 is turned ON and the switch circuit SW1 is turned OFF, whereby the CKB signal is loaded and outputted from the OUTB terminal.

According to the shift register circuit 301, an OUTB terminal of a current stage is connected with an SB terminal of a next stage, and an OUTB terminal of the next stage is connected with an RB terminal of the current stage. For example, the OUTB terminal of the shift register circuit SRn in the nth stage is connected with the SB terminal of the shift register circuit SRn+1 in the (n+1)th stage, and the OUTB terminal of the shift register circuit SRn+1 in the (n+1)th stage is connected with the RB terminal of the shift register circuit SRn in the nth stage. Note that the shift register circuit SR in the first stage, i.e., the shift register circuit SR1, receives a GSPB signal via its SB terminal. Further, in a gate driver GD, CKB terminals in the odd-numbered stages and CKB terminals in the even-numbered stages are connected with different GCK lines (lines that supplies GCK), and INIT terminals in respective stages are connected with an identical INIT line (line that supplies INIT signal). For example, the CKB terminal of the shift register circuit SRn in the nth stage is connected with a GCK2 line, the CKB terminal of the shift register circuit SRn+1 in the (n+1)th stage is connected with a GCK1 line, and the INIT terminal of the shift register circuit SRn in the nth stage and the INIT terminal of the shift register circuit SRn+1 in the (n+1)th stage are connected with an identical INIT signal line.

A display driving circuit according to the present invention is a display driving circuit for use in a display device in which by supplying retention capacitor wire signals to retention capacitor wires forming capacitors with pixel electrodes included in pixels, signal potentials written to the pixel electrodes from data signal lines are changed in a direction corresponding to polarities of the signal potentials, the display driving circuit alternately switching between (i) a first mode in which to carry out a display by converting resolution of a video signal by a factor of n (n is an integer of two or greater) at least in a column-wise direction, assuming that a direction in which scanning signal lines extend is a row-wise direction, and (ii) a second mode in which to carry out a display by converting the resolution of the video signal by a factor of m (m is an integer different from n) at least in the column-wise direction, during the first mode, signal potentials having the same polarity and the same gray scale being supplied to pixel electrodes included in respective n pixel(s) that correspond to n adjacent scanning signal line(s) and that are adjacent to each other in the column-wise direction, a direction of change in the signal potentials written to the pixel electrodes from the data signal lines varying every n adjacent row(s), during the second mode, signal potentials having the same polarity and the same gray scale being supplied to pixel electrodes included in respective m pixel(s) that correspond to m adjacent scanning signal line(s) and that are adjacent to each other in the column-wise direction, and the direction of change in the signal potentials written to the pixel electrodes from the data signal lines varying every m adjacent row(s).

According to the display driving circuit, the signal potentials written to the pixel electrodes are changed by the retention capacitor wire signals in the direction corresponding to the polarity of the signal potential. This achieves the CC driving.

The display driving circuit is configured to alternately switch, in such CC driving, between (i) a first mode in which to carry out a display by converting resolution of a video signal by a factor of n (n is an integer of two or greater) at least in a column-wise direction, and (ii) a second mode in which to carry out a display by converting the resolution of the video signal by a factor of m (m is an integer different from n) at least in the column-wise direction. Further, during the first mode, the display driving circuit supplies signal potentials having the same gray scale to pixel electrodes included in respective n pixel(s) that are adjacent to each other in the column-wise direction, and carries out n-line inversion driving. During the second mode, the display driving circuit supplies signal potentials having the same gray scale to pixel electrodes included in respective m pixel(s) that are adjacent to each other in the column-wise direction, and carries out m-line inversion driving.

Figure 29:
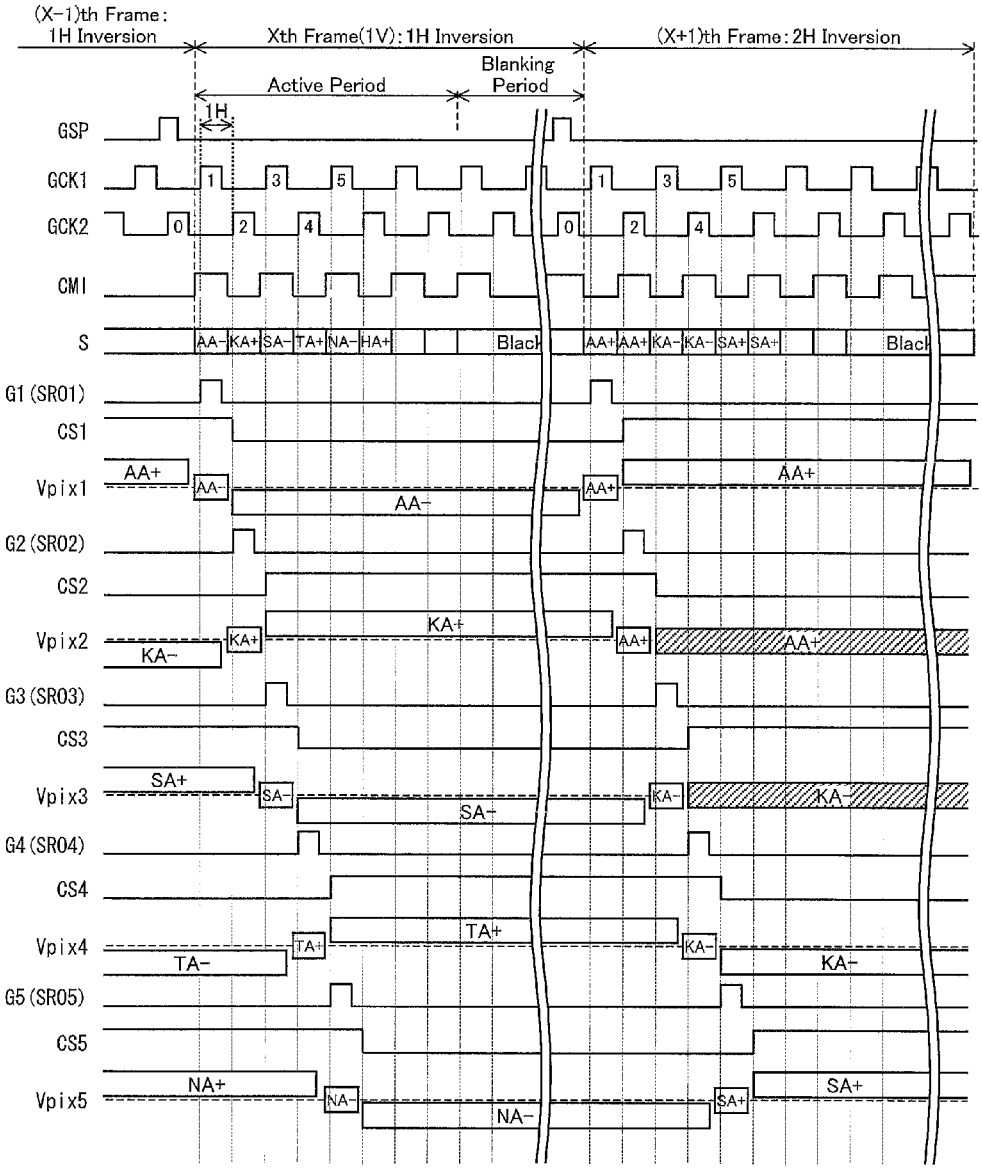
FIG. 29 is a timing chart showing waveforms of various signals observed in a case where a conventional liquid crystal display device has switched from normal display driving to resolution conversion driving (double-size display driving).

This allows the signal potentials written to the pixel electrodes to be properly subjected to an electric potential shift, thus making it possible to eliminate the appearance of alternate bright and dark transverse stripes in a display picture (see FIG. 29). This allows a display device employing CC driving to, without lowering display quality, alternately switch between (i) a first mode in which to carry out a display by converting resolution of a video signal by a factor of n (n is an integer) and (ii) a second mode in which to carry out a display by converting the resolution of the video signal by a factor of m (m is an integer different from n).

The display driving circuit may be configured to include a shift register including a plurality of stages provided in such a way as to correspond to a plurality of scanning signal lines, respectively, the display driving circuit having retaining circuits provided in such a way as to correspond one-by-one to the respective stages of the shift register, a retention target signal being inputted to each of the retaining circuits, an output signal from a current stage and an output signal from a subsequent stage that is later than the current stage being inputted to a logic circuit corresponding to the current stage, when an output from the logic circuit becomes active, a retaining circuit corresponding to the current stage loading and retaining the retention target signal, the output signal from the current stage being supplied to a scanning signal line connected to pixels corresponding to the current stage, and an output from the retaining circuit corresponding to the current stage being supplied as the retention capacitor wire signal to a retention capacitor wire that forms capacitors with pixel electrodes of the pixels corresponding to the current stage, the retention target signal that is inputted to each of the retaining circuits being set according to each of the modes.

The display driving circuit may be configured such that: each of the retaining circuits loads and retains the retention target signal at timings at which the output signal from the current stage and the output signal from the subsequence stage, both inputted via the corresponding logic circuit, become active, respectively; and the retention target signal is a signal whose polarity is reversed in a predetermined cycle, and varies in polarity between the timing at which the output signal from the current signal becomes active and the timing at which the output signal from the subsequent signal become active.

The display driving circuit may be configured such that the output signal from the subsequent stage as inputted during the first mode to the retaining circuit corresponding to the current stage and the output signal from the subsequent stage as inputted during the second mode to the retaining circuit corresponding to the current stage are outputted from different stages from each other.

The display driving circuit may be configured such that: the retention target signal is a signal whose polarity is reversed in a predetermined cycle; and the polarity is reversed in different cycles between the first mode and the second mode.

The display driving circuit may be configured such that: during a mode in which the polarities of the signal potentials that are supplied to the data signal lines are reversed every single horizontal scanning period, the retaining circuit corresponding to the xth stage retains the retention target signal when an output signal from the xth stage in the shift register becomes active and retains the retention target signal when an output signal from the (x+1)th stage in the shift register becomes active; during a mode in which the polarities of the signal potentials that are supplied to the data signal lines are reversed every two horizontal scanning periods, the retaining circuit corresponding to the xth stage retains the retention target signal when an output signal from the xth stage in the shift register becomes active and retains the retention target signal when an output signal from the (x+2)th stage in the shift register becomes active; and during a mode in which the polarities of the signal potentials that are supplied to the data signal lines are reversed every three horizontal scanning periods, the retaining circuit corresponding to the xth stage retains the retention target signal when an output signal from the xth stage in the shift register becomes active and retains the retention target signal when an output signal from the (x+3)th stage in the shift register becomes active.

The display driving circuit may be configured to include a shift register including a plurality of stages provided in such a way as to correspond to a plurality of scanning signal lines, respectively, the display driving circuit having retaining circuits provided in such a way as to correspond one-by-one to the respective stages of the shift register, a retention target signal being inputted to each of the retaining circuits, an output signal from a current stage and an output signal from a subsequent stage that is later than the current stage being inputted to a logic circuit corresponding to the current stage, when an output from the logic circuit becomes active, a retaining circuit corresponding to the current stage loading and retaining the retention target signal, the output signal from the current stage being supplied to a scanning signal line connected to pixels corresponding to the current stage, and an output from the retaining circuit corresponding to the current stage being supplied as the retention capacitor wire signal to a retention capacitor wire that forms capacitors with pixel electrodes of the pixels corresponding to the current stage, phases of the retention target signals that are inputted to a plurality of retaining circuits and phases of the retention target signals that are inputted to another plurality of retaining circuits being set according to each of the modes.

The display driving circuit may be configured such that wherein each of the retaining circuits is constituted as a D latch circuit or a memory circuit.

A display device according to the present invention includes: any one of the display driving circuits above; and a display panel.

A display driving method according to the present invention is a display driving method for driving a display device in which by supplying retention capacitor wire signals to retention capacitor wires forming capacitors with pixel electrodes included in pixels, signal potentials written to the pixel electrodes from data signal lines are changed in a direction corresponding to polarities of the signal potentials, the display driving method comprising alternately switching between (i) a first mode in which to carry out a display by converting resolution of a video signal by a factor of n (n is an integer of two or greater) at least in a column-wise direction, assuming that a direction in which scanning signal lines extend is a row-wise direction, and (ii) a second mode in which to carry out a display by converting the resolution of the video signal by a factor of m (m is an integer different from n) at least in the column-wise direction, during the first mode, signal potentials having the same polarity and the same gray scale being supplied to pixel electrodes included in respective n pixel(s) that correspond to n adjacent scanning signal line(s) and that are adjacent to each other in the column-wise direction, a direction of change in the signal potentials written to the pixel electrodes from the data signal lines varying every n adjacent row(s), during the second mode, signal potentials having the same polarity and the same gray scale being supplied to pixel electrodes included in respective m pixel(s) that correspond to m adjacent scanning signal line(s) and that are adjacent to each other in the column-wise direction, and the direction of change in the signal potentials written to the pixel electrodes from the data signal lines varying every m adjacent row(s).

The display driving method can bring about the same effects as those brought about by the configuration of the display driving circuit.

It should be noted that it is desirable that a display device according to the present invention be a liquid crystal display device.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention can be suitably applied, in particular, to driving of an active-matrix liquid crystal display device.

REFERENCE SIGNS LIST

1 Liquid crystal display device (display device)
10 Liquid crystal display panel (display panel)
11 Source bus line (data signal line)
12 Gate line (scanning signal line)
13 TFT (switching element)
14 Pixel electrode
15 CS bus line (retention capacitor wire)
20 Source bus line driving circuit (data signal line driving circuit)

30 Gate line driving circuit (scanning signal line driving circuit)
40 CS bus line driving circuit (retention capacitor wire driving circuit)
4*na* D latch circuit (retaining circuit, retention capacitor wire driving circuit)
4*nb* OR circuit (logic circuit)
50 Control circuit
SR Shift register circuit
CMI Polarity signal (retention target signal)
SRO Shift register output (control signal)

The invention claimed is:

1. A display driving circuit for use in a display device in which by supplying retention capacitor wire signals to retention capacitor wires forming capacitors with pixel electrodes included in pixels, signal potentials written to the pixel electrodes from data signal lines are changed in a direction corresponding to polarities of the signal potentials, the display device comprising:

a shift register including a plurality of stages provided in such a way as to correspond to a plurality of scanning signal lines, respectively, said display driving circuit alternately switching between (i) a first mode in which to carry out a display by converting resolution of a video signal by a factor of n at least in a column-wise direction, assuming that a direction in which scanning signal lines extend is a row-wise direction, and (ii) a second mode in which to carry out a display by converting the resolution of the video signal by a factor of m at least in the column-wise direction, n being an integer of two or greater, m being an integer different from n, during the first mode, signal potentials having the same polarity and the same gray scale being supplied to pixel electrodes included in respective n pixels that correspond to n adjacent scanning signal lines and that are adjacent to each other in the column-wise direction, a direction of change in the signal potentials written to the pixel electrodes from the data signal lines varying every n adjacent rows, during the second mode, signal potentials having the same polarity and the same gray scale being supplied to pixel electrodes included in respective m pixel(s) that correspond to m adjacent scanning signal line(s) and that are adjacent to each other in the column-wise direction, and the direction of change in the signal potentials written to the pixel electrodes from the data signal lines varying every m adjacent row(s), the display driving circuit having retaining circuits provided in such a way as to correspond one-by-one to the respective stages of the shift register, a retention target signal being inputted to each of the retaining circuits, an output signal from a current stage and an output signal from a subsequent stage that is later than the current stage being inputted to a logic circuit corresponding to the current stage, when an output from the logic circuit becomes active, a retaining circuit corresponding to the current stage loading and retaining the retention target signal, the output signal from the current stage being supplied to a scanning signal line connected to pixels corresponding to the current stage, and an output from the retaining circuit corresponding to the current stage being supplied as the retention capacitor wire signal to a retention capacitor wire that forms capacitors with pixel electrodes of the pixels corresponding to the current stage, the retention target signal that is inputted to each of the retaining circuits being set according to each of the modes, wherein the output signal from the subsequent stage as inputted during the first mode to the retaining circuit corresponding to the current stage and the output signal from the subsequent stage as inputted during the second mode to the retaining circuit corresponding to the current stage are outputted from different stages from each other.

2. The display driving circuit as set forth in claim 1, wherein:

each of the retaining circuits loads and retains the retention target signal at timings at which the output signal from the current stage and the output signal from the subsequence stage, both inputted via the corresponding logic circuit, become active, respectively; and the retention target signal is a signal whose polarity is reversed in a predetermined cycle, and varies in polarity between the timing at which the output signal from the current signal becomes active and the timing at which the output signal from the subsequent signal become active.

3. The display driving circuit as set forth in claim 1, wherein:

the retention target signal is a signal whose polarity is reversed in a predetermined cycle; and the polarity is reversed in different cycles between the first mode and the second mode.

4. The display driving circuit as set forth in claim 1, wherein:

during a mode in which the polarities of the signal potentials that are supplied to the data signal lines are reversed every single horizontal scanning period, the retaining circuit corresponding to the xth stage retains the retention target signal when an output signal from the xth stage in the shift register becomes active and retains the retention target signal when an output signal from the (x+1)th stage in the shift register becomes active;

during a mode in which the polarities of the signal potentials that are supplied to the data signal lines are reversed every two horizontal scanning periods, the retaining circuit corresponding to the xth stage retains the retention target signal when an output signal from the xth stage in the shift register becomes active and retains the retention target signal when an output signal from the (x+2)th stage in the shift register becomes active; and during a mode in which the polarities of the signal potentials that are supplied to the data signal lines are reversed every three horizontal scanning periods, the retaining circuit corresponding to the xth stage retains the retention target signal when an output signal from the xth stage in the shift register becomes active and retains the retention target signal when an output signal from the (x+3)th stage in the shift register becomes active.

5. The display driving circuit as set forth in claim 1, wherein each of the retaining circuits is constituted as a D latch circuit or a memory circuit.

6. A display device comprising:

a display driving circuit as set forth in claim 1; and a display panel.

7. A display driving circuit for use in a display device in which by supplying retention capacitor wire signals to retention capacitor wires forming capacitors with pixel electrodes included in pixels, signal potentials written to the pixel electrodes from data signal lines are changed in a direction corresponding to polarities of the signal potentials, the display device comprising:

a shift register including a plurality of stages provided in such a way as to correspond to a plurality of scanning signal lines, respectively, said display driving circuit alternately switching between (i) a first mode in which to carry out a display by converting resolution of a video signal by a factor of n at least in a column-wise direction, assuming that a direction in which scanning signal lines extend is a row-wise direction, and (ii) a second mode in which to carry out a display by converting the resolution of the video signal by a factor of m at least in the column-wise direction, n being an integer of two or greater, m being an integer different from n, during the first mode, signal potentials having the same polarity and the same gray scale being supplied to pixel electrodes included in respective n pixels that correspond to n adjacent scanning signal lines and that are adjacent to each other in the column-wise direction, a direction of change in the signal potentials written to the pixel electrodes from the data signal lines varying every n adjacent rows, during the second mode, signal potentials having the same polarity and the same gray scale being supplied to pixel electrodes included in respective m pixel(s) that correspond to m adjacent scanning signal line(s) and that are adjacent to each other in the column-wise direction, and the direction of change in the signal potentials written to the pixel electrodes from the data signal lines varying every m adjacent row(s), the display driving circuit having retaining circuits provided in such a way as to correspond one-by-one to the respective stages of the shift register, a retention target signal being inputted to plural ones of the retaining circuits, and one of the retention target signal and an inversion signal of the retention target signal being inputted to remaining plural ones of the retaining circuits according to each of the modes, an output signal from a current stage and an output signal from a subsequent stage that is later than the current stage being inputted to a logic circuit corresponding to the current stage, when an output from the logic circuit becomes active, a retaining circuit corresponding to the current stage loading and retaining the retention target signal, the output signal from the current stage being supplied to a scanning signal line connected to pixels corresponding to the current stage, and an output from the retaining circuit corresponding to the current stage being supplied as the retention capacitor wire signal to a retention capacitor wire that forms capacitors with pixel electrodes of the pixels corresponding to the current stage, phases of the retention target signals that are inputted to plural ones of the retaining circuits and phases of the retention target signals that are inputted to another plural ones of the retaining circuits being set according to each of the modes.

8. A display driving method for driving a display device in which by supplying retention capacitor wire signals to retention capacitor wires forming capacitors with pixel electrodes included in pixels, signal potentials written to the pixel electrodes from data signal lines are changed in a direction corresponding to polarities of the signal potentials, the display device including a shift register including a plurality of stages provided in such a way as to correspond to a plurality of scanning signal lines, respectively, said display driving method comprising:

alternately switching between (i) a first mode in which to carry out a display by converting resolution of a video signal by a factor of n at least in a column-wise direction, assuming that a direction in which scanning signal lines extend is a row-wise direction, and (ii) a second mode in which to carry out a display by converting the resolution of the video signal by a factor of m at least in the column-wise direction, n being an integer of two or greater, m being an integer different from n, during the first mode, signal potentials having the same polarity and the same gray scale being supplied to pixel electrodes included in respective n pixels that correspond to n adjacent scanning signal lines and that are adjacent to each other in the column-wise direction, a direction of change in the signal potentials written to the pixel electrodes from the data signal lines varying every n adjacent rows, during the second mode, signal potentials having the same polarity and the same gray scale being supplied to pixel electrodes included in respective m pixel(s) that correspond to m adjacent scanning signal line(s) and that are adjacent to each other in the column-wise direction, and the direction of change in the signal potentials written to the pixel electrodes from the data signal lines varying every m adjacent row(s), the display driving circuit having retaining circuits provided in such a way as to correspond one-by-one to the respective stages of the shift register, a retention target signal being inputted to each of the retaining circuits, an output signal from a current stage and an output signal from a subsequent stage that is later than the current stage being inputted to a logic circuit corresponding to the current stage, when an output from the logic circuit becomes active, a retaining circuit corresponding to the current stage loading and retaining the retention target signal, the output signal from the current stage being supplied to a scanning signal line connected to pixels corresponding to the current stage, and an output from the retaining circuit corresponding to the current stage being supplied as the retention capacitor wire signal to a retention capacitor wire that forms capacitors with pixel electrodes of the pixels corresponding to the current stage, the retention target signal that is inputted to each of the retaining circuits being set according to each of the modes, wherein the output signal from the subsequent stage as inputted during the first mode to the retaining circuit corresponding to the current stage and the output signal from the subsequent stage as inputted during the second mode to the retaining circuit corresponding to the current stage are outputted from different stages from each other.

9. A display driving method for driving a display device in which by supplying retention capacitor wire signals to retention capacitor wires forming capacitors with pixel electrodes included in pixels, signal potentials written to the pixel electrodes from data signal lines are changed in a direction corresponding to polarities of the signal potentials, the display device including a shift register including a plurality of stages provided in such a way as to correspond to a plurality of scanning signal lines, respectively, said display driving method comprising:

alternately switching between (i) a first mode in which to carry out a display by converting resolution of a video signal by a factor of n at least in a column-wise direction, assuming that a direction in which scanning signal lines extend is a row-wise direction, and (ii) a second mode in which to carry out a display by converting the resolution of the video signal by a factor of m at least in the column-wise direction, n being an integer of two or greater, m being an integer different from n, during the first mode, signal potentials having the same polarity and the same gray scale being supplied to pixel electrodes included in respective n pixels that correspond to n adjacent scanning signal lines and that are adjacent to each other in the column-wise direction, a direction of change in the signal potentials written to the pixel electrodes from the data signal lines varying every n adjacent rows, during the second mode, signal potentials having the same polarity and the same gray scale being supplied to pixel electrodes included in respective m pixel(s) that correspond to m adjacent scanning signal line(s) and that are adjacent to each other in the column-wise direction, and the direction of change in the signal potentials written to the pixel electrodes from the data signal lines varying every m adjacent row(s), the display driving circuit having retaining circuits provided in such a way as to correspond one-by-one to the respective stages of the shift register, a retention target signal being inputted to plural ones of the retaining circuits, and one of the retention target signal and an inversion signal of the retention target signal being inputted to remaining plural ones of the retaining circuits according to each of the modes, an output signal from a current stage and an output signal from a subsequent stage that is later than the current stage being inputted to a logic circuit corresponding to the current stage, when an output from the logic circuit becomes active, a retaining circuit corresponding to the current stage loading and retaining the retention target signal, the output signal from the current stage being supplied to a scanning signal line connected to pixels corresponding to the current stage, and an output from the retaining circuit corresponding to the current stage being supplied as the retention capacitor wire signal to a retention capacitor wire that forms capacitors with pixel electrodes of the pixels corresponding to the current stage, phases of the retention target signals that are inputted to plural ones of the retaining circuits and phases of the retention target signals that are inputted to another plural ones of the retaining circuits being set according to each of the modes.

* * * * *